US008240808B2

(12) United States Patent
Sasayama

(10) Patent No.: US 8,240,808 B2
(45) Date of Patent: Aug. 14, 2012

(54) INK-JET HEAD MAINTENANCE DEVICE, INK-JET RECORDING DEVICE AND INK-JET HEAD MAINTENANCE METHOD

(75) Inventor: Hiroyuki Sasayama, Kanagawa (JP)

(73) Assignee: Fujifilm Corporation, Tokyo (JP)

( * ) Notice: Subject to any disclaimer, the term of this patent is extended or adjusted under 35 U.S.C. 154(b) by 1196 days.

(21) Appl. No.: 12/027,755

(22) Filed: Feb. 7, 2008

(65) Prior Publication Data

US 2008/0186352 A1 Aug. 7, 2008

(30) Foreign Application Priority Data

Feb. 7, 2007 (JP) ..... 2007-027858
Feb. 7, 2007 (JP) ..... 2007-027905

(51) Int. Cl.
*B41J 2/165* (2006.01)

(52) U.S. Cl. ..... 347/30; 347/104

(58) Field of Classification Search ..... 347/30–33, 347/104
See application file for complete search history.

(56) References Cited

U.S. PATENT DOCUMENTS 3,647,138 A * 3/1972 Houser ..... 239/104
4,546,363 A * 10/1985 Iwagami ..... 347/28
4,558,326 A * 12/1985 Kimura et al. ..... 347/30
4,577,203 A * 3/1986 Kawamura ..... 347/30
4,825,229 A * 4/1989 Matsumoto et al. ..... 347/83
4,959,662 A * 9/1990 Kobayashi ..... 347/25
5,250,962 A * 10/1993 Fisher et al. ..... 347/32
5,359,907 A * 11/1994 Baker et al. ..... 73/865.5
5,412,411 A * 5/1995 Anderson ..... 347/28
5,552,811 A * 9/1996 Kurata et al. ..... 347/28
5,625,398 A * 4/1997 Milkovits et al. ..... 347/104
5,784,081 A * 7/1998 Ozaki et al. ..... 347/30
6,523,930 B2 * 2/2003 Griffin et al. ..... 347/28
6,565,186 B1 * 5/2003 Hattori et al. ..... 347/24
6,802,588 B2 * 10/2004 Garbacz et al. ..... 347/28
7,044,610 B2 * 5/2006 Beyer et al. ..... 359/509
7,114,793 B2 * 10/2006 Katsuta et al. ..... 347/22

(Continued)

FOREIGN PATENT DOCUMENTS

DE 3719704 A1 12/1987

(Continued)

OTHER PUBLICATIONS

Japanese Office Action issued in corresponding Japanese Patent Application No. 2007-027858 on Jun. 21, 2011 (partial translation is attached).

(Continued)

*Primary Examiner* — Charlie Peng
*Assistant Examiner* — Peter Radkowski
(74) *Attorney, Agent, or Firm* — Birch, Stewart, Kolasch & Birch, LLP

(57) ABSTRACT

A maintenance device for an ink-jet head having a head substrate on a surface of which orifices for ejecting ink droplets are formed in a row. A maintenance device includes a removal unit comprising a suction assembly which is disposed in a position that faces the surface of the head substrate having the orifices formed thereon and does not come into contact with the head substrate, and which has formed therein, on a surface opposite the head substrate surface on which the orifices are formed, a first and second suction ports, each being slit-like and elongated in a direction parallel to an orifice array direction; and a suction pump which draws air from inside the suction assembly.

24 Claims, 20 Drawing Sheets

U.S. PATENT DOCUMENTS

| | | | | |
|---|---|---|---|---|
| 2002/0085058 | A1* | 7/2002 | Griffin et al. | 347/28 |
| 2003/0016264 | A1* | 1/2003 | Jeanmaire | 347/28 |
| 2003/0104170 | A1* | 6/2003 | Johnston et al. | 428/167 |
| 2003/0142403 | A1* | 7/2003 | Kalley et al. | 359/509 |
| 2003/0197909 | A1* | 10/2003 | Beyer et al. | 359/196 |
| 2004/0017421 | A1* | 1/2004 | Jeanmaire | 347/22 |
| 2004/0227785 | A1* | 11/2004 | Katsuta et al. | 347/33 |

FOREIGN PATENT DOCUMENTS

| | | | | |
|---|---|---|---|---|
| EP | 1106359 | A1 | | 6/2001 |
| JP | 5-201028 | A | | 8/1993 |
| JP | 06047920 | A | * | 2/1994 |
| JP | 8-58103 | A | | 3/1996 |
| JP | 11-042791 | A | | 2/1999 |
| JP | 11042791 | A | * | 2/1999 |
| JP | 2000-062197 | A | | 2/2000 |
| JP | 2000062197 | A | * | 2/2000 |
| JP | 2004-174845 | A | | 6/2004 |
| JP | 2005-159730 | A | | 6/2005 |
| JP | 2005169730 | A | * | 6/2005 |
| JP | 2006-347000 | A | | 12/2006 |
| JP | 2006347000 | A | * | 12/2006 |
| WO | WO-2006/131965 | A1 | | 12/2006 |

OTHER PUBLICATIONS

Japanese Office Action issued in corresponding Japanese Patent Application No. 2007-027905 on Jul. 26, 2011 (partial translation is attached).

* cited by examiner

INK-JET HEAD MAINTENANCE DEVICE, INK-JET RECORDING DEVICE AND INK-JET HEAD MAINTENANCE METHOD

The entire contents of all documents cited in this specification are incorporated herein by reference.

BACKGROUND OF THE INVENTION

The present invention relates to a maintenance device for an ink-jet head which ejects droplets of ink. More particularly, the invention relates to a maintenance device for an ink-jet head having a plurality of ink droplet-ejecting portions, an ink-jet recording device having a maintenance device, and an ink-jet head maintenance method.

One method for recording images on a recording medium involves using an ink-jet head having ink droplet-ejecting orifices and causing ink droplets to be ejected from the orifices in accordance with image signals.

In an ink-jet head which ejects ink droplets from such orifices, ink droplets adhere to the surface of a nozzle plate (also referred to herein as a "head substrate") on which nozzles (more specifically, nozzles with openings that serve as ink droplet-ejecting orifices) are formed.

When such ink droplets adhere to the nozzle plate, particularly in the vicinity of the orifices, the direction in which the ink is ejected becomes unstable, making it impossible to form a high-quality image.

Methods for removing ink droplets and debris adhering to the surface of the nozzle plate include, for example, rubbing the surface with a flat blade formed of a soft material so as to dislodge the ink droplets and debris, and bringing an ink droplet and debris-absorbing member into contact with the nozzle plate so as to absorb the ink droplets and debris.

However, if a low-hardness material is used in the nozzle plate so as to enhance the nozzle orifice machining precision during ink-jet head production or if the surface of the nozzle plate has been given a liquid-repelling treatment, the above methods which entail physical contact using a blade or absorbing material may damage the edge structure of the nozzle or mar the liquid repellent-treated surface.

Damage to the nozzle edge structure or marring of the treated surface disrupts the ejection of the ink droplets, making it impossible to form a high-quality image.

Devices for removing ink droplets adhering to the surface of the nozzle plate include the maintenance devices described in JP 05-201028 A and JP 08-58103 A.

JP 05-201028 A discloses a maintenance device for an ink-jet head having a plurality of nozzles formed in an array within a head main body and having a head main body end which is formed as a flat surface. The maintenance device includes a negative pressure-generating means for generating a negative pressure which is lower than atmospheric pressure, a local suction means which is connected to and communicates with the negative pressure generating means and has formed therein a suction port of a size that faces one or a plurality of unit nozzle regions, and a suction port displacing means for relative displacement of the suction port on the local suction means in the direction in which the nozzles are arrayed.

JP 08-58103 A discloses an ink-jet device in which, when ink or the like adheres to the nozzle plate and maintenance is required, a cap is moved and positioned so as to be separated from the nozzle plate by a specific distance L between a cap rubber and a nozzle plate face at the front surface of the head, and a pump is operated in this state, thereby aspirating ink on the nozzle plate face into the cap.

This ink-jet device is described as being capable of removing ink without deterioration of the water-repellent film on the nozzle plate.

As described in JP 05-201028 A and JP 08-58103 A, damage to the surface of the nozzle plate during maintenance can be prevented by the use of suction at a position separated from the nozzle plate by a fixed distance.

SUMMARY OF THE INVENTION

However, in the ink-jet head maintenance device described in JP 05-201028 A, because relative displacement of the suction port on the local suction means in the direction in which the nozzles (and nozzle orifices) are arrayed must be carried out by the suction port displacing means, treatment takes time and the device itself is complicated. Such problems are especially acute in the case of ink-jet heads having a plurality of orifices formed on the head substrate.

Moreover, no mention whatsoever is made in JP 08-58103 A of cases in which a plurality of nozzles (and orifices) are formed in the ink-jet device described therein.

For example, if there is a single cap for a plurality of nozzles, ink between neighboring nozzles may remain on the nozzle plate (head substrate, orifice plate). In addition, the pump used must be a large pump, which is a problem in itself.

Also, if a cap is provided for every two or more nozzles, the device will have a complicated design. In particular, it is a challenge to form caps on an ink-jet head in which the nozzles are arranged at very small intervals.

It is therefore a first object of the invention to provide an ink-jet head maintenance device which is capable of carrying out maintenance on an ink-jet head efficiently, quickly, reliably, and without damaging the nozzle plate.

A second object of the invention is to provide an ink-jet recording device which is capable of carrying out maintenance on an ink-jet head efficiently, quickly, reliably, and without damaging the nozzle plate.

A third object of the invention is to provide an ink-jet heat maintenance method which is capable of carrying out maintenance on an ink-jet head efficiently, quickly, reliably, and without damaging the nozzle plate.

According to an aspect of the invention, there is provided a maintenance device for an ink-jet head having a head substrate on a surface of which orifices for ejecting ink droplets are formed in an array having a direction, comprising:

a removal unit comprising a suction assembly which is disposed in a position that faces the surface of the head substrate having the orifices formed thereon and does not come into contact with the head substrate, and which has formed therein, on a surface opposite the head substrate surface on which the orifices are formed, a first suction port and a second suction port, each being slit-like and elongated in a direction parallel to an orifice array direction and mutually parallel and spaced apart in a direction perpendicular to the orifice array direction; and a suction pump which draws air from inside the suction assembly.

The suction assembly preferably comprises a first suction member having formed therein the first suction port and a second suction member having formed therein the second suction port.

The suction assembly preferably has an interval between the first suction port and the second suction port which, in the direction perpendicular to the orifice array direction, is not more than R+L+2, where R represents a diameter in millimeters of the orifices in the direction perpendicular to the orifice array direction and L represents a size in millimeters of the first and second suction ports in the direction perpendicular to the orifice array direction.

It is preferable that the first suction port of the first suction member be disposed at a position opposite to, in the direction perpendicular to the orifice array direction, one edge of each of the orifices, and that the second suction port of the second suction member be disposed at a position opposite to, in the direction perpendicular to the orifice array direction, another edge of each of the orifices.

Preferably, the removal unit further comprises:

a blowing member which is disposed adjacent to the suction assembly and which has formed therein, on the surface opposite the head substrate surface on which the orifices are formed, a blowing port being slit-like and elongated in the direction parallel to the orifice array direction, and a blowing pump which feeds air to the blowing member.

The blowing port in the blowing member is preferably disposed between the first suction port and the second suction port in the direction perpendicular to the orifice array direction.

Preferably, the first suction port and the second suction port are divided in the orifice array direction, respectively and have openings formed in rows parallel to the orifice array direction, respectively.

According to another aspect of the invention, there is provided a maintenance device for an ink-jet head having a head substrate on a surface of which orifices for ejecting ink droplets are formed in an array having a direction, comprising:

a removal unit comprising a suction assembly which is disposed in a position that faces the surface of the head substrate having the orifices formed thereon and does not come into contact with the head substrate, and which has formed therein, on a surface opposite the head substrate surface on which the orifices are formed, a suction port elongated in a direction parallel to an orifice array direction in the ink-jet head, and a blowing member which is disposed adjacent to the suction assembly and has formed therein, on the surface opposite the head substrate surface on which the orifices are formed, a blowing port elongated in the direction parallel to the orifice array direction in the ink-jet head;

a suction pump which draws air from inside the suction assembly; and a blowing pump which feeds air to the blowing member.

The suction port and the blowing port each preferably have a length in the direction parallel to the orifice array direction which is longer than a spacing interval between the orifices formed in an array having a direction.

Preferably, the suction port and the blowing port are divided in the orifice array direction, respectively and have openings formed in rows parallel to the orifice array direction, respectively.

It is preferable for the ink-jet head maintenance device to further comprise a soaking mechanism which, when the suction pump is at rest, discharges ink from the orifices in the ink-jet head so as to wet with the ink the surface of the head substrate on which the orifices are formed.

Preferably, the soaking mechanism further includes a liquid flow guide which is disposed in a position that faces the head substrate surface having the orifices formed thereon and does not come into contact with the head substrate, and which defines in an interval with the head substrate surface a flow channel for the ink discharged from the ink-jet head.

Preferably, the ink-jet head maintenance device further comprises a removal unit moving mechanism which, when the suction pump is at rest, moves the removal unit in a direction perpendicular to the head substrate surface having the orifices formed thereon.

According to still another aspect of the invention, there is provided a maintenance device for an ink-jet head having a head substrate on a surface of which orifices for ejecting ink droplets are formed in an array having a direction, comprising:

a removal unit comprising a suction assembly which is disposed in a position that faces the surface of the head substrate having the orifices formed thereon and does not come into contact with the head substrate, and which has formed therein a suction port elongated in a direction parallel to an orifice array direction in the ink-jet head, and a moving mechanism which moves the at least one suction port on the suction assembly in a direction perpendicular to the orifice array direction; and a suction pump which draws air from inside the suction assembly;

wherein the moving mechanism moves the suction port as the suction port aspirates air or ink or both with the suction pump.

Preferably, the moving mechanism moves the suction port as the suction port aspirates air or ink or both in the direction perpendicular to the orifice array direction and, relative to a center of the orifices, from a position opposite a portion of the head substrate that is farther away than one edge of each of the orifices to a position opposite a portion of the head substrate that is farther away than the other edge of each of the orifices.

Preferably, the moving mechanism reciprocatingly moves the at least one suction port in the direction perpendicular to the orifice array direction as the at least one suction port aspirates air or ink or both.

Preferably, the moving mechanism moves the suction port in a direction parallel to the head substrate surface on which the orifices are formed as the suction port aspirates air or ink or both.

The moving mechanism preferably rotates the at least one suction port about an axis which is a straight line that passes through a point farther from the orifices than the center of the suction assembly and is parallel to the orifice array direction as the at least one suction port aspirates air or ink or both.

Preferably, the ink-jet head maintenance device further comprises a soaking mechanism which discharges ink from the orifices in the ink-jet head so as to wet with the ink the surface of the head substrate on which the orifices are formed.

Preferably, the soaking mechanism further includes a liquid flow guide which is disposed in a position that faces the head substrate surface having the orifices formed thereon, and which defines in an interval with the head substrate surface a flow channel for the ink discharged from the ink-jet head.

Preferably, the ink-jet head maintenance device further comprises a removal unit moving mechanism which moves the removal unit in a direction perpendicular to the head substrate surface having the orifices formed thereon.

Preferably, the suction port is divided in the orifice array direction, respectively and have openings formed in rows parallel to the orifice array direction, respectively.

According to yet another aspect of the invention, there is provided an ink-jet recording device comprising:

an ink-jet head having a head substrate on a surface of which orifices for ejecting ink droplets are formed in an array having a direction; and According to still yet another aspect of the invention, there is provided a method for maintaining an ink-jet head having a head substrate on a surface of which orifices for ejecting ink droplets are formed in an array having a direction, comprising the steps of:

discharging ink from the orifices so as to wet with the ink the surface of the head substrate on which the orifices are formed;

making a suction assembly that has a suction port elongated in a direction parallel to an orifice array direction and draws in air from the suction port approach a position that does not come into contact with the orifices on the head substrate surface having the orifices formed therein; and aspirating from the suction port air or ink or both, and thereby drawing off deposits from a periphery of the orifices on the head substrate.

Preferably, the ink-jet head maintenance method further comprises the steps of:

simultaneously making the suction assembly and a blowing member which has a blowing port elongated in the direction parallel to the orifice array direction and ejects air from the blowing port approach a position that does not come into contact with the orifices on the head substrate surface having the orifices formed therein; and aspirating from the suction port air or ink or both and thereby drawing off deposits from the periphery of the orifices on the head substrate while ejecting air from the blowing port to the periphery of the orifices.

According to a further aspect of the invention, there is provided a method for maintaining an ink-jet head having a head substrate on a surface of which orifices for ejecting ink droplets are formed in an array having a direction, comprising the steps of:

discharging ink from the orifices so as to wet with the ink the surface of the head substrate on which the orifices are formed;

making a suction assembly that has a suction port elongated in a direction parallel to an orifice array direction and draws in air or ink or both from the suction port approach a position that does not come into contact with the orifices on the head substrate surface having the orifices formed therein; and aspirating from the suction port air or ink or both, and simultaneously moving the suction port in the direction perpendicular to the orifice array direction.

Preferably, the ink-jet head maintenance method further comprises setting the suction assembly to a negative pressure at the interior thereof and, while drawing in air or ink or both from the suction port, reciprocatingly moving the suction port in the direction perpendicular to the orifice array direction.

The invention makes it possible to efficiently and quickly remove ink droplets and debris in the vicinity of the orifices on the surface of a head substrate in which ink-ejecting orifices are formed. This enables the maintenance of an ink-jet head to be carried out quickly and efficiently. Moreover, the device can be made inexpensive.

The invention also makes it possible to shorten the distance the suction port is moved when aspirating ink droplets and debris (e.g., deposits) from the vicinity of the orifices on the surface of a head substrate in which orifices are formed.

Shortening the distance that the suction port is moved enables the movement mechanism to be given a simple design and lowers the cost of the device.

Also, the suction port can be moved back and forth in a short time, enabling ink droplets and debris in the vicinity of the nozzles to be more reliably aspirated and removed.

DETAILED DESCRIPTION OF THE INVENTION

The ink-jet maintenance device according to the first aspect of the invention, the ink-jet recording device according to the second aspect of the invention, and the ink-jet head maintenance method according to the third aspect of the invention are described more fully below based primarily on the embodiments shown in the accompanying drawings.

First, a digital label printer which uses the ink-jet recording device of the second aspect of the invention that is equipped with the ink-jet head maintenance device of the first aspect of the invention is described.

Figure 1:
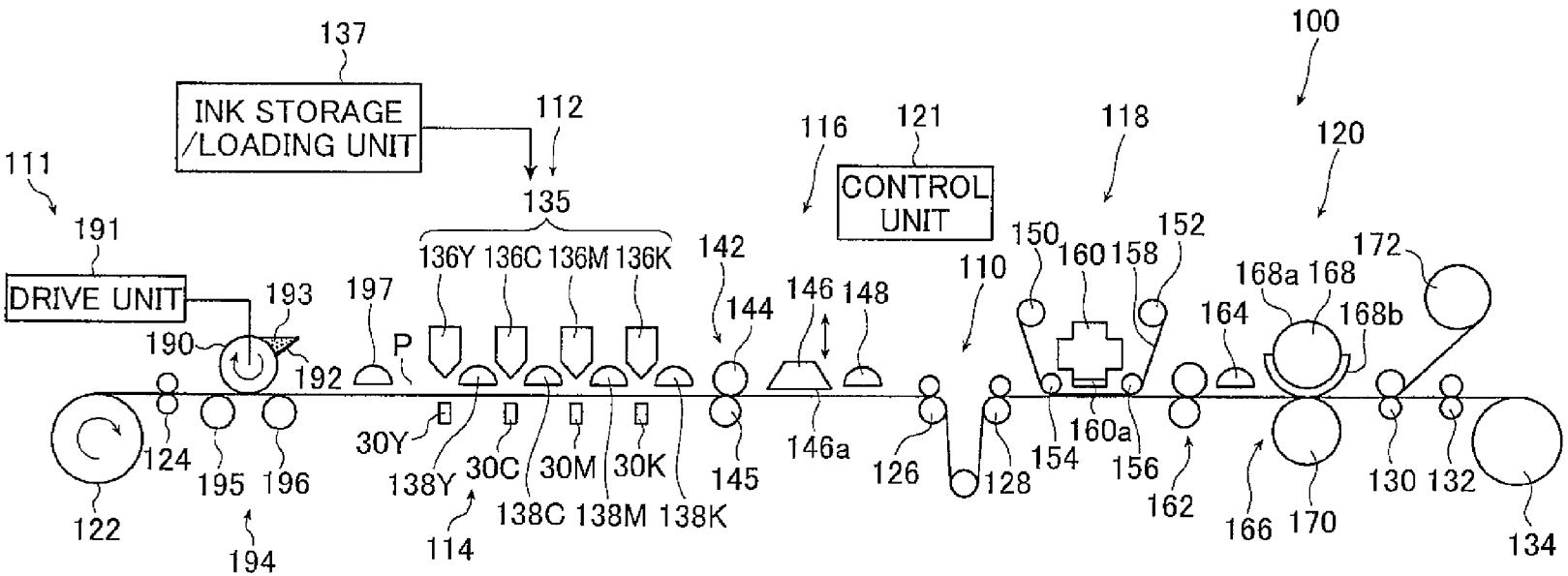
FIG. 1 is a front view showing, in simplified form, an embodiment of a digital label printer which may employ a maintenance device according to the invention.
Figure 2:
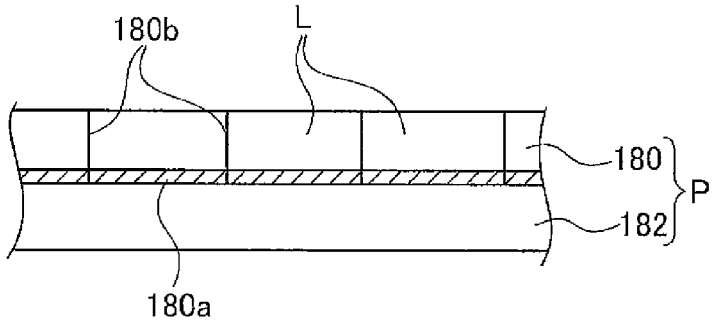
FIG. 2 is a longitudinal sectional view showing the arrangement of layers in a recording medium.
Figure 3:
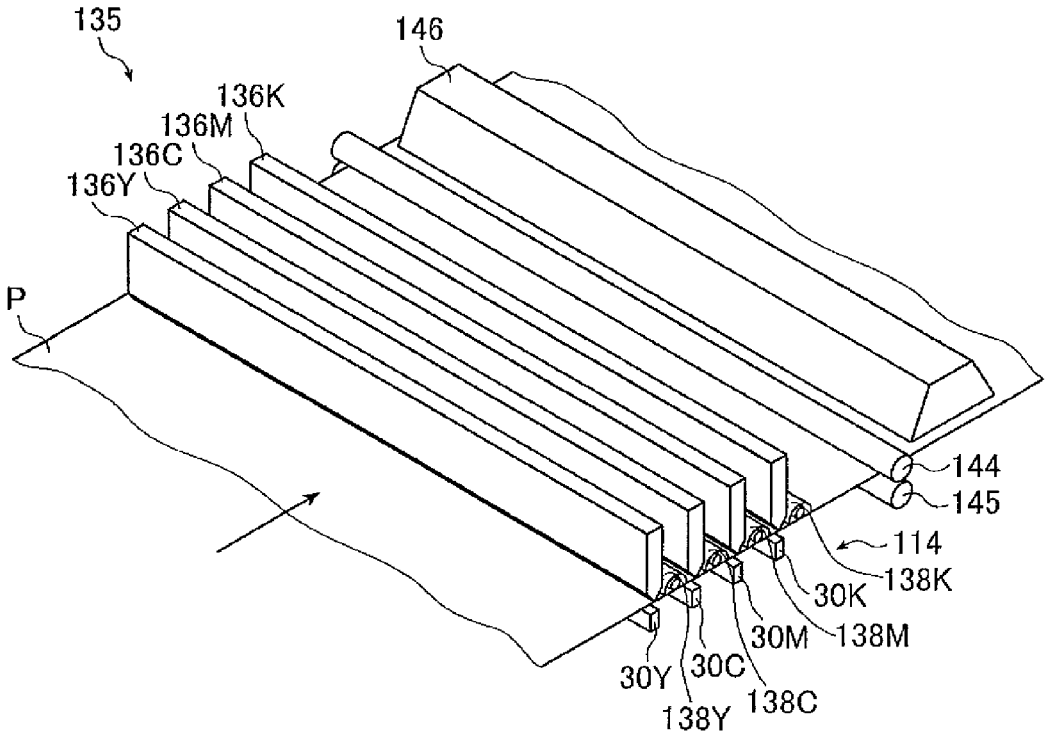
FIG. 3 is an enlarged, simplified perspective view of an image recording section in the digital label printer shown in FIG. 1.

FIG. 1 is a simplified view showing a digital label printer 100 according to one embodiment of the invention; FIG. 2 is a longitudinal sectional view of a recording medium for label printing such as may be used in the digital label printer 100 shown in FIG. 1, and FIG. 3 is an enlarged, simplified perspective view of an image recording section 112 in the digital label printer 100 shown in FIG. 1.

The digital label printer 100 according this embodiment is an ultraviolet light-curable ink-jet digital label printer that uses an ultraviolet light-curable ink, which is a type of ink that cures on exposure to active energy rays (active light). The label printer has a foil stamping section and is capable of foil stamp printing.

"Foil stamp printing" (also called "hot stamping") refers herein to a process in which foil that is gold, silver or of some other color is pressed with a heated relief plate against a mating member so as to hot-stamp (i.e., foil-stamp) the foil onto, for example, the front or back cover of a book.

Referring to FIG. 1, the digital label printer 100 includes basically a transport section 110, an undercoat forming section 111, an image recording section 112, a maintenance section 114, a surface smoothing section 116, a foil stamping section 118, a label forming section 120, and a control unit 121. The control unit 121 controls the respective operations of the transport section 110, the undercoat forming section 111, the image recording section 112, the maintenance section 114, the surface smoothing section 116, the foil stamping section 118 and the label forming section 120.

Here, the transport section 110 transports a web-type recording medium P for printing labels (referred to below as the "recording medium P") in a fixed direction (from left to right in FIG. 1). The image recording section 112, the surface smoothing section 116, the foil stamping section 118 and the label forming section 120 are arranged in this order in the direction of travel by the recording medium P; i.e., the upstream to downstream direction. The maintenance section 114 is disposed at a position that faces the image recording section 112 through the recording medium P therebetween.

Referring to FIG. 2, the recording medium P used in the present embodiment has a two-layer construction composed of a peel sheet 182 as a backing sheet on which is laminated a pressure-sensitive adhesive sheet 180 coated on the back thereof with a pressure-sensitive adhesive 180*a*.

The transport section 110 has a feed roll 122, transport roller pairs 124, 126, 128, 130 and 132, and a product roll 134.

The feed roll 122 has the recording medium P wound thereon in the form of a roll. The transport roller pairs 124, 126, 128, 130 and 132 are rotatably driven by transport motors (not shown), let out the recording medium P from the feed roll 122, and successively transport the recording medium P to the image recording section 112, the surface smoothing section 116, the foil stamping section 118 and the label forming section 120.

The product roll 134, which is disposed the furthest downstream in the direction of travel by the recording medium P, takes up the recording medium P that is transported by the transport roller pairs 124, 126, 128, 130 and 132 and has passed through the image recording section 112, the surface smoothing section 116, the foil stamping section 118 and the label forming section 120.

The undercoat forming section 111 has a coating roll 190 for coating the recording medium P with an undercoating liquid, a drive unit 191 which drives the coating roll, a blade 192 which adjusts the amount of undercoating liquid adhering to the coating roll 190, a positioning section 194 which supports the recording medium P so that the recording medium P is situated at a specific position with respect to the coating roll 190, and an undercoating liquid semi-curing section 197 where the recording medium P which has been coated with an undercoating liquid to form an undercoat is exposed to UV light so as to render the undercoating liquid (undercoat) into a semi-cured state.

The coating roll 190 is disposed so as to be, on the downstream side of the feed roll 122 on the travel path of the recording medium P, in touching contact with the surface of the recording medium P on the side where images are to be formed.

The coating roll 190, which is a roll that is longer than the width of the recording medium P, is a so-called gravure roller on the surface (peripheral face) of which recessed features are formed at fixed, i.e., uniform, intervals.

Here, the shape of the recessed features formed on the coating roll 190 is not subject to any particular limitation. Any of various shapes may be used, including round, rectangular, polygonal and star-like shapes. Alternatively, the recessed features may be formed as grooves extending over the entire circumference of the coating roll.

The drive unit 191 is connected to the coating roll 190 and rotates the coating roll 190 in the direction (clockwise in FIG. 1) opposite to the direction of transport of the recording medium P, more specifically in the direction opposite at the contact point therebetween to the recording medium P direction of transport.

No particular limitation is imposed on the driving method used by the drive unit 191. Any of various suitable methods may be used to drive the coating roll 190, including gear driving, pulley driving, belt driving and direct driving.

The blade 192 is situated so as to be in touching contact with the surface of the coating roll 190 on the downstream side in the recording medium P direction of transport.

An undercoating liquid accumulates in a space (referred to below as the "reservoir 193") that is formed above the area of touching contact between the coating roll 190 and the blade 192. The undercoating liquid is fed as needed from a feed tank (not shown) to the reservoir 193.

The coating roll 190 is immersed in the undercoating liquid at the reservoir 193, and subsequently comes into contact with the recording medium P.

The blade 192 scrapes off that portion of the undercoating liquid picked up by the coating roll 190 when immersed in the reservoir 193 which is not needed, thereby setting the quantity of undercoating liquid adhering to the coating roll 190 to a fixed amount. Specifically, except for the undercoating liquid retained in the recessed features formed on the surface of the coating roll 190, the blade 192 scrapes off undercoating liquid adhering to other portions of the coating roll 190.

The undercoating liquid retained in the portion of the coating roll 190 which comes into contact with the recording medium P can in this way be limited to only the undercoating liquid retained in the recessed features, thus enabling the amount of undercoating liquid which comes into contact with the recording medium P to be made constant.

The positioning section 194 has a first positioning roll 195 and a second positioning roll 196, and supports the recording medium P in such a way as to ensure that the recording medium P comes into contact with the coating roll 190 at a specific position. That is, the positioning section 194 sets the travel path of the recording medium P where the undercoating roll 190 and the recording medium P come into contact to a specific position.

The first positioning roll 195 is situated on the opposite side of the recording medium P from the side where an image is to be formed (i.e., the side to be coated with undercoating liquid) and, in the direction of travel by the recording medium P, between the transport roller pair 124 and the coating roll 190.

The second positioning roll 196 is situated on the opposite side of the recording medium P from the side where an image is to be formed and, in the direction of travel by the recording medium P, between the coating roll 190 and the subsequently described undercoating liquid semi-curing section 197.

Hence, the first and second positioning rolls 195 and 196 are each situated on the opposite side of the recording medium P from the coating roll 190 and, in the direction of travel by the recording medium P, on either side of the coating roll 190; that is, one is situated on the upstream side, and the other is situated on the downstream side, of the coating roll 190.

These first and second positioning rolls 195 and 196 support the recording medium P from the side of the recording medium P opposite to the side on which an image is to be formed.

In the foregoing arrangement of the undercoat forming section 111, the drive unit 191 causes the coating roll 190 to rotate in the direction opposite to the direction of travel by the recording medium P. The surface of the rotating coating roll 190, after being immersed in the undercoating liquid which has accumulated in the reservoir 193, comes into touching contact with the blade 192, thereby setting the amount of undercoating liquid retained on the surface to a fixed amount, then comes into contact with the recording medium P, coating the undercoating liquid onto the recording medium P. By thus rotating the coating roll 190 in the direction opposite to the direction of travel by the recording medium P and coating the undercoating liquid onto the recording medium P, a layer of undercoating liquid (referred to below as the "undercoat") that has been smoothened and has a good, even, coating surface state can be formed on the recording medium P.

The coating roll 190 which has come into contact with the recording medium P is rotated further and again immersed within the undercoating liquid in the reservoir 193.

In this way, the undercoat forming section 111, by rotating the coating roll 190 and coating the undercoating liquid onto the surface of the recording medium P, forms an undercoat on the surface of the recording medium P.

Here, by rotating the coating roll 190 in the direction opposite to the direction of travel by the recording medium P, an undercoat U having an improved surface state can be formed on the recording medium P. That is, an undercoat having a low surface roughness can be formed on the recording medium P, thus enabling a high-quality image to be formed.

The undercoating liquid semi-curing section 197 has a UV lamp and is disposed so as to face the travel path of the recording medium P. Here, the UV lamp is a light source which emits ultraviolet light. Examples of UV light sources that may be used include metal halide lamps and high-pressure mercury vapor lamps.

The undercoating liquid semi-curing section 197 irradiates the entire width of the recording medium P which passes through a position opposite thereto with ultraviolet light.

The undercoating liquid semi-curing section 197 exposes to UV light the recording medium P which has been coated with the undercoating liquid and passes through a position opposite thereto, thereby rendering the undercoating liquid coated onto the surface of the recording medium P into a semi-cured state. That is, the undercoating liquid semi-curing section 197 renders the undercoating liquid coated onto the recording medium P into a semi-cured state. The semi-cured state of the undercoating liquid is described in detail later in the specification.

The image recording section 112 has a recording head unit 135, an ink storage/loading unit 137, and UV irradiators 138Y, 138C, 138M and 138K.

The recording head unit 135 has recording heads (also referred to below as "ink-jet heads") 136Y, 136C, 136M and 136K which are disposed at positions facing the travel path of the recording medium P. That is, the nozzle tips which discharge ink droplets are disposed so as to face the recording medium P.

The recording heads 136Y, 136C, 136M and 136K are ink-jet heads which respectively discharge from the nozzles yellow (Y), cyan (C), magenta (M) and black (K) colored inks, and are arranged, from the upstream to the downstream side in the direction of travel by the recording medium P, in the following order: recording head 136Y, recording head 136C, recording head 136M, and recording head 136K. Moreover, the recording heads 136Y, 136C, 136M and 136K are connected to the ink storage/loading unit 137 and the control unit 121.

The recording heads 136Y, 136C, 136M and 136K, as shown in FIG. 3, are full-line type ink-jet heads, each having a plurality of ejection portions (nozzles) arranged in a row over a region whose width in a direction perpendicular to the direction of travel by the recording medium P exceeds the maximum width of the traveling recording medium P. The construction of the recording heads is described in detail later in the specification.

In an arrangement such as that of the present embodiment where the recording heads are full-line type recording heads, an image can be recorded over the full surface of the recording medium P by moving the recording medium P and the image recording section 112 relative to each other once (that is, in a single scan) in a direction (auxiliary scanning direction) which is perpendicular to the direction over which the ejection portions extend on the recording heads. This allows printing to be carried out at a higher speed than with a shuttle-type head in which the recording heads move reciprocatingly in the main scanning direction, enabling productivity to be improved.

Moreover, a color image can be formed on the recording medium P by ejecting inks of the respective colors from the recording heads 136Y, 136C, 136M and 136K while transporting the recording medium P.

The ink storage/loading unit 137 has ink supplying tanks which store inks of colors that correspond to the respective recording heads 136Y, 136C, 136M and 136K.

The ink supplying tanks that are used may be of a type where, when the amount of ink remaining is low, ink within the tank is replenished from a fill port (not shown), or may be of a cartridge type in which the tank itself is replaced.

The ink supplying tanks in the ink storage/loading unit 137 communicate with the respective recording heads 136Y, 136C, 136M and 136K via channels (not shown), thereby supplying ink to the recording heads 136Y, 136C, 136M and 136K.

The UV irradiators 138Y, 138C, 138M and 138K are provided as active energy ray-irradiating light sources for the respective recording heads 136Y, 136C, 136M and 136K, and are individually arranged on the downstream side of the corresponding recording heads 136Y, 136C, 136M and 136K. The UV irradiators 138Y, 138C, 138M and 138K may be any of various types of UV light sources such as metal halide lamps, high-pressure mercury vapor lamps and ultraviolet LEDs.

The UV irradiators 138Y, 138C, 138M and 138K irradiate with UV light the recording medium P which has passed through positions facing the respective recording heads 136Y, 136C, 136M and 136K and on which an image has been formed. That is, the UV irradiators 138Y, 138C, 138M and 138K expose ink that has been ejected from the recording heads and deposited on the recording medium P to energy which at once cures the ink, causing the ink on the recording medium P to semi-cure or cure.

It is preferable for the UV irradiators 138Y, 138C, 138M and 138K to be positioned or configured in such a way that the UV light which is emitted irradiates the ink on the surface of the recording medium P but does not irradiate the ink-ejecting orifices on the recording heads 136Y, 136C, 136M and 136K. By thus protecting the ink-ejecting orifices from irradiation with UV light, ink can be prevented from curing at the orifices.

Preferably, a measure for preventing light reflection (e.g., matte black treatment) is provided at each of the areas in the vicinity of the UV irradiators 138Y, 138C, 138M and 138K.

The maintenance section 114 is disposed at a position which faces the recording head unit 135 across the travel path of the recording medium P. That is, the maintenance section 114 is disposed so as to face the recording head unit 135 from the side of the recording medium P on which an image is not formed (i.e., the back side).

The maintenance section 114 has maintenance devices 30Y, 30C, 30M and 30K disposed therein for the respective recording heads 136Y, 136C, 136M and 136K.

The maintenance section 114 and the maintenance devices 30Y, 30C, 30M and 30K are described in detail later in the specification.

Next, the surface smoothing section 116 is situated on the downstream side of the image recording section 112 in the direction of travel by the recording medium P, and has both a varnish coater 142 which is a clear liquid feeding means that feeds to the surface of the recording medium P a clear, active energy ray-curable (in this embodiment, UV-curable) liquid (also referred to below as "clear, active energy-curable liquid" or simply "clear liquid"), a flat pressing member 146 which presses and thereby smoothens the subsequently described region of the recording medium P to which foil is to be applied, and a UV irradiator 148 which is an active energy-irradiating means that cures the clear liquid by exposing it to active energy rays.

The varnish coater 142 has a pair of coating rolls 144 and 145 to the surfaces of which adheres, or which have been impregnated with, the clear liquid. The coating rolls 144 and 145 are positioned so as to nip the recording medium P being transported by the transport section 110. The coating rolls 144 and 145 rotate synchronously with movement of the recording medium P while nipping the recording medium P, thereby coating the surface of the recording medium P (i.e., the surface on which an image has been formed) with the clear liquid following passage of the recording medium P through the image recording section 112 and image formation.

The clear liquid coated by the varnish coater 142 is a clear, active energy-curable liquid which is curable by exposure to ultraviolet light. Exemplary clear liquids include cationic-polymerizable compositions, radical-polymerizable compositions and aqueous compositions which contain as the primary ingredients at least a polymerizable compound and a photoinitiator.

The flat pressing member 146 is disposed on the downstream side of the varnish coater 142 in the direction of travel by the recording medium P and in a state where a smooth surface 146*a* thereon is movable in a vertical direction (in the direction indicated by the arrows shown in FIG. 1) toward the recording medium P.

The flat pressing member 146 moves in the vertical direction, coming into contact with the recording medium P, and presses with the smooth surface 146*a* against the surface (image side) of the recording medium P in at least the region where foil is to be applied, thereby smoothing the ink which has been ejected onto the surface of the recording medium P and forms an image.

The smooth surface 146*a* has a surface area which is at least larger than the region where foil is to be applied.

The UV irradiator 148 is disposed on the downstream side of the flat pressing member 146 in the direction of travel by the recording medium P. The UV irradiator 148 irradiates the recording medium P with active energy rays (in this embodiment, ultraviolet light), thereby curing the clear liquid which has been coated onto the surface of the recording medium P and smoothed. The UV irradiator 148 is exemplified by metal halide lamps, high-pressure mercury vapor lamps and ultraviolet LEDs.

The varnish coater 142 and the UV irradiator 148, while not devices critical for smoothing the region of the recording medium P to which foil is to be applied, are preferably included in this arrangement because coating a clear liquid enables a good, smooth surface to be obtained.

The foil stamping section 118 is situated on the downstream side of the surface smoothing section 116 in the direction of transport of the recording medium P, and includes a foil feed roll 150, a foil take-up roll 152, a first roller 154, a second roller 156, foil 158, and a hot stamping plate 160.

The foil feed roll 150 and the foil take-up roll 152 are disposed so as to be separated by a specific interval. The first roller 154 and the second roller 156 are disposed so as to be separated by a given interval, in such a way that a plane defined by the rollers 154 and 156 is parallel to the surface of the recording medium P, and at positions more proximate to the recording medium P than the foil feed roll 150 and the foil take-up roll 152. Moreover, the first roller 154 and the second roller 156 are disposed at positions very close to the recording medium P.

The foil 158 is fed out from the foil feed roll 150, passed around the first roller 154 and the second roller 156, and wound onto the foil take-up roll 152. The foil 158 between the first roller 154 and the second roller 156 is made parallel to the recording medium P.

The hot stamping plate (relief plate) 160 is disposed between the first roller 154 and the second roller 156 at a position facing the recording medium P through the foil 158. The hot stamping plate 160 has, on the recording medium P side thereof, a relief plate surface portion 160*a* which is made of a material such as zinc or brass and which comes into contact with and foil-stamps the foil 158. In addition, the hot stamping plate 160 has a heater (not shown) which heats the relief plate surface portion 160*a* and a movement mechanism which moves the hot stamping plate 160 in a direction that brings it closer to or farther from the recording medium P.

The hot stamping plate 160 brings the relief plate surface portion 160*a* while in a heated state into pressurized contact with the recording medium P through the foil 158, thereby heat and pressure bonding the foil 158 onto the recording medium P in accordance with the shape of the relief plate surface portion 160*a*.

In the present embodiment, a transport buffer is provided between the surface smoothing section 116 and the foil stamping section 118.

By providing a transport buffer, slack that arises in a web-type recording medium P due to a difference between the transport speed in the surface smoothing section 116 and the transport speed in the foil stamping section 118 can be absorbed, enabling labels to be efficiently produced.

The label forming section 120 is disposed on, in the recording medium P travel direction, the downstream side of the foil stamping section 118. It has a varnish coater 162 and an UV irradiator 164 for coating the image surface with a clear, active energy-curable liquid (in the present embodiment, a clear, UV-curable liquid) and improving the gloss, a die cutter 166 for making label-shaped slits in the web-type recording medium P, and a waste roll 172 for peeling off unnecessary portions of the recording medium P.

The varnish coater 162 is situated on the downstream side, in the direction of travel by the recording medium P, of the foil stamping section 118.

The varnish coater 162 has a pair of coating rolls to the surfaces of which adheres (or which have been impregnated with) a clear, UV-curable liquid and which rotate synchronously with movement of the recording medium P while nipping the recording medium P, thereby coating the surface of the foil-stamped recording medium P (i.e., the side on which an image has been formed) with the clear, UV-curable liquid.

The UV irradiator 164 is disposed on the downstream side of the varnish coater 162 in the direction of travel by the recording medium P. The UV irradiator 164 exposes the recording medium P to active energy rays (in this embodiment, ultraviolet light), thereby curing the clear, UV-curable liquid that has been coated onto the surface of the recording medium P.

By coating the surface of the recording medium P with the clear, UV-curable liquid and curing the applied liquid, gloss can be imparted to the image side of the recording medium P, making it possible to improve the quality of the image.

The die cutter 166 makes slits 180*b* of a desired label shape in only the pressure-sensitive adhesive sheet 180 of the printed, web-type recording medium P, as shown in FIG. 2. The die cutter 166 is situated on the downstream side of the UV irradiator 164 in the direction of travel by the recording medium P, and has a cylinder cutter 168 disposed on the image-forming side of the recording medium P and an anvil roller 170 disposed on the opposite side of the recording medium P from the cylinder cutter 168.

The cylinder cutter 168 is composed of a cylinder 168*a* and a plurality of slitting blades 168*b* which wind around the cylindrical surface of the cylinder 168*a* and are formed according to the shape of the labels.

The die cutter 166, while nipping the recording medium P between the cylinder cutter 168 and the anvil roller 170, undergoes an intermittently rocking rotation which is synchronous with the transport speed of the recording medium P, causing the slitting blades 168*b* to make label-shaped slits in only the pressure-sensitive adhesive sheet 180 of the recording medium P.

The die cutter 166 is made to rotate with an intermittently rocking motion in order to eliminate problems that arise when the length in the circumferential direction of the cylindrical surface of the cylinder 168*a* and the required length of the slitting blades 168*b* do not agree. That is, when label-shaped slits 180*b* are formed by continuously rotating the die cutter 166, recording medium P corresponding to portions of the cylinder cutter 168 that lack slitting blades 168*b* also advances, resulting in the generation of waste in the recording medium P. However, by causing the die cutter 166 to rotate with a rocking motion, the slits 180*b* can be continuously formed, enabling the recording medium P to be used without waste.

The waste roll 172 peels from the peel sheet 182 and takes up unnecessary portions (label borders) of the pressure-sensitive adhesive sheet 180 which do not form labels (finished product) L.

The recording medium P from which unnecessary portions have been peeled and taken up, that is, the recording medium P in a state where only the labels L remain adhering to the peel sheet 182, is then taken up onto the product roll 134, giving the final product.

Next, the recording head unit 135 of the image recording section 112 and the maintenance section 114 are described in greater detail.

First, the construction of the recording heads 136Y, 136C, 136M and 136K is described. Because the recording heads 136Y, 136C, 136M and 136K are all identical except for the color of the ink discharged, only the recording head 136K is described below, but the description that follows applies also to the other recording heads.

Figure 4A:
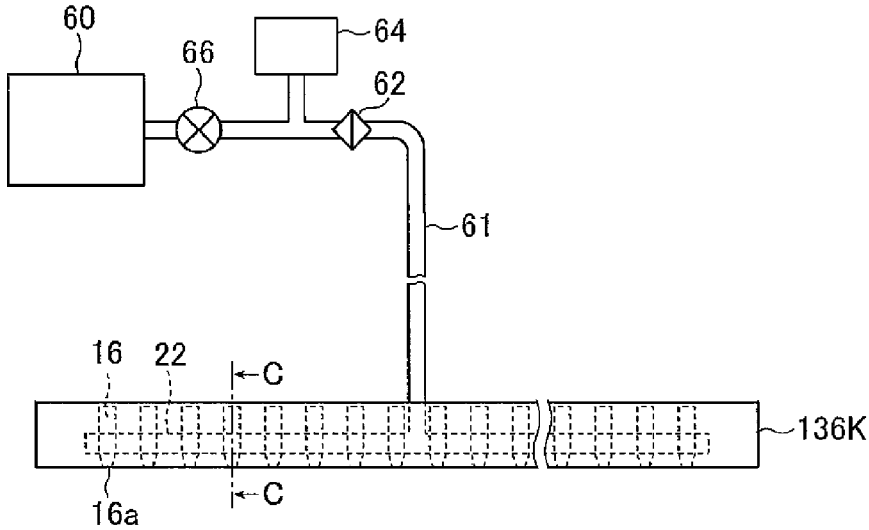
FIG. 4A is a schematic side view showing a recording head.
Figure 4B:
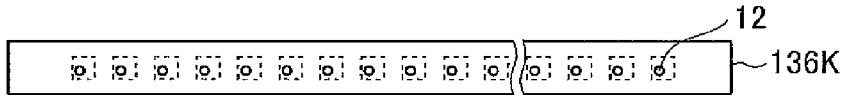
FIG. 4B is a bottom view showing the pattern in which ejection portions in the recording head are arranged.
Figure 4C:
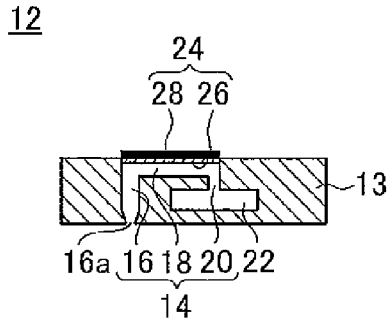
FIG. 4C is a schematic sectional view, taken along line C-C in FIG. 4A, illustrating the construction of the recording head.

FIG. 4A is a schematic side view of the recording head 136K; FIG. 4B is a bottom view showing the pattern in which ejection portions 12 in the recording head 136K are arranged; and FIG. 4C is a simplified sectional view, taken along line C-C in FIG. 4A, illustrating the construction of the ejection portion of the recording head 136K.

Referring to FIGS. 4A and 4B, the recording head 136K has a plurality of ink droplet-ejecting portions 12 formed in a row at fixed intervals on a head substrate 13.

Here, the head substrate 13 is a plate-like member common to a plurality of ejection portions 12. The head substrate 13 may be made of any of a variety of materials, such as resin materials, polymer materials, silicon.

A single ejection portion 12 is now described.

Referring to FIG. 4C, the ejection portion 12 includes an ink chamber unit 14 formed in the head substrate 13, and an actuator 24.

The ink chamber unit 14 is formed at the interior of the head substrate 13 and has a nozzle 16, a pressure chamber 18 and an ink supply port 20.

The nozzle 16, which is a tubular member that ejects ink droplets, has one opening that is formed on a surface of the head substrate 13 and faces the recording medium P, and another opening that communicates with the pressure chamber 18. The opening of the nozzle 16 that is formed in the head substrate 13 is an ink-ejecting orifice 16*a* (referred to below as simply the "orifice").

A portion of the nozzle 16 on the orifice 16*a* side thereof has a shape of progressively decreasing diameter toward the orifice 16*a*.

The pressure chamber 18 is shaped as a rectangular body having a surface perpendicular to the ink droplet-ejecting direction with a planar shape that is substantially square. The two corners on a diagonal of the square surface are connected to, respectively, the nozzle 16 and the ink supply port 20.

The ink supply port 20 has one end connected to the pressure chamber 18 and the other end communicating with a common flow channel 22.

Referring to FIG. 4A, the common flow channel 22 is formed at the interior of the head substrate 13, communicates with the ink chamber units 14 in a plurality of ejection portions 12, and communicates also with an ink tank 60 via a feed line 61.

An actuator 24 is disposed on a surface (top surface) of the pressure chamber 18 located on the opposite side thereof from the surface connected to the nozzle 16 and the ink supply port 20, and has a pressure plate 26 and a discrete electrode 28.

The actuator 24 applies a driving voltage to the discrete electrode 28, thereby deforming the pressure plate 26

The ink tank 60 connected to the common flow channel 22 via the feed line 61 is a portion of the above-described ink storage/loading unit 137 and feeds ink to the recording head 136K.

The feed line 61 connected to the ink tank 60 and the recording head 136K has disposed thereon a filter 62, and an ink pressurizing mechanism 64 and a solenoid valve 66 which belong to the maintenance section 114.

The filter 62 removes foreign matter and bubbles present in the ink supplied from the ink tank 60 to the recording head 136K. The filter 62 has a mesh size which is preferably the same as or smaller than the nozzle diameter (for example, 20 μm or less).

The ink pressurizing mechanism 64 and the solenoid valve 66 are described later in the specification.

Next, the ink-ejecting method at the ejection portion 12 is described.

First, ink is supplied from the ink tank 60.

Ink supplied from the ink tank 60 passes through the common flow channel 22 and the ink supply port 20, filling the pressure chamber 18 and the nozzle 16. That is, the pressure chamber 18 and the nozzle 16 are placed in an ink-filled state.

With the pressure chamber 18 and nozzle 16 in an ink-filled state, a driving voltage is applied to the discrete electrode 28, thereby deforming the pressure plate 26 and pressurizing the pressure chamber 18, which causes the ink to be expelled from the orifice 16*a* of the nozzle 16. That is, driving the actuator 24 causes an ink droplet to be ejected from the orifice 16*a* of the nozzle 16.

When an ink droplet has been ejected from the nozzle 16, fresh ink is supplied from the common flow channel 22 and through the ink supply port 20 to the pressure chamber 18.

In this way, the image recording section 112 forms an image on the recording medium P by ejecting ink droplets from the orifices 16*a* of the nozzles 16.

Next, the maintenance section 114 is described in detail.

Figure 5:
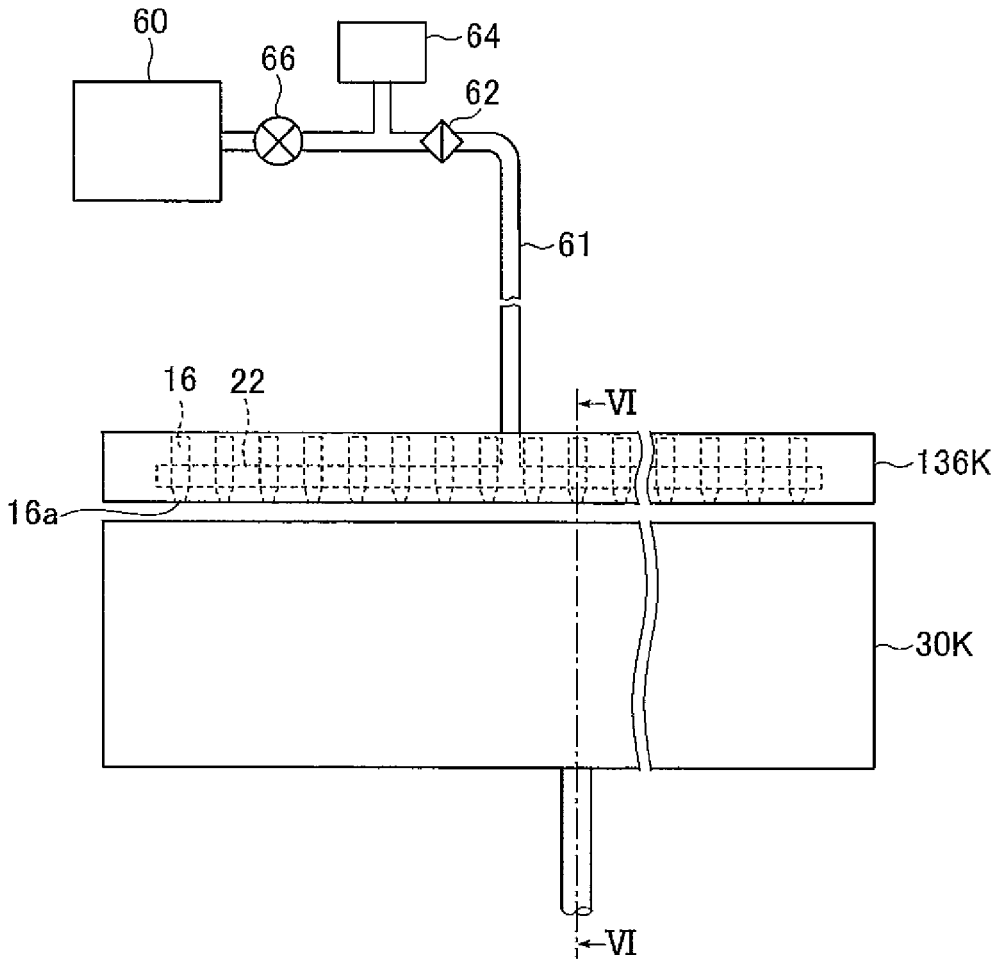
FIG. 5 is a schematic side view of a recording head and a maintenance device in the digital label printer shown in FIG. 1.
Figure 6:
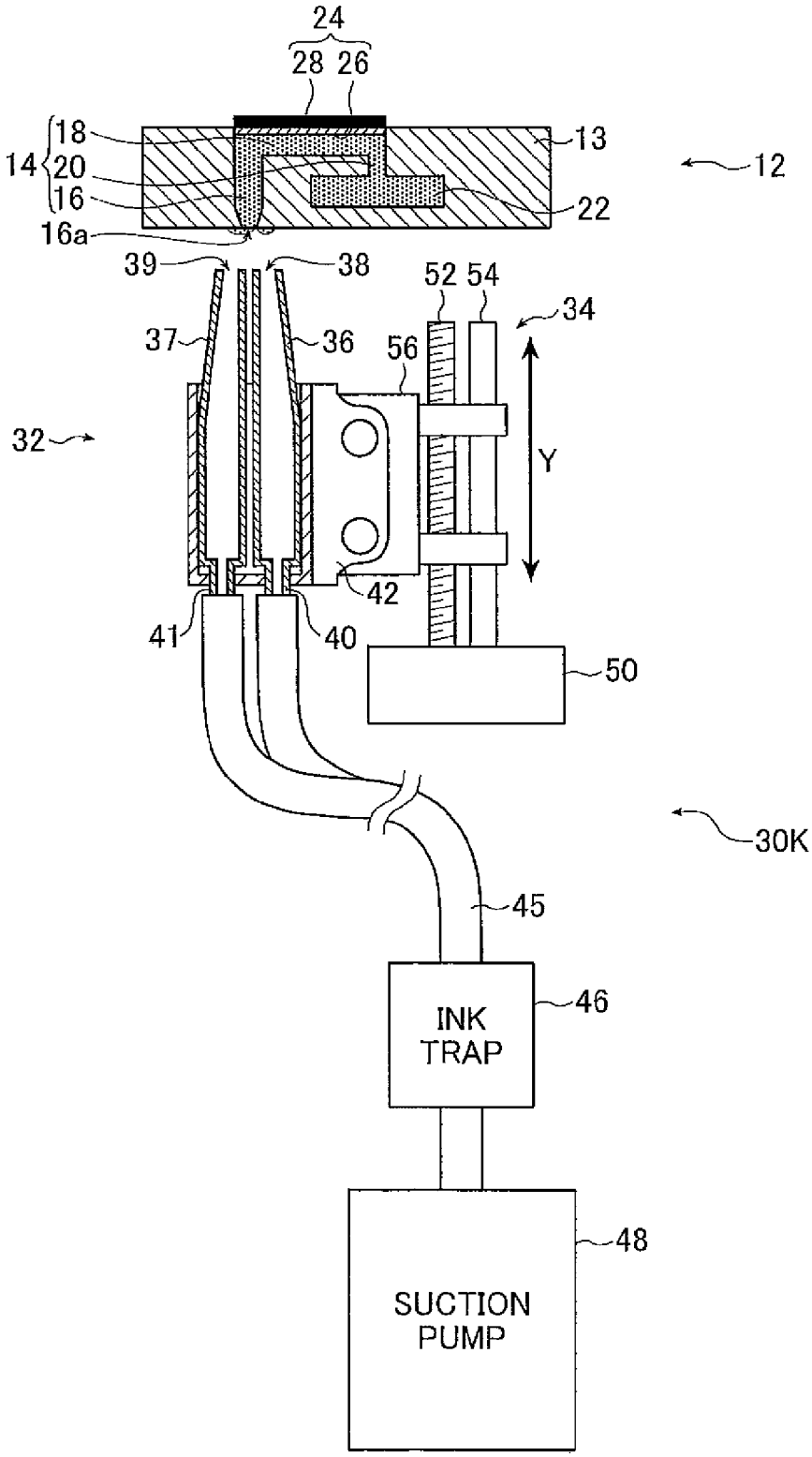
FIG. 6 is a partial cross-sectional view, taken along line VI-VI, of the maintenance device shown in FIG. 5.
Figure 7:
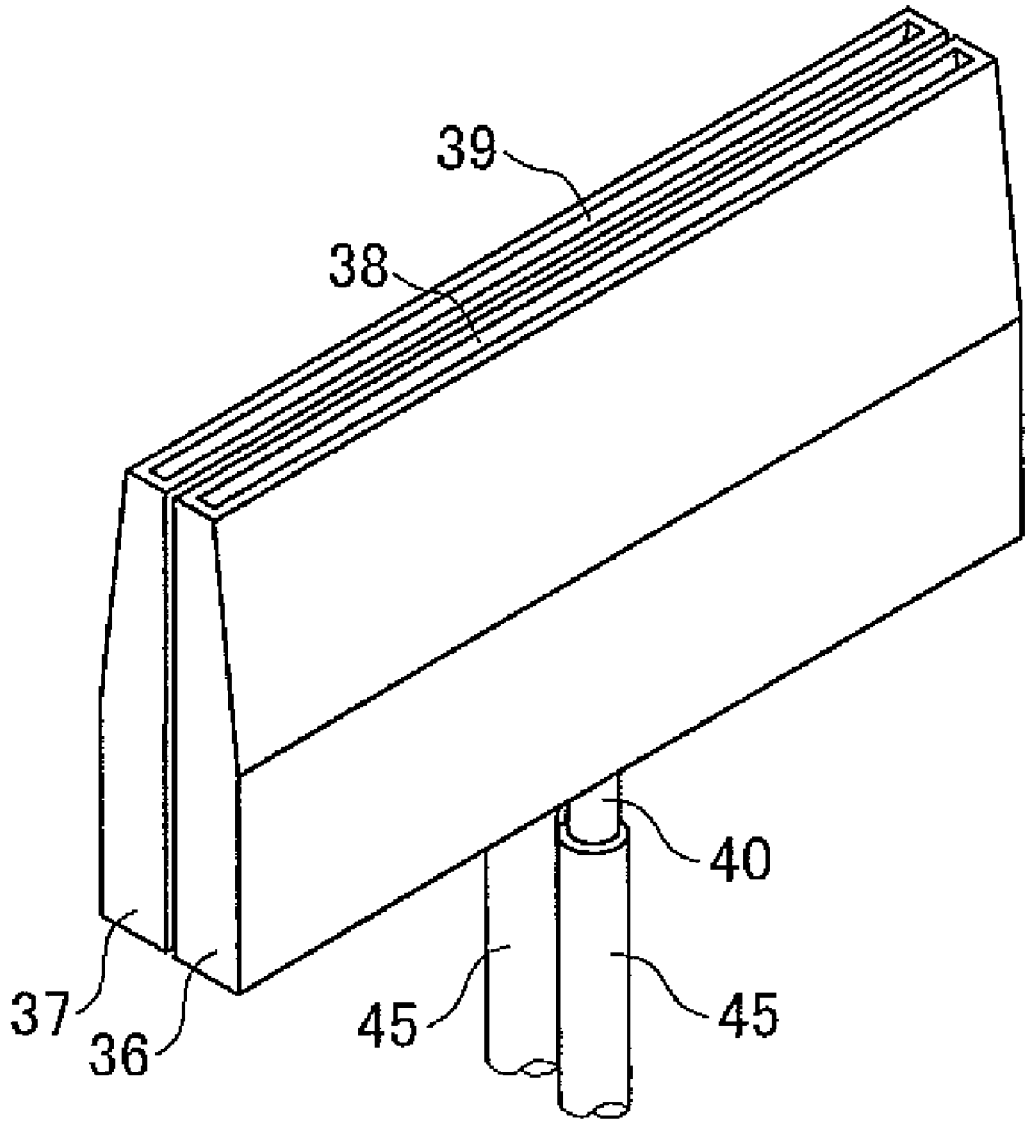
FIG. 7 is a schematic perspective view showing the shape of a suction assembly in the maintenance device shown in FIG. 6.

FIG. 5 is a schematic side view showing the recording head 136K in the recording head unit 135 of the image recording section 112, and a maintenance device 30K in the maintenance section 114. FIG. 6 is a partial cross-sectional view, taken along line VI-VI, of the maintenance device 30K shown in FIG. 5. FIG. 7 is a schematic perspective view depicting the shape of a suction member in the maintenance device 30K shown in FIG. 6.

As noted above, the maintenance section 114 has a plurality (in the present embodiment, four) maintenance devices 30Y, 30M, 30C and 30K. The maintenance devices 30Y, 30M, 30C and 30K are arranged opposite the respective recording heads 136Y, 136C, 136M and 136K.

Because the maintenance devices 30Y, 30M, 30C and 30K all have the same function and shape, only the maintenance device 30K positioned opposite the recording head 136K is described below, but the description that follows applies also to the other maintenance devices.

Referring to FIG. 5, the maintenance device 30K is disposed so as face a surface of the head substrate 13 of the recording head 136K, which surface has orifices 16*a* (also referred to below as the "head substrate 13 ink-ejecting surface") formed thereon. That is, the maintenance device 30K is situated on the recording medium P travel path side of the recording head 136K.

The maintenance device 30K has a shape with a length in a direction in which the plurality of orifices 16*a* formed in the head substrate 13 are arrayed (also referred to below as the "array direction"), that is, in a direction parallel to a line connecting the plurality of nozzle orifices 16*a* formed in a row, which is substantially the same as, or longer than, the length of the head substrate 13. Hence, the maintenance device 30K is shaped so as to have a length which corresponds to all the ejection portions 12 in the recording head 136K.

Referring to FIG. 6, the maintenance device 30K has a removal mechanism 32 and a removal mechanism moving means 34. In addition, although not shown in FIG. 6, the removal mechanism 32 has an ink pressurizing mechanism 64 and a solenoid valve 44 (see FIG. 4). The removal mechanism 32, the removal mechanism moving means 34, the ink pressurizing mechanism 64 and the solenoid valve 66 are each connected to the control unit 121 (see FIG. 1), with various operations being controlled by the control unit 121.

The removal mechanism 32 has a first suction member 36, a second suction member 37, a support 42, an ink trap 46, and a suction pump 48.

Referring to FIG. 6, the first suction member 36 is disposed at a position which faces the ejection portion 12 of the recording head 136K and does not come into contact (i.e., is non-contacting) with the head substrate 13, and has a hollow, box-like shape in which a portion on an ejection portion 12 side thereof has a width which becomes progressively smaller toward the ejection portion 12 side.

The first suction member 36 has a first slit 38 formed at a tip thereof on the ejection portion 12 side. A connector 40 is provided on part of a surface on an opposite side (opposing surface) of the first suction member 36 to the side on which the slit 38 is formed.

The second suction member 37 is disposed at a position which faces the ejection portion 12 of the recording head 136K, which is separated by a given interval from the first suction member 36 in a direction perpendicular to the array direction of the orifices 16*a* (that is, in the left-right direction in FIG. 6), and which does not come into contact with the head substrate 13 (i.e., is non-contacting).

The second suction member 37 has a shape which is symmetrical to the first suction member 36 about a plane that is parallel to the array direction of the orifices 16*a* and perpendicular to the ink-ejecting surface of the head substrate 13. That is, the second suction member 37 is disposed so as to face the ejection portion 12 of the recording head 136K and has a hollow, box-like shape in which a portion thereof on an ejection portion 12 side thereof has a width which becomes progressively smaller toward the ejection portion 12 side.

The second suction member 37 likewise has a second slit 39 formed at a tip thereof on the ejection portion 12 side. A connector 41 is provided on part of a surface on an opposite side (opposing surface) of the second suction member 37 to the side on which the slit 39 is formed.

The first slit 38 in the first suction member 36 and the second slit 39 in the second suction member 37 are disposed so as to be mutually spaced apart in a direction perpendicular to the array direction of the orifices 16*a*.

Moreover, the first slit 38 in the first suction member 36 is disposed at a position facing one edge of each orifice 16*a* in a direction perpendicular to the array direction of the orifices 16*a*, and the second slit 39 in the second suction member 37 is situated at a position facing the other edge of each orifice 16*a* in a direction perpendicular to the array direction of the orifices 16*a*. Hence, the two slits 38 and 39 are disposed so as to respectively face both edges of the orifices 16*a*. That is, the first slit 38 is disposed at a position which straddles one edge of each orifice 16*a*, and the second slit 39 is disposed at a position which straddles the other edge of each orifice 16*a*.

Referring to FIG. 7, the first suction member 36 and the second suction member 37 have cross-sectional shapes which are substantially the same at any position in the lengthwise direction of the recording head 136K, that is, in the array direction of the orifices 16*a*, except where the connectors 40 and 41 which connect with a tube 45 are formed in respective portions thereof.

Hence, the first slit 38 and the second slit 39 are disposed so as to face a plurality of orifices 16*a* which are arranged in a row. That is, one first slit 38 and one second slit 39 are each disposed so as to face a plurality of orifices 16*a*.

The tube 45 is a three-way tube which is bifurcated at one end. The tube is connected at the bifurcated ends to the connectors 40 and 41, and at the other end to the suction pump 48. That is, the tube 45 communicates with the first suction member 36, the second suction member 37, and the suction pump 48.

The suction pump 48 is a pump which draws air, such as a vacuum pump or an air pump. The pump 48 draws air from inside the first suction member 36 and from inside the second suction member 37, thereby reducing the pressure in the interiors of the first suction member 36 and the second suction member 37.

The thus configured removal mechanism 32, by drawing air from the vicinity of the first slit 38 on the first suction member 36 into the interior of the first suction member 36, aspirates ink droplets and debris (e.g., deposits) adhering to the ink-ejecting surface of the head substrate 13 at a position opposite the first slit 38; and by drawing air from the vicinity of the second slit 39 on the second suction member 37 into the interior of the second suction member 37, aspirates ink droplets and debris adhering to the ink-ejecting surface of the head substrate 13 at a position opposite the second slit 39. This is described later in greater detail.

The ink trap 46 is situated on the tube 45 between the first suction member 36 and the second suction member 37 on one side and the suction pump 48 on the other side. The ink trap 46 removes foreign matter such as ink and debris present in the air that is aspirated by the slits 38 and 39 and passes through the tube 45 when the suction pump 48 draws air, thereby preventing the deposition and entry of such foreign matter in the suction pump 48.

The support 42, which has a box-like shape with one side open, supports at the interior thereof the first suction member 36 and the second suction member 37. More specifically, the support 42 has a shape which covers all sides of the first suction member 36 and the second suction member 37, except for the side on which the first slit 38 and the second slit 39 are formed, and supports the first suction member 36 and the second suction member 37. In addition, the support 42 has openings formed in portions thereof which correspond to the connectors 40 and 41.

Next, the removal mechanism moving means 34, which has a supporting base 50, a drive screw 52, a guide rail 54 and a coupler 56, moves the first suction member 36, the second suction member 37 and the support 42 in a direction perpendicular to the ink-ejecting surface of the head substrate 13 (the Y direction indicated by the arrows in FIG. 6).

That is, the removal mechanism moving means 34 moves the first suction member 36 and the second suction member 37 from a standby position separated by a given distance from the ink-ejecting surface of the head substrate 13 to a position close to the head substrate 13.

The supporting base 50 is secured to a given position on a housing or the like (not shown).

The drive screw 22 is a ball screw having a male thread and is rotatably supported on the supporting base 50 in the axial direction perpendicular to the ink-ejecting surface of the head plate 13.

The drive screw 52 is rotated by a drive unit (not shown) situated at the interior of the supporting base 50.

The guide rail 54 is disposed on the supporting base 50 so as to be both adjacent and parallel to the drive screw 52.

The coupler 56 is joined to the support 42 by fasteners such as bolts or screws, with an adhesive, or by some other suitable means. The coupler 56 has both a female thread and a hole therein. The drive screw 52 engages the female thread, and the guide rail 54 passes through the hole.

Turning the drive screw 52 causes the coupler 56 to move in a direction perpendicular to the ink-ejecting surface. By having the guide rail 54 pass therethrough, the coupler 56 moves without changing direction.

In the removal mechanism moving means 34, rotating the drive screw 52 causes the coupler 56 to move in a direction perpendicular to the ink-ejecting surface of the head substrate 13. By moving the coupler 56 in this way, the support 42 and the first suction member 36 and second suction member 37 supported thereby also move in a direction perpendicular to the ink-ejecting surface of the head substrate 13.

The removal mechanism moving means 34 is thus able to move the first suction member 36 and the second suction member 37 toward and away from the ejection portions 12. Hence, the distance from the first slit 38 on the first suction member 36 and the second slit 39 on the second suction member 37 to the orifices 16*a* on the ejection portions 12 can be adjusted.

When the maintenance device 30K is used, the first suction member 36 and the second suction member 37 are moved in this way and brought close to the recording head 136K. When the maintenance device 30K is not used, the first suction member 36 and the second suction member 37 are moved away from the recording head 136K (more specifically, the first suction member 36 and the second suction member 37 are moved from the travel path of the recording medium P to get further away from the recording head 136), thereby preventing the maintenance device 30K from affecting transport of the recording medium P and image formation on the recording medium P during label production; i.e., preventing transport of the recording medium P and image formation on the recording medium P from being impeded.

In the present embodiment, the removal mechanism is moved using a drive screw or the like. However, no particular limitation is imposed on the means of movement. Other means that may be suitably used for this purpose include, for example, an air cylinder mechanism and a direct mechanism.

Next, the ink pressurizing mechanism 64 is a pressurizing means such as a compression pump, which means is located on the feed line 61 that supplies ink to the respective ejection portions 12 of the recording head 136K.

The ink-pressurizing mechanism 64 pressurizes ink within the feed line 61, causing the ink to be discharged from the orifice 16*a* in each of the ejection portions 12 on the recording head 136K.

The solenoid valve 66 is located, in the direction of ink flow, on the upstream side of the ink pressurizing mechanism 64 on the feed line 61. That is, the solenoid valve 66 is situated on the feed line 61 at a point between the ink tank 60 and the ink pressurizing mechanism 64.

By thus providing the solenoid valve 66 on the feed line 61 and closing the feed line 61 when the ink within the feed line 61 is pressurized by the ink pressurizing mechanism 64, the ink within the feed line 61 can be prevented from flowing back to the ink tank 60.

This enables the desired amount of ink droplets to be ejected from the orifice 16*a*.

The solenoid valve 66 is not limited by the present embodiment. For example, the solenoid valve may be a three-way valve which is provided at a coupling element between the feed line 61 and the ink pressurizing mechanism 64, and which may be switched as necessary between a state where the recording head 136K and the ink pressurizing mechanism 64 are in communication and a state where the recording head 136K and the ink tank 60 are in communication.

The digital label printer 100 according to the present embodiment is basically configured as described above.

Next, a method for producing labels with the digital label printer 100 is described.

Figure 8A:
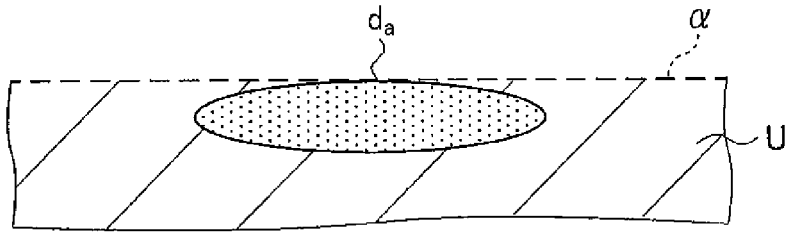
FIGS. 8A to 8C are each a cross-sectional diagram showing the state in which an ink droplet has been deposited on the surface of an undercoating liquid.
Figure 8B:
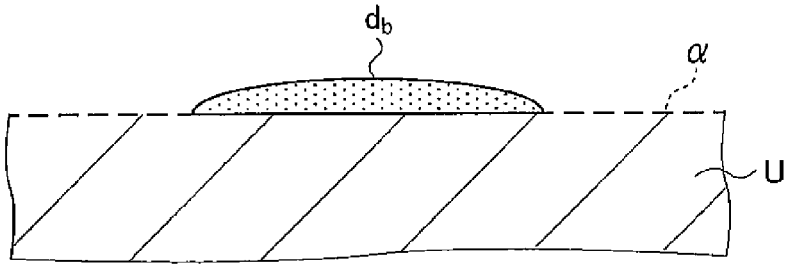
Figure 8C:
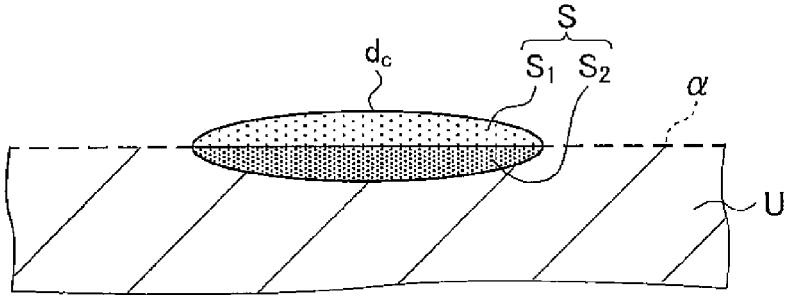
Figure 9A:
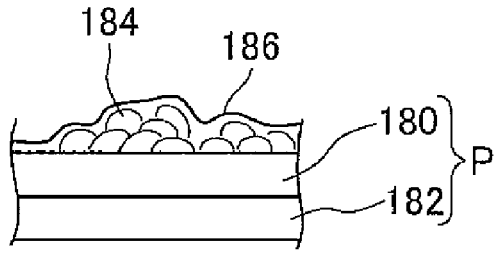
FIGS. 9A to 9C show foil stamping states, FIG. 9A being a sectional view of the essential features of a recording medium having large irregularities on the image surface, FIG. 9B being a sectional view of the essential features of a recording medium that has been foil-stamped without surface smoothing, and FIG. 9C being a sectional view of the essential features of a recording medium that has been foil-stamped after surface irregularities were smoothed by a surface smoothing means.
Figure 9B:
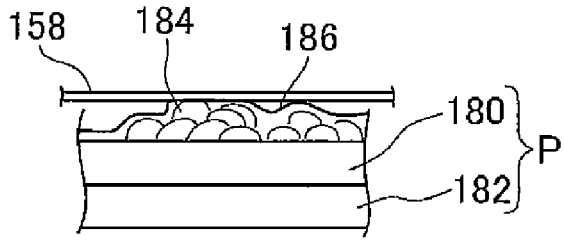
Figure 9C:
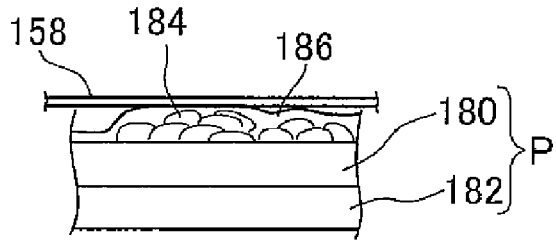

FIGS. 8A to 8C are each a cross-sectional diagram showing the state in which an ink droplet has been deposited on the surface of an undercoating liquid. FIG. 9A is a sectional view of the essential features of a recording medium having large irregularities on the image surface, FIG. 9B is a sectional view of the essential features of a recording medium that has been foil-stamped without smoothing, and FIG. 9C is a sectional view of the essential features of a recording medium that has been foil-stamped after surface irregularities were smoothed by a smoothing means.

Referring to FIG. 1, the recording medium P that has been let out from the feed roll 122 onto which it is wound into a roll is transported by the transport section 110 (transport roller pairs 124 and 126) to the undercoat forming section 111.

The recording medium P that has been transported to the undercoat forming section 111 by the transport section 110 comes into contact with the coating roll 190 in the undercoat forming section 111 and is coated on the surface with the undercoating liquid, thereby forming the undercoat U.

Here, the coating roll 190 is caused by the drive unit 191 to rotate in a direction opposite to the direction of travel by the recording medium P. That is, the drive unit 191 drives the coating roll 190 in a direction such that, at the position of contact between the coating roll 190 and the recording medium P, the surface of the coating roll 190 and the recording medium P move in opposite directions.

The recording medium P which has been coated with the undercoating liquid and on which the undercoat U has been formed is then transported further by the transport roll pairs 124 and 126 on the transport section 110 and passes through a position opposite the undercoating liquid semi-curing section 197.

The undercoating liquid semi-curing section 197 irradiates UV light onto the undercoating liquid-coated recording medium P passing through the position opposite thereto, thereby semi-curing the undercoat U on the recording medium P.

In the present invention, the semi-cured state of the undercoating liquid and/or ink droplets (also denoted below as simply the "semi-cured state") refers to a state in which the interior of the undercoating liquid and/or the ink liquid is completely or partially cured, and the degree of cure at the surface is lower than the degree of cure at the interior.

This semi-cured state can be judged by pressing a permeable medium such as plain paper against a recording medium P following completion of the semi-curing operation for undercoating liquid and/or ink droplets coated thereon (i.e., following the irradiation of active energy rays or heating; in the present embodiment, following UV light irradiation by the undercoating liquid semi-curing section 197 and/or the UV irradiators 138Y, 138C, 138M and 138K) and before depositing ink droplets in the next step, and determining whether a portion of the surface of the undercoating liquid and/or ink droplets transfers to the permeable medium.

That is, when no undercoating liquid and/or ink liquid whatsoever transfers to the permeable medium pressed thereto, the undercoating liquid and/or ink liquid is regarded as being fully cured. When cured undercoating liquid and/or ink liquid remains on the recording medium, but some transfer of undercoating liquid and/or ink liquid to the permeable medium also occurs, the undercoating liquid and/or ink liquid is regarded as being in a semi-cured state; i.e., a state where at least the uppermost surface portion retains fluidity and the interior has cured.

When the semi-cured state of the undercoating liquid and/or the ink droplets is achieved by the polymerization of a polymerizable compound which is initiated by exposure to active energy rays or heating, it is advantageous to judge the semi-cured state using infrared spectroscopy. Specifically, such a determination is preferably carried out by measurement of the polymerization ratio based on a comparison of the IR absorption spectra before and after completion of the undercoating liquid and/or ink droplet polymerization step (e.g., before and after irradiation with active energy rays or before and after heating).

Here, the polymerization ratio is defined as the ratio of the IR absorption peak intensities due to polymerizable groups that are detected in the IR absorption spectra; that is, $A_{after\ polymerization}/A_{before\ polymerization}$. $A_{after\ polymerization}$ is the infrared absorption peak absorbance attributable to polymerizable groups after the polymerization reaction. $A_{before\ polymerization}$ is the infrared absorption peak absorbance attributable to polymerizable groups before the polymerization reaction.

When this ratio $A_{after\ polymerization}/A_{before\ polymerization}$ is at least 0.05 but not more than 0.99, the undercoating liquid or ink can be regarded as being in a semi-cured state.

Here, to increase the color saturation of the image, the ratio $A_{after\ polymerization}/A_{before\ polymerization}$ is preferably at least 0.1 but not more than 0.98, more preferably at least 0.15 but not more than 0.97, and even more preferably at least 0.2 but not more than 0.96.

For example, when the polymerizable compound included in the undercoating liquid and/or the ink droplets is an acrylate monomer or a methacrylate monomer, absorption peaks based on polymerizable groups (acrylate groups, methacrylate groups) can be observed near 810 $cm^{-1}$. Accordingly, the above polymerization ratio is preferably defined in terms of the absorbances of these peaks. When the polymerizable compound is an oxetane compound, an absorption peak based on polymerizable groups (oxetane rings) can be observed near 986 $cm^{-1}$. The above polymerization ratio is thus preferably defined in terms of the absorbance of this peak. When the polymerizable compound is an epoxy compound, an absorption peak based on the polymerizable groups (epoxy groups) can be observed near 750 $cm^{-1}$. Hence, the above polymerization ratio is preferably defined in terms of the absorbance of this peak.

A commercial infrared spectrophotometer may be used as the means for measuring the infrared absorption spectrum. The spectrophotometer may be either a transmission-type or reflection-type system. Suitable selection according to the form of the sample is preferred. Measurement may be carried out using, for example, an FTS-6000 infrared spectrophotometer manufactured by Bio-Rad.

Alternatively, a desirable undercoating liquid and/or ink droplet semi-cured state may be judged by examining a cross-section of ink droplets deposited on the undercoating liquid and/or ink droplets following completion of the semi-curing step for the undercoating liquid that has been coated and/or the ink droplets that have been deposited on the recording medium P.

Specifically, it is preferable for the undercoating liquid and/or ink droplets in a semi-cured state to have, in cross-section, a shape where part of a ink droplet deposited thereon lies on the recording medium side of the liquid surface of the semi-cured undercoating liquid and/or ink droplet.

In the invention, the ink droplet cross-section is defined as, in droplet cross-sections taken perpendicular to the surface of the recording medium, the cross-section having the largest surface area S.

Also, the liquid surface of the undercoating liquid and/or ink droplets refers herein to the liquid surface prior to the deposition of ink droplets thereon.

The method used to examine cross-sections is not subject to any particular limitation. For example, such examination may be carried out using a commercial microtome and a commercial optical microscope.

The deposition of ink droplets on the surface of an undercoating liquid is described in detail below.

FIGS. 8A to 8C are each a cross-sectional diagram showing the state in which an ink droplet has been deposited on the surface of the undercoating liquid (undercoat) U.

FIG. 8A is a diagram showing the cross-sectional shape in one example where an ink droplet has been deposited on the surface of a semi-cured undercoating liquid. As shown in FIG. 8A, in this example, when an ink droplet is ejected onto the semi-cured undercoating liquid U, the ink droplet $d_a$ that is deposited onto the undercoating liquid U assumes a state in which the entire droplet lies beneath the undercoating liquid surface $\alpha$ (dashed line). That is, the entire ink droplet $d_a$ is submerged in the undercoating liquid U. As shown in FIG. 8A, a state in which the entire ink droplet has sunk below the liquid surface $\alpha$ of the undercoating liquid U is one form of a preferred "semi-cured state."

By curing the undercoating liquid so that the entire ink droplet sinks below the liquid surface $\alpha$ of the undercoating liquid U, interference between ink droplets can be prevented, enabling an image having a high color saturation to be obtained.

FIG. 8B is a diagram showing the cross-sectional shape when curing of the undercoating liquid has proceeded too far; that is, when the undercoating liquid has been excessively cured. As shown in FIG. 8B, if the undercoating liquid U has been excessively cured, an ink droplet $d_b$ deposited on the undercoating liquid U will lie completely above the liquid surface $\alpha$ of the undercoating liquid U. Hence, the entire ink droplet $d_b$ is present on top of the undercoating liquid surface, in which case there is a high likelihood of deposition interference.

Next, FIG. 8C is a diagram showing the cross-sectional shape in another example where the undercoating liquid has been cured to a suitable degree; that is, where the undercoating liquid is in a good semi-cured state. As shown in FIG. 8C, an ink droplet $d_c$ deposited on the undercoating liquid U lies both above and below the undercoating liquid surface $\alpha$. Hence, a state in which part of the ink droplet is submerged in the undercoating liquid indicates that the undercoating liquid is in a properly semi-cured state. In such a case, part of the ink droplet lies on the undercoating liquid U side (i.e., the side of the recording medium, which is not shown) of the undercoating liquid surface $\alpha$. By curing the undercoating liquid so that part of an ink droplet deposited thereon becomes submerged, mutual interference between the ink droplets can be prevented and an image having a high color saturation can be formed.

During cross-sectional examination, the size of the ink droplets deposited on the semi-cured undercoating liquid and/or ink liquid is preferably at least 1 picoliter but not more than 100 picoliters. It is more preferable for the ink droplets to have a shape which is of the same size as the ink droplets deposited when actually recording an image.

Also, during cross-sectional examination, it is preferable to solidify the semi-cured film; i.e., the undercoating liquid and/or ink liquid in a semi-cured state. The method of solidification is not subject to any particular limitation. For example, solidification by freezing or polymerization may be employed.

In order to be able to both avoid deposition interference and form a high color saturated image, letting the surface area of a ink droplet $d_c$ above the liquid surface of the undercoating liquid in a cross section as shown in FIG. 8C be $S_1$ and the surface area of the ink droplet $d_c$ below the liquid surface of the undercoating liquid be $S_2$, the ratio defined as $S_1/S_2$ based on the liquid surface is preferably in a range of from 0/100 to 95/5, more preferably in a range of from 10/90 to 75/25, and even more preferably in a range of from 30/70 to 50/50. As shown in FIG. 8C, letting the total cross-sectional area of the ink droplet $d_c$ deposited on an undercoating liquid in a semi-cured state be S ($S_{droplet}$), the relationship among S, $S_1$ and $S_2$ is $S-S_1=S_2$.

The cross-sectional surface area can be measured by counting pixels using commercially available image analysis software such as Adobe Photoshop.

The recording medium P on which the undercoat has been formed is transported to the image recording section 112 by the transport roller pairs 124 and 126 of the transport section 110.

Under control by the control unit 121, the recording heads 136Y, 136C, 136M and 136K eject droplets of UV-curable ink onto the recording medium P passing by positions opposed thereto. The recording medium P onto which ink has been ejected is then transported further, passing through positions opposite the UV irradiators 138Y, 138C, 138M and 138K, where it is irradiated with UV light, causing the ink to semi-cure or cure.

That is, when the recording medium P passes through positions opposite the recording heads 136Y, 136C and 136M, ink droplets are ejected from the recording heads 136Y, 136C and 136M toward the recording medium P. The recording medium P is then irradiated in turn with UV light from the UV irradiators 138Y, 138C and 138M, causing each of the inks deposited on the recording medium P to semi-cure. In addition, when the recording medium P passes through a position opposite the recording head 136K, ink droplets are ejected from the recording head 136K toward the recording medium P, following which the recording medium is irradiated with UV light from the UV irradiator 138K, thereby causing all the ink and undercoating liquid deposited on the recording medium P to cure.

In this way, an image is formed on the surface of the recording medium P.

The recording medium P on which an image has been formed is transported to the surface smoothing section 116 where, as shown in FIG. 9A, it is coated by means of the varnish coater 142 with a clear liquid 186 to a thickness of about 5 to 30 μm (dry film thickness) so as to entirely cover the image 184 formed on the recording medium P.

The recording medium P coated with the clear liquid 186 is then transported to a position opposite the flat pressing member 146. The flat pressing member 146 moves in a direction that approaches the recording medium P and presses against the recording medium P with the smooth surface portion 146*a*. Pressing the recording medium P with the smooth surface portion 146*a* flattens the ink on the recording medium P. This makes the ink (image) lying on the recording medium P smooth. The smooth surface portion 146*a* on the flat pressing member 146 has a larger surface area than the region on the recording medium P where foil is to be applied.

The recording medium P on which the image has been smoothed is then transported to the foil stamping section 118 by way of the transport buffer. The recording medium P transported to the foil stamping section 118 is stamped by the hot stamping plate 160 through foil 158, thereby heat and pressure bonding the foil 158 onto the surface of the recording medium P in accordance with the shape of the relief plate portion 160*a*.

The recording medium P on which foil 158 has been heat and pressure bonded, i.e., which has been foil-stamped, is transported to the label forming section 120, where it is coated with a clear, UV-curable liquid by the varnish coater 162, then is irradiated with UV light from the UV irradiator 164, thereby curing the clear UV-curable liquid which has been coated thereon.

The recording medium P on which the clear, UV-curable liquid has been cured is transported to the die cutter 166, where slits 180*b* in the shape of labels L are made only in the pressure-sensitive adhesive sheet 180 by means of the cylinder cutter 168 and the anvil roller 170.

In this step, as noted above, because the die cutter 166 makes label L shaped slits 180*b* while intermittently rocking, the slits 180*b* can be continuously formed, preventing the generation of waste in the recording medium P.

Unnecessary portions (portions other than the labels L) on the pressure-sensitive adhesive sheet 180 of the recording medium P are peeled from the peel sheet 182 and taken up with the waste roll 172. The recording medium P in a state where only the labels L remain attached to the peel sheet 182 is then taken up onto the product roll 134, giving the final product.

This completes label production.

Here, referring to FIG. 9A, cured inks 184 of a plurality of colors are piled together three-dimensionally on the image side of the recording medium P. Although the height to which the ink is piled differs also depending on the ink absorptivity of the recording medium P (the height being greater when the absorptivity is lower), this height is generally about 10 μm per color. Hence, when inks of several colors are used in one place, the height of the ink can reach about 40 μm. Moreover, the image side of the recording medium P has surface irregularities. These surface irregularities exert a large influence on adhesion of the foil 158 to the recording medium P (more specifically, to the ink 184 on the recording medium P) when the image side of the recording medium is foil-stamped.

That is, referring to FIG. 9B, when the image side where the region to which foil will be applied has not been smoothed (i.e., when the image side remains in the state achieved by ejection and curing of the UV-curable ink at the image recording section 112) is foil-stamped, the foil 158 heat and pressure bonds only to the peak areas of the surface irregularities, and remains in a non-pressure-bonded state in the valleys. That is, the degree of adhesion between the foil 158 and the recording medium P is low, making the foil subject to peeling.

By contrast, in the present embodiment, the recording medium P is foil stamped after the region where foil is to be stamped is first smoothed with the flat pressing member 146. As a result, referring to FIG. 9C, the foil 158 can be heat and pressure bonded to a flat surface having a large surface area, thus making it possible to carry out foil stamping that achieves a high degree of adhesion between the recording medium P and the foil 158 and discourages peeling.

That is, in the digital label printer 100 of the present embodiment, by providing, upstream of the foil stamping section 118, the surface smoothing section 116 which smoothes with the flat pressing member 146 the ink 184 and clear liquid 186 in at least the region on the recording medium P where foil is to be applied, it is possible to apply the foil 158 to the region that has been smoothened with the surface smoothing section 116 and to carry out foil stamping.

This enables the degree of adhesion between the recording medium P and the foil 158 to be improved, and good foil stamp printing to be carried out. Moreover, by carrying out the smoothing operation with the flat pressing member 146, the surface of the recording medium P can be smoothed in a short time, enabling increased productivity to be achieved.

The surface smoothing section 116, which is provided with a clear liquid furnishing means (varnish coater) 142 that furnishes a clear, active energy-curable liquid to the image side of the recording medium P and an active energy-curable means (UV irradiator) 148 that irradiates active energy rays onto the active energy-curable liquid (clear liquid) that has been furnished, covers the surface of the image side with a clear, active energy-curable liquid and smoothens the surface, thereby making it possible, even when the image side initially has large surface irregularities, to form a region where foil is to be provided that has a good degree of flatness.

Moreover, by using a varnish coater as the clear liquid furnishing means 142, the clear liquid 186 can be stably coated with a simple and inexpensive mechanism onto the surface of the recording medium P on which has been formed an image having surface irregularities.

The purpose of forming a film of clear, UV-curable liquid with the varnish coater 162 and the UV irradiator 164 is to impart gloss to the image side and thus achieve a high-quality image. Accordingly, such a film is not always necessary. In cases where there is no need to impart gloss, the digital label printer may be set up in such a way that a film of the clear, UV-curable liquid is not formed.

By forming an undercoat on the recording medium, the ink droplets that are deposited on the recording medium penetrate into the recording medium, preventing bleeding from arising on the image, and thus making it possible to obtain a high-quality image. Alternatively, use may be made of a recording medium to which the ink droplets have a low adhesion; i.e., which repels ink droplets deposited thereon. In other words, images may be recorded onto various types of recording media.

By semi-curing the undercoat with an undercoating liquid semi-curing section as in the present embodiment, even when ink droplets having portions which mutually overlap are deposited on the recording medium, the coalescence of these neighboring ink droplets can be suppressed through interactions between the undercoating liquid and the ink droplets.

That is, by forming a semi-cured undercoat on the recording medium, the migration of ink droplets can be prevented in cases where ink droplets ejected from the recording heads are deposited in close proximity on the recording medium, such as when ink droplets of a single color having portions which mutually overlap are deposited on a recording medium or when ink droplets of different colors having portions which mutually overlap are deposited on a recording medium.

In this way, image bleed, line width non-uniformities such as of fine lines in the image, and color unevenness on colored surfaces can be effectively prevented from occurring, enabling the formation of uniform-width, sharp line shapes, and thus making it possible to carry out the recording of ink-jet images of a high deposition density, such as reversed letters, with good reproducibility of fine features such as fine lines. That is, high-quality images can be formed on the recording medium.

The inner layer of the semi-cured undercoat and/or ink droplets has a viscosity at 25° C. of preferably at least 5,000 mPa·s.

The surface layer of the semi-cured undercoat and/or ink droplets has a viscosity at 25° C. of preferably at least 100 mPa·s but not more than 5,000 mPa·s.

The viscosity at 25° C. of the inner layer of the semi-cured undercoat and/or ink droplets is preferably at least 1.5 times, more preferably at least 2 times, and even more preferably at least 3 times, the viscosity at 25° C. of the surface layer of the semi-cured undercoat and/or ink droplets.

By setting the viscosity within the foregoing ranges, the undercoat and/or ink droplets can be suitably semi-cured.

The degree of polymerization by polymerizable compounds at the surface of the inner cured undercoating liquid (undercoat) and/or the ink droplets is preferably at least 1% but not more than 70%, more preferably at least 5% but not more than 60%, and even more preferably at least 10% but not more than 50%. Here, the degree of polymerization may be measured by a suitable technique such as infrared spectroscopy.

By setting the degree of polymerization within the foregoing range, the undercoat can be suitably semi-cured.

Alternatively, by using the coating roll 190 and, moreover, rotating the coating roll 190 in a direction opposite to the recording medium P direction of travel to coat undercoating liquid onto the recording medium P, an undercoat U having an improved surface state can be formed on the recording medium P. That is, by rotating the coating roll 190 in the direction opposite to the direction of travel by the recording medium P, disruption of the surface of the undercoating liquid on the recording medium P when the coating roll 190 separates from the recording medium P after having applied undercoating liquid to the recording medium P can be prevented, enabling an undercoat U having a smooth surface and a low surface roughness to be formed on the recording medium P.

Next, the ink-jet head maintenance method according to the third aspect of the present invention is described. The maintenance method of the invention removes liquid droplets and debris adhering to the ink-ejecting surface of the head substrate 13, especially in the vicinity of the orifices 16*a*, on the respective recording heads 136Y, 136C, 136M and 136K.

Because the ink-jet head (recording head) maintenance method is identical for all the recording heads 136Y, 136C, 136M and 136K, the maintenance method is described here only for the recording head 136K but applies also to the other recording heads as well.

Figure 10A:
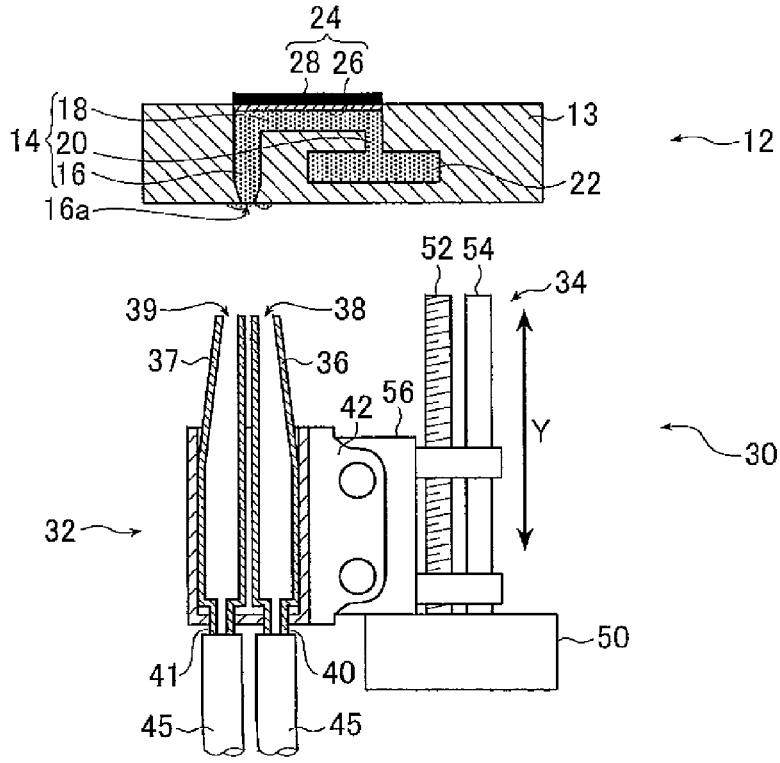
FIGS. 10A and 10B are diagrams showing steps in a maintenance method for a recording head.
Figure 10B:
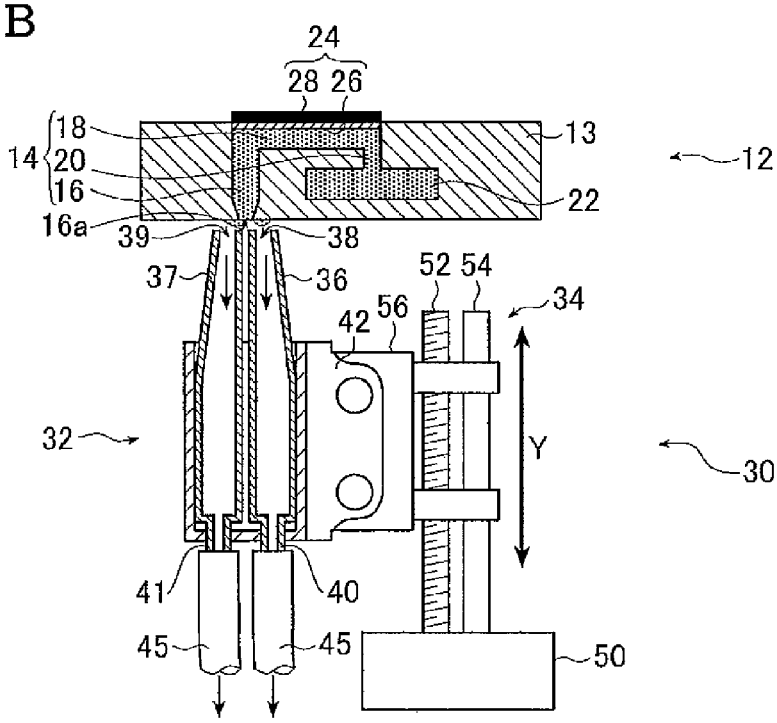

FIGS. 10A and 10B are diagrams showing steps in a recording head maintenance method by the maintenance section 114.

First, while an image is being recorded by the recording head 136K, that is, while a label is being produced, the first suction member 36 (and the removal mechanism 32, including supporting members) stands by at a position away from the recording head, as shown in FIG. 10A; specifically, it stands by at a position which does not impede the transport of the recording medium P.

When label production by the label printer 100 is finished and maintenance of the recording head 136K is to be carried out, first, as shown in FIG. 10B, the maintenance device 30K, with the removal mechanism moving means 34, moves the first suction member 36 and the second suction member 37 toward the ink-ejecting surface of the head substrate 13; i.e., it moves the first suction member 36 and the second suction member 37 toward the recording head 136K side. Hence, the first slit 38 on the first suction member 36 and the second slit 39 on the second suction member 37 are brought closer to the orifices 16*a* on the ejection portions 12. That is, the slits 38 and 39 are moved toward the orifice 16*a* side to a position which is substantially not in contact with the orifices 16*a*.

Next, the maintenance device 30K, with the suction pump 48, draws air from, and thus negatively pressurizes, the interior of the first suction member 36 and the second suction member 37, thereby aspirating air from the vicinity of the slits 38 and 39.

The slits 38 and 39 which are thus in an air aspirating state are made to approach the ink-ejecting surface of the head substrate 13, where the slits 38 and 39 respectively disposed in the vicinity of both edges of the orifices 16*a* draw in air from the respective vicinities thereof, thereby enabling the aspiration and removal of ink droplets and debris adhering to the ink-ejecting surface of the head substrate 13 in the vicinity of the orifices 16*a*.

By thus placing the slits 38 and 39 at positions opposite both edges of the orifices 16*a* and thereby aspirating and removing ink (ink droplets) and debris from the vicinity of the orifices 16*a* together with air, the direction in which ink droplets are ejected from the orifices 16*a* can be made constant. That is, shifts in the ink droplet deposition positions can be prevented from occurring.

This enables high-quality images to be consistently formed on the recording medium.

Moreover, by disposing the respective slits 38 and 39 at positions opposite both edges of the orifices 16*a*, and carrying out aspiration, the sizes of the respective slit openings can be made smaller. That is, by placing the slits 38, 39 at both edges of the orifices 16*a*, the ink droplets and debris (hardened deposits) at the vicinity of the orifices 16*a* can be removed even when the slits 38 and 39 have small size openings.

An additional advantage of having the slit openings be of a small size is that an inexpensive pump may be used. In other words, even when a pump having a small suction force is used, the suction force on air drawn in through the slits can be increased by making the size of the slit openings smaller. By increasing the force of suction from the slits, ink droplets and hardened deposits in the vicinity of the orifice can be more reliably aspirated.

By giving the slit on the suction member a shape which is elongated in the direction in which the orifices are arrayed, that is, by forming a slit which is common to a plurality of orifices, ink droplets and debris adhering to the vicinity of a plurality of orifices formed in a row on the head substrate can be aspirated and removed at the same time, enabling the recording head to be serviced in a short time.

In particular, when, as in the present embodiment, the length of the suction members in the orifice array direction is the same as the length of the head substrate; that is, in the present embodiment, by having the slits in the suction members be of a length in the array direction which covers all the orifices arranged in a row, all the orifices formed in a row on the head substrate can be serviced at the same time with a single suction member. Moreover, the recording head can be serviced without moving the suction member in the orifice array direction.

Also, because ink droplets and solid debris adhering to the ink-ejecting surface of the head substrate in the vicinity of the orifices can be removed without touching the ink-ejecting surface of the head substrate, damage to the ink-ejecting surface of the head substrate can be prevented.

Thus, in the present embodiment, ink droplets and debris in the vicinity of the orifices can be efficiently aspirated and removed in a short time, in addition to which the device can be given a simple construction and made lower in cost.

In each of the suction members (first suction member 36 and second suction member 37), the slit (also referred to below as the "suction port") that extends in a direction perpendicular to the direction in which the orifices are arrayed has a size which is preferably not more than 1 mm.

By having the size of the slit satisfy the foregoing range, it is possible to more advantageously achieve the above-described effects.

In the present embodiment, to more efficiently remove ink droplets and debris adhering to the ink-ejecting surface in the vicinity of the orifices, the first slit 38 is disposed at a position, in a direction perpendicular to the array direction of the orifices 16*a*, such that the opening therein straddles one edge of each orifice 16*a* and the second slit 39 is disposed in the same direction at a position such that the opening therein straddles the other edge of each orifice 16*a*. However, the invention is not limited to this configuration. As long as the slits are disposed opposite the respective edges of each orifice 16*a*, i.e., as long as separate slits are formed at both edges of each orifice, it is possible, for example, to dispose the slits so that their respective openings are positioned outside the orifice edges in a direction perpendicular to the array direction of the orifices 16*a*.

The first suction member 36 and the second suction member 37 are preferably disposed at positions such that the interval between the first slit and the second slit 39 in the direction perpendicular to the array direction of the orifices 16*a* is not more than R+L+2, where R represents the diameter in millimeters of the orifice openings and L represents the size in millimeters of the suction ports in the direction perpendicular to the array direction of the orifices 16*a*.

By setting the interval between the first slit 38 and the second slit 39 in the above range, ink droplets and debris in the vicinity of the orifices 16*a* on the ink-ejecting surface of the head substrate 13 can be more reliably removed in a shorter time.

As already noted, the present embodiment provides as the removal mechanism the first suction member 36 and the second suction member 37 wherein two slits are formed so as to be mutually parallel and spaced apart in a direction perpendicular to the array direction of the orifices 16*a*, and are elongated in the array direction of the orifices 16*a*. However, the invention is not limited in this regard. That is, use may be made of suction members of various configurations which have formed therein two slits that are mutually parallel and spaced apart in a direction perpendicular to the array direction of the orifices 16*a* and elongated in the array direction of the orifices 16*a*.

For example, the suction member may be shaped so as to have a bifurcated line, with a slit being formed in each of the two branches. In another possible configuration, the suction member may have a broad surface opposite the ink-ejecting surface of the head substrate, in which broad surface are formed two slits that are spaced apart in a direction perpendicular to the array direction of the orifices 16*a*.

Next, another embodiment of the recording head maintenance method is described in conjunction with FIGS. 11A to 11E, which show steps in the maintenance method.

Figure 11A:
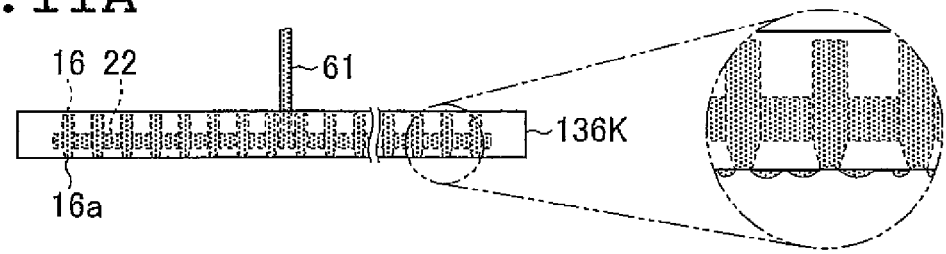
FIGS. 11A to 11E are diagrams showing steps in another maintenance method for a recording head.

Referring to FIG. 11A, at the start of maintenance, ink droplets and the like adhere to the vicinity of the orifices 16*a* on the ink-ejecting surface of the head substrate 13 of the recording head 136K.

Figure 11B:
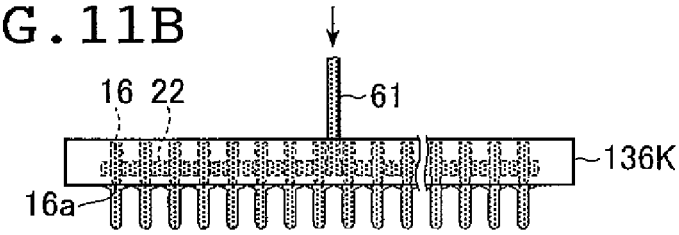

From this state, first, referring to FIG. 11B, ink within the feed line 61 is pressurized by the ink pressurizing mechanism 64, causing ink droplets to be discharged from all the orifices 16*a* on the recording head 136K. At this time, the solenoid valve 66 is closed, shutting the feed line 61. This prevents ink within the feed line 61 from flowing back to the ink tank 60 when it is pressurized by the ink pressurizing mechanism 64.

Figure 11C:
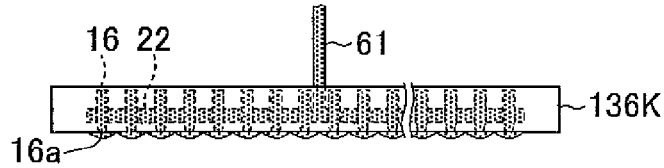

By discharging ink from all the orifices 16*a* on the recording head 136K, as shown in FIG. 11C, the entire ink-ejecting surface of the head substrate 13 is placed in an ink-adhering state, that is, in an ink-wetted (ink-moistened) state.

Figure 11D:
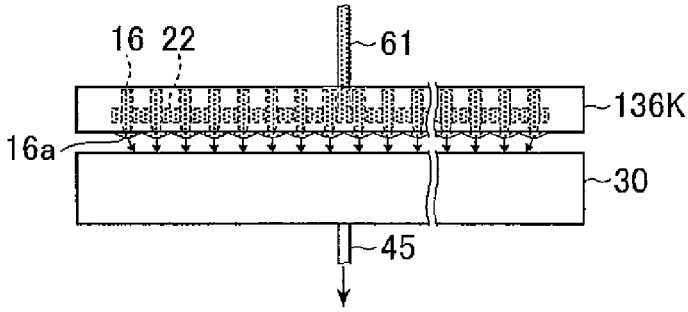

Next, referring to FIG. 11D, ink droplets and debris adhering to the ink-ejecting surface of the head substrate 13 are suctioned off by the maintenance device 30K in the same way as in the above-described method.

That is, the slits are brought closer to the orifices 16*a* and moved while drawing in air, thereby aspirating off ink droplets and debris adhering to the ink-ejecting surface of the head substrate 13.

Figure 11E:
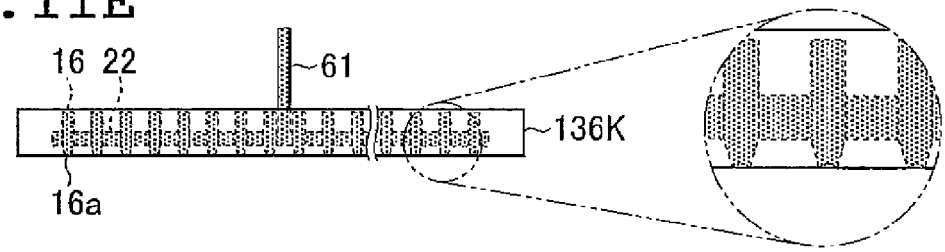

By aspirating off ink droplets and debris adhering to the ink-ejecting surface of the head substrate 13 with the maintenance device 30K, as shown in FIG. 11E, a state is achieved where no ink droplets or debris adheres to the ink-ejecting surface of the head substrate 13.

As described above, by using the ink pressurizing mechanism to discharge ink droplets from the orifices 16*a*, and thereby wetting the ink-ejecting surface of the head substrate 13 with ink, ink droplets can be placed in an easily aspirated state.

Moreover, debris adhering in the vicinity of the ink-ejecting surface of the head substrate 13 can be removed together with the discharge of ink from the orifices 16*a*, in addition to which debris (deposits), when wetted with ink, can also be placed in an easily aspirated state.

Thus, according to the present embodiment, ink droplets and debris (deposits) adhering to the ink-ejecting surface of the head substrate 13 can be placed in an easily aspirated state, enabling ink droplets and debris adhering to the ink-ejecting surface of the head substrate 13 to be reliably removed.

Figure 12:
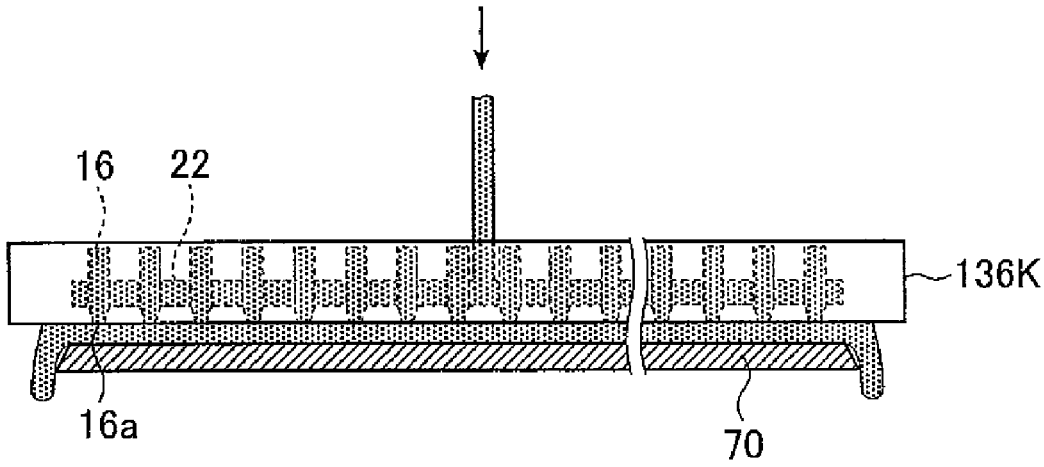
FIG. 12 is a diagram showing a step in yet another maintenance method for a recording head.

Here, when ink is discharged from the orifices 16*a*, as shown in FIG. 12, it is preferable to dispose a plate-like liquid flow guide 70 at a position opposite the ink-ejecting surface of the head substrate 13.

By thus disposing the liquid flow guide 70 at a position opposite the ink-ejecting surface of the head substrate 13, a flow channel for the ink discharged from the orifices 16*a* can be formed between the ink-ejecting surface of the head substrate 13 and the liquid flow guide 70.

Disposing the liquid flow guide 70 in this way enables the ink-ejecting surface of the head substrate 13 to be wetted more easily and with a smaller amount of ink.

Moreover, the flow of ink along the flow channel formed between the ink-ejecting surface of the head substrate 13 and the liquid flow guide 70 enables debris (deposits) adhering to the ink-ejecting surface of the head substrate 13 to be placed in an easily aspirated state or to be washed off, thereby making it possible to more reliably remove debris (deposits) adhering to the ink-ejecting surface.

A movement mechanism (not shown) may be used to dispose the liquid flow guide 70 in a position opposite the orifices 16*a* on the ink-ejecting surface of the head substrate 13 only at the time of use.

In the present embodiment, ink was discharged from the orifices 16*a* by pressurizing ink within the feed line 61 with the ink pressurizing mechanism 64. However, other methods may instead be used to cause ink to adhere to the ink-ejecting surface of the head substrate 13. For example, ink droplets may be continuously ejected by driving the actuators 24 for all the ejection portions 12 using the same method as in an ordinary recording operation. Alternatively, ink may be fed to each of the ejection portions 12 from the ink tank 60 by a pressurizing means, then discharged from the respective orifices 16*a*.

Figure 13:
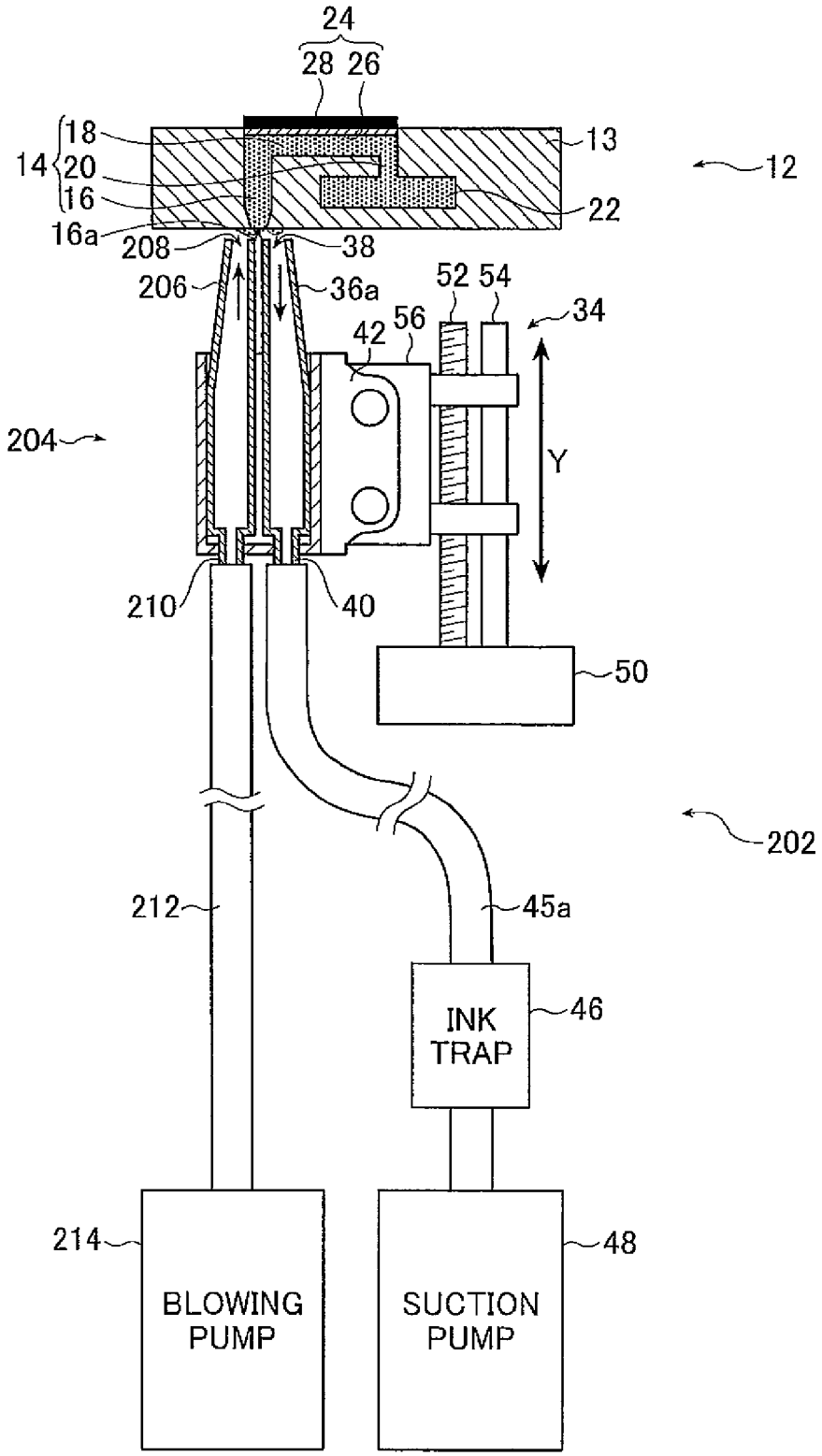
FIG. 13 is a sectional view showing, in simplified form, another embodiment of the maintenance device of the invention.

FIG. 13 is a sectional view showing, in simplified form, another embodiment of the maintenance device of the invention.

Because a maintenance device 202 shown in FIG. 13 has an arrangement which, aside from the removal mechanism 204, is the same as that of the maintenance device 30K shown in FIG. 6, like elements in both embodiments are denoted by the same reference symbols and repeated explanations of such elements are omitted below. The following description focuses on the distinctive features of the maintenance device 202.

The maintenance device 202 has a removal mechanism 204 and a removal mechanism moving means 34.

The removal mechanism 204 has a suction member 36*a*, a support 42, an ink trap 46, a suction pump 48, a blowing member 206 and a blowing pump 214. Because the support 42, the ink trap 46 and the suction pump 48 are the same as in the above-described maintenance device 30K, detailed explanations of these elements are omitted below. Moreover, as with the respective elements in the earlier described maintenance unit 30K, the removal mechanism 204, the removal mechanism moving means 34, the ink pressurizing mechanism 64 and the solenoid valve 66 in the present maintenance device 202 are each connected to a control unit 121 (shown in FIG. 1), and their various operations are controlled by the control unit 121.

The suction member 36*a* is disposed opposite the ejection portion 12 of the recording head 136K, and has a hollow, box-like shape in which the width becomes progressively smaller toward the ejection portion 12 side. Because the suction member 36*a* has the same shape and configuration as the first suction member 36, a detailed explanation is omitted below.

The blowing member 206 is disposed so as to be separated from the suction member 36*a* at a given interval in a direction perpendicular to the array direction of the orifices 16*a*. The blowing member 206 has a shape that is symmetric to that of the suction member 36 about a plane which is parallel to the array direction of the orifices 16*a* (direction orthogonal to the paper in FIG. 13) and perpendicular to the ink-ejecting surface of the head substrate 13. That is, the blowing member 206 is disposed opposite the ejection portion 12 of the recording head 136K (ink-ejecting surface of the head substrate 13), and has a hollow, box-like shape in which a portion thereof on the ejection portion 12 side has a width which becomes progressively smaller toward the ejection portion 12 side.

Moreover, the blowing member 206 has a blowing slit 208 formed at a tip thereof on the ejection portion 12 side. A connector 210 is provided on part of a surface on the side opposite (opposite surface) to the surface on which the blowing slit 208 is formed.

Here, a suction slit 38 on the suction member 36*a* is situated at a position opposite one edge of each of the orifices 16*a* in a direction perpendicular to the array direction of the orifices 16*a*, and the blowing slit 208 on blowing member 206 is situated at a position opposite the other edge of each of the orifices 16*a* in a direction perpendicular to the array direction of the orifices 16*a*. That is, the two slits 38 and 208 are respectively disposed opposite the two edges of each of the orifices 16*a*. Hence, the suction slit 38 is disposed at a position where the opening therein straddles one edge of each of the orifices 16*a*, and the blowing slit 208 is disposed at a position where the opening therein straddles the other edge of each of the orifices 16*a*.

The suction member 36*a* and the blowing member 206 each have a cross-sectional shape which is substantially the same at any position in the lengthwise direction of the recording head 136K, that is, in the array direction of the orifices 16*a*, except where there is formed, respectively, a first connector 40 which connects with a first tube 45*a* or a second connector 210 which connects with a second tube 212. Moreover, the suction slit 38 and the blowing slit 208 are disposed opposite the plurality of orifices 16*a* arranged in a row. That is, one suction slit 38 and one blowing slit 208 are each disposed opposite a plurality of orifices 16*a*.

The first tube 45*a* is connected at either end to, respectively, the suction member 36*a* and the suction pump 48. The first tube 45*a* thus communicates with the suction member 36*a* and the suction pump 48.

The suction pump 48 draws air from within the suction member 36*a*, thereby negatively pressurizing the interior of the suction member 36*a*.

The blowing member 206 is connected to the blowing pump 214 through the second tube 212. More specifically, the second tube 212 is connected at one end to the second connector 210 on the blowing member 206, and is connected at the other end to the blowing pump 214. The second tube 212 thus communicates with the blowing member 206 and the blowing pump 214.

The blowing pump 214 is a pump which supplies air, such as a compression pump or an air pump. The blowing pump 214 supplies air to the blowing member 206 through the second tube 212.

The removal mechanism 204 configured as described above feeds air from the blowing pump 214 to the blowing member 206, and blows out air from the blowing slit 208 in the blowing member 206.

Here, the blowing slit 208 in the blowing member 206 is formed on a surface opposite the ink-ejecting surface of the head substrate 13. Hence, air blown out from the blowing slit 208 on the blowing member 206 is blown against the ink-ejecting surface of the head substrate 13.

The suction member 36*a*, as with the above-described first suction member 36, draws in air from around the suction slit 38 into the interior of the suction member 36*a*, thereby aspirating ink droplets and debris adhering to the ink-ejecting surface of the head substrate 13 at a position opposite the suction slit 38.

That is, the removal mechanism 204 blows out air from the blowing slit 208 on the blowing member 206 to the vicinity of the orifices 16*a* formed on the ink-ejecting surface of the head substrate 13, and draws in air from around the orifices 16*a* through the suction slit 38 on the suction member 36*a* situated adjacent to the blowing member 206, thereby suctioning off ink droplets and debris (deposits) adhering to the vicinity of the orifices 16*a* on the ink-ejecting surface of the head substrate 13.

In this way, it is possible to remove ink droplets and debris adhering to the vicinity of the orifices 16*a* on the ink-ejecting surface of the head substrate by drawing in air from around the orifices on the ink-ejecting surface of the head substrate while at the same time blowing in air to the vicinity of the orifices.

Moreover, by blowing in air to the vicinity of the orifices on the ink-ejecting surface of the head substrate, ink droplets and debris can be more reliably removed from the vicinity of the orifices. Also, by drawing in air from around the orifices on the ink-ejecting surface of the head substrate, ink droplets and debris can be prevented from scattering to other areas.

In this embodiment as well, to more efficiently remove ink droplets and debris adhering to the vicinity of the orifices on the ink-ejecting surface, the suction slit 38 is disposed at a position, in a direction perpendicular to the array direction of the orifices 16*a*, such that the opening therein straddles one edge of each of the orifices 16*a* and the blowing slit 208 is disposed in the same direction at a position such that the opening therein straddles the other edge of each of the orifices 16*a*. However, the invention is not limited in this regard. As long as the slits are disposed opposite the respective edges of each of the orifices 16*a*, i.e., as long as separate slits are formed at both edges of each of the orifices, it is possible, for example, to dispose the slits so that their respective openings are positioned outside the orifice 16*a* edges in a direction perpendicular to the array direction of the orifices 16*a*.

Moreover, in the blowing member, it is preferable for the size of the slit in a direction perpendicular to the array direction of the orifices to be of the same size as the slit on the suction member.

By making the size of the slit on the blowing member the same as the size of the slit on the suction member, air can be efficiently blown onto the head substrate, enabling the above-described effects to be more desirably achieved.

The blowing member 206 is preferably disposed at a position such that the interval between the blowing slit 208 and the suction slit 38 in the direction perpendicular to the array direction of the orifices 16*a* is not more than R+L+2, where R represents the diameter in millimeters of the orifice openings and L represents the size in millimeters of the blowing port in the direction perpendicular to the array direction of the orifices.

By setting the interval between the suction slit 38 and the blowing slit 208 in the above range, ink droplets and debris in the vicinity of the orifices on the ink-ejecting surface of the head substrate can be more reliably removed in a shorter time.

Figure 14:
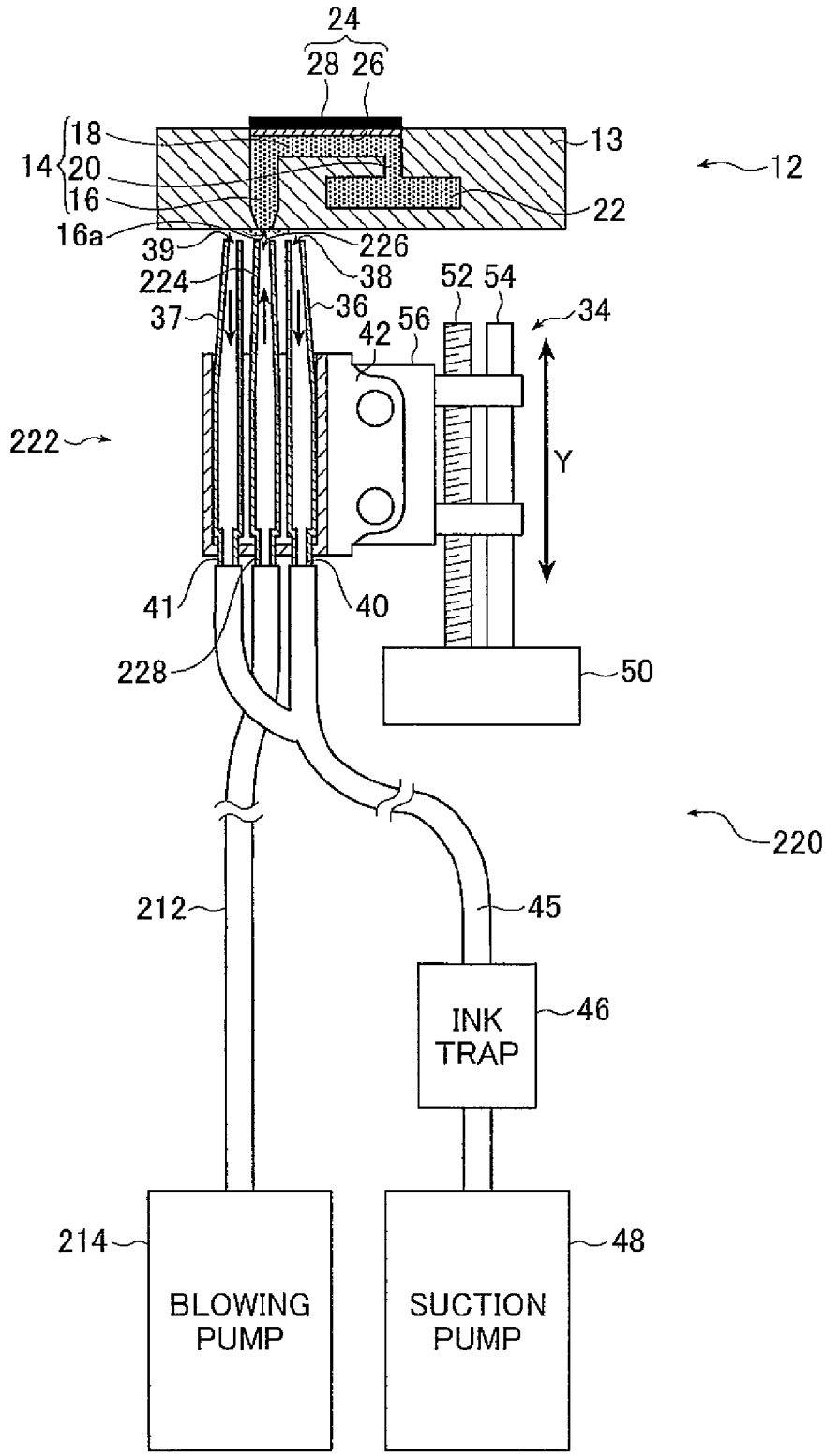
FIG. 14 is a sectional view showing, in simplified form, yet another embodiment of the maintenance device of the invention.

FIG. 14 is a partial cross-sectional view showing, in simplified form, yet another embodiment of the maintenance device of the invention.

Because the maintenance device 220 shown in FIG. 14 has an arrangement which, aside from the removal mechanism 222, is the same as that of the maintenance device 30K shown in FIG. 6, like elements in both embodiments are denoted by the same reference symbols and repeated explanations of such elements are omitted below. The following description focuses on the distinctive features of the maintenance device 220.

The maintenance device 220 has a removal mechanism 222 and a removal mechanism moving means 34.

The removal mechanism 222 has a first suction member 36, a second suction member 37, a support 42, an ink trap 46, a suction pump 48, a blowing member 224 and a blowing pump 214. Because the first suction member 36, the second suction member 37, the support 42, the ink trap 46 and the suction pump 48 are the same as in the above-described maintenance device 30K, detailed explanations of these elements are omitted below.

In the present embodiment, as with the respective elements in the earlier-described maintenance unit 30K, the removal mechanism 222, the removal mechanism moving means 34, the ink pressurizing mechanism 64 and the solenoid valve 66 in the maintenance device 220 are each connected to a control unit 121 (shown in FIG. 1), and their various operations are controlled by the control unit 121.

The first suction member 36 and the second suction member 37 have the same structure, function and other attributes. However they are disposed at a mutual interval which is wider than the interval between the first suction member 36 and the second suction member 37 shown earlier in the maintenance device 30K.

The blowing member 224 is disposed between the first suction member 36 and the second suction member 37. That is, the blowing member 224 is disposed at a position opposite the center of the orifices 16*a*.

The blowing member 224 is disposed opposite the ejection portions 12 of the recording head 136K (the ink-ejecting surface of the head substrate 13), and has a hollow, box-like shape in which a portion thereof on the ejection portion 12 side has a width which becomes progressively smaller toward the ejection portion 12 side.

Moreover, the blowing member 224 has a blowing slit 226 formed at a tip thereof on the ejection portion 12 side. A connector 228 is provided on part of a surface on an opposite side (opposing surface) of the blowing member 224 to the side on which the blowing slit 226 is formed.

The blowing member 224 has a cross-sectional shape which is substantially the same at any position in the lengthwise direction of the recording head 136K, that is, in the array direction of the orifice 16*a*, except where there is formed a connector 228 which connects with a tube 212. Moreover, the blowing slit 226 is disposed opposite the plurality of orifices 16*a* arranged in a row. That is, one blowing slit 226 is disposed opposite a plurality of orifices 16*a*.

As with the blowing member 206 in the above-described maintenance device 202, the blowing member 224 in the present embodiment is connected to a blowing pump through a tube 212.

The removal mechanism 222 configured as described above feeds air from the blowing pump 214 to the blowing member 224, and blows out air from the blowing slit 226 on the blowing member 224. Air blown out from the blowing slit 226 on the blowing member 224 is blown against the ink-ejecting surface of the head substrate 13.

The first suction member 36 and the second suction member 37 draw in air from around, respectively, the first suction slit 38 and the second suction slit 39, into the interior of the suction members 36 and 37, thereby aspirating ink droplets and debris adhering to the ink-ejecting surface of the head substrate 13 at positions opposite the suction slits 38 and 39.

That is, the removal mechanism 222 blows out air from the blowing slit 226 on the blowing member 224 to the vicinity of the orifices 16*a* formed on the ink-ejecting surface of the head substrate 13, and draws in air from around the orifices 16*a* through the slit 38 on the first suction member 36 and the slit 39 on the second suction member 37 situated adjacent to and on either side of the blowing member 224 in a direction perpendicular to the array direction of the orifices 16*a*, thereby suctioning off ink droplets and debris (deposits)

adhering to the vicinity of the orifices 16*a* on the ink-ejecting surface of the head substrate 13.

As shown in FIG. 14 for the maintenance device 220, by placing the blowing member 224 between the first suction member 36 and the second suction member 37, blowing air from the center toward the periphery of the orifices 16*a* on the ink-ejecting surface of the head substrate 13, and drawing in air at the periphery of the orifices 16*a* on the ink-ejecting surface of the head substrate 13 from both sides, ink droplets and debris (deposits) adhering to the vicinity of the orifices 16*a* on the ink-ejecting surface of the head substrate 13 can be removed.

By disposing the first slit 38 on the first suction member 36 and the second slit 39 on the second suction member 37 which aspirate air and/or ink (ink attached to the ink-ejecting surface) on either side of the blowing slit 226 on the blowing member 224 which blows out air, and blowing air against the ink-ejecting surface of the head substrate 13, ink droplets and debris that have not been removed from the ink-ejecting surface can be reliably prevented from scattering.

Because the sizes of the slit openings and the preferred relative positions of the first suction member 36 and the second suction member 37 are the same as for the above-described maintenance device 30K, a detailed explanation of these is omitted below.

In the above embodiments, the maintenance device is configured with a plurality of fixed suction members or a fixed suction member and a fixed blowing member. However, the invention is not limited in this regard. For example the maintenance device may instead have a configuration wherein a slit 316 that is located on a suction member and is in an air and/or ink-aspirating state is brought closer to the ink-ejecting surface of the head substrate 13 and moved around the orifices 16*a*.

Figure 15:
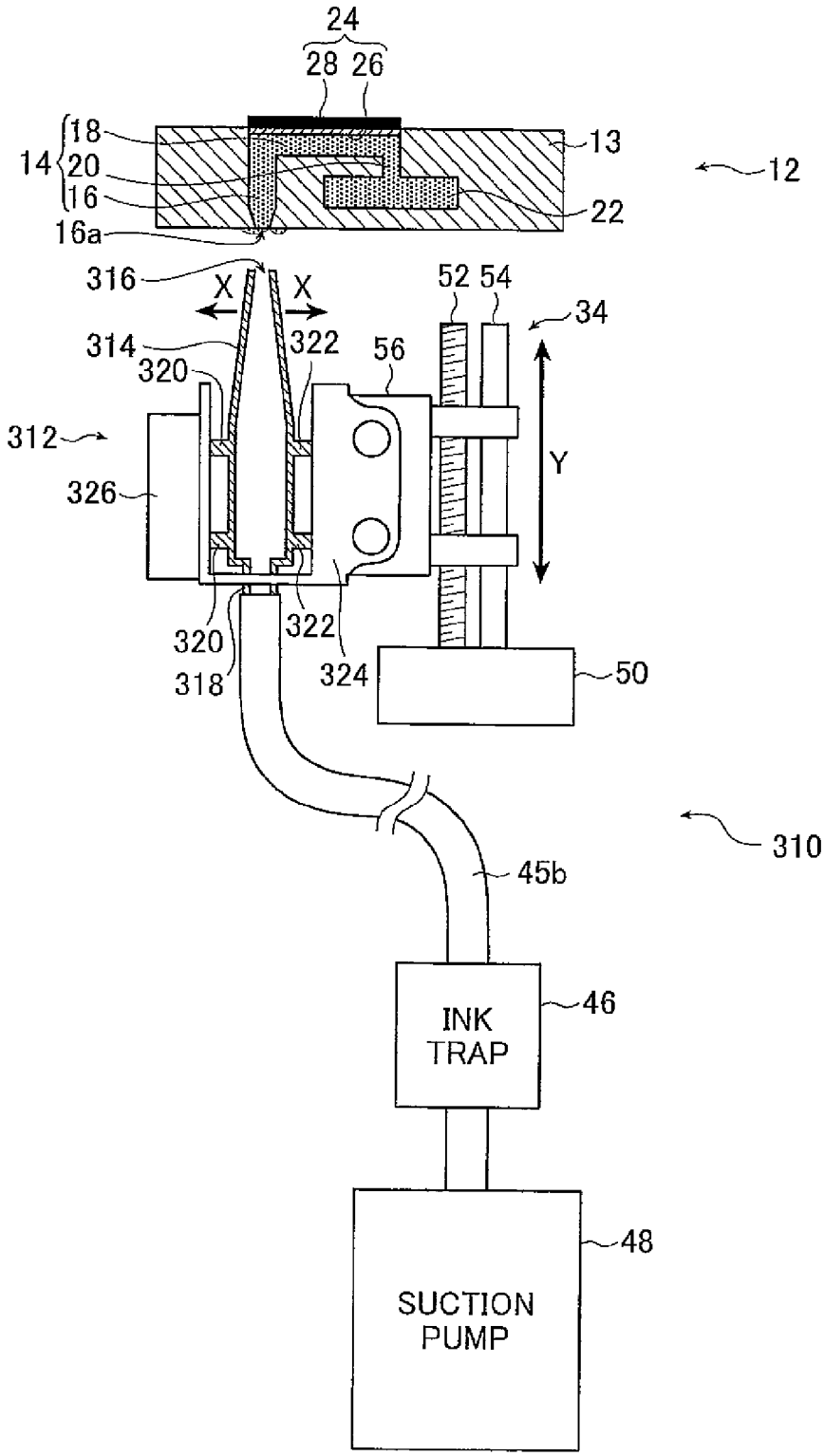
FIG. 15 is a sectional view showing, in simplified form, still another embodiment of the maintenance device of the invention.
Figure 16:
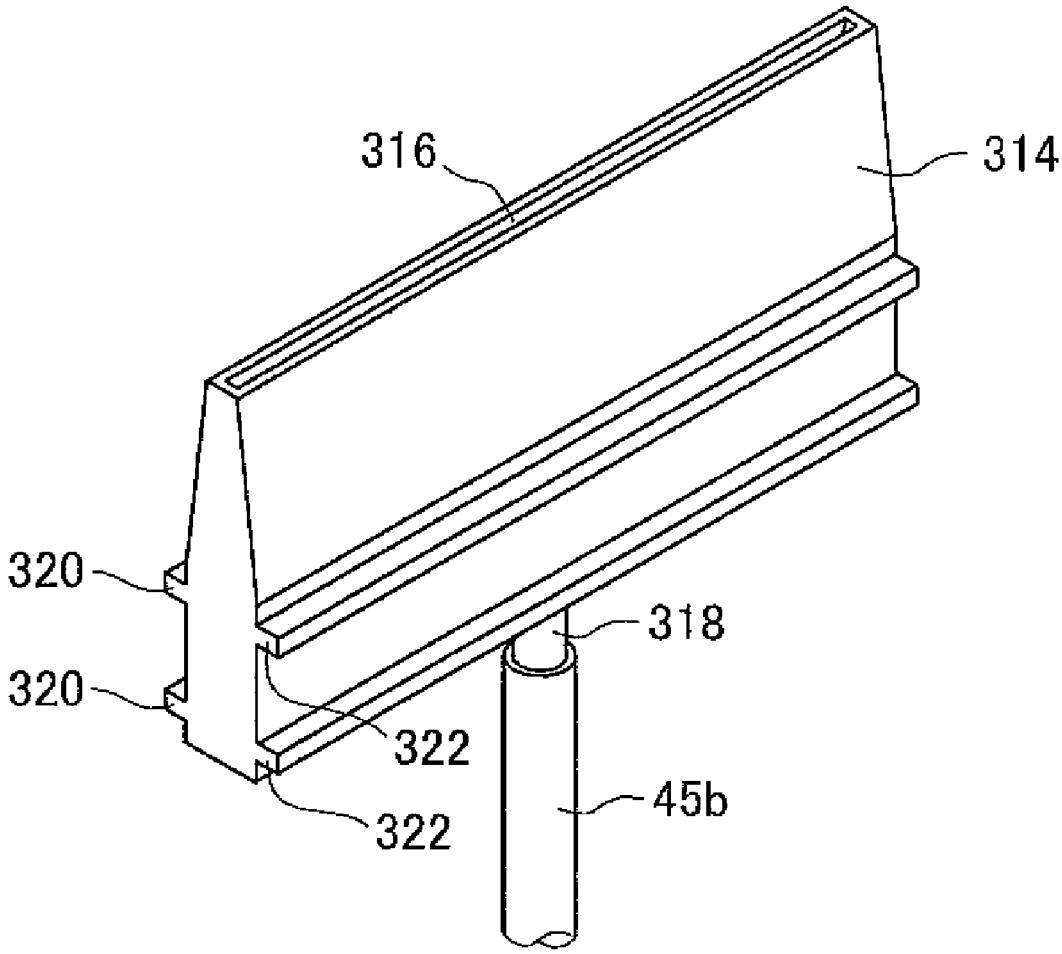
FIG. 16 is a schematic perspective view showing the shape of a suction member in the maintenance device shown in FIG. 15.

FIG. 15 is a partial cross-sectional view showing, in simplified form, still another embodiment of the maintenance device of the invention. FIG. 16 is a perspective view showing the shape of the suction member in FIG. 15.

Because a maintenance device 310 shown in FIG. 15 has an arrangement which, aside from a removal mechanism 312, is the same as that of the maintenance device 30K shown in FIG. 6, like elements in both embodiments are denoted by the same reference symbols and repeated explanations of such elements are omitted below. The following description focuses on the distinctive features of the maintenance device 310.

The maintenance device 310, as described above, is disposed opposite a surface on which orifices 16*a* are formed on the head substrate 13 of a recording head 136K (which surface is also referred to below as the "ink-ejecting surface of the head substrate 13"). That is, the maintenance device 310 is situated on the recording medium P travel path side of the recording head 136K.

Moreover, the maintenance device 310 has a shape with a length in the direction in which the plurality of orifices 16*a* formed on the head substrate 133 are arrayed (also referred to below as the "array direction"), i.e., in a direction parallel to a line connecting the plurality of orifices 16*a* formed in a row, which is of substantially the same length as or longer than the length of the head substrate 13. That is, the maintenance device 310 is formed to a length which corresponds to all the ejection portions 12 on the recording head 136K.

As shown in FIG. 15, the maintenance device 310 has a removal mechanism 312 and a removal mechanism moving means 34. In addition, although not shown in FIG. 15, the maintenance device 310, as with the maintenance device 30K in the earlier described embodiment, has an ink pressurizing mechanism 64 and a solenoid valve 66.

The removal mechanism 312 has a suction member 314, a support 324, a suction member moving mechanism 326, an ink trap 46 and a suction pump 48.

As shown in FIG. 15, the suction member 314 is disposed in a position that faces the ejection portions 12 of the recording head 136K and does not come into contact (i.e., is non-contacting) with the head substrate 13, and has a hollow, box-like shape in which a portion thereof on the ejection portion 12 side has a width which becomes progressively smaller toward the ejection portion 12 side.

Moreover, the suction member 314 has a slit 316 formed at a tip thereof on the ejection portion 12 side. A connector 318 is provided on part of a surface on the side opposite (opposing surface) to the surface on which the slit 316 is formed.

In a cross-section taken perpendicular to the array direction of the orifices 16*a*, a sidewall of the suction member 314, i.e., one of the sides between the side in which the slit 316 is formed and the side in which the connector 318 is formed, is provided with a first set of ridges 320, and the other side is provided with a second set of ridges 322.

Referring to FIG. 16, the suction member 314 has a cross-sectional shape which is substantially the same at any position in the lengthwise direction of the recording head 136K, that is, in the array direction of the orifices 16*a*, except where the connector 318 to the suction pump 48 is formed in a portion thereof.

A tube 45*b* is connected to the connector 318 and is also connected to the suction pump 48. That is, the tube 45*b* communicates with the suction member 314 and the suction pump 48.

An ink trap 46 is disposed on the tube 45*b* between the suction member 314 and the suction pump 48.

Because the ink trap 46 and the suction pump 48 have the same configuration as the ink trap 46 and the suction pump 48 in the above-described maintenance device 30K, detailed explanations of these elements are omitted below.

The removal mechanism 312 configured as described above draws in air from around the slit 316 into the interior of the suction member 314, thereby aspirating ink droplets and debris (solid deposits, etc.) adhering to the ink-ejecting surface of the head substrate 13 at a position opposite the slit 316. This point of the present embodiment will be described subsequently in greater detail.

The support 324 has a box-like shape which is open on one side, and movably supports at the interior thereof the suction member 314. More specifically, the support 324 has a shape which is separated at a given interval from and covers the sides of the suction member 314, except for the side in which the slit 316 is formed, and slidably supports the ridges 320 and 322 on the suction member 314. The support 324 has an opening formed therein at a portion which corresponds to the connector 318.

The suction member moving mechanism 326 is disposed on an outside wall on the side of the support 324 where one set of ridges 320 for the suction member 314 are formed. That is, the suction member moving mechanism 326 is situated opposite the suction member 314 with the support 324 in between.

The suction member moving mechanism 326 is coupled with the ridges 320 on the suction member 314, and causes the suction member 314 to move parallel to the ink-ejecting surface of the head substrate 13 and in a direction perpendicular to the array direction of the orifices 16*a* (the directions X indicated by the arrows in FIG. 15).

Here, the suction member moving mechanism 326 moves the slit 316 on the suction member 314 in a direction perpendicular to the array direction of the orifices 16*a* and, relative to the center of the orifices 16*a*, from a position facing a portion of the ink-ejecting surface of the head substrate 13 that is farther away than one edge of each of the orifices 16*a* to a position facing a portion of the ink-ejecting surface of the head substrate 13 that is farther away than the other edge of each of the orifices 16*a*. That is, the suction member moving mechanism 326 moves the slit 316 in the vicinity of the orifices 16*a* so as to pass by the center of the orifices 16*a*. In other words, the suction member moving mechanism 326 moves the slit 316 in the vicinity of the orifices 16*a* over a distance which is longer than the diameter of the orifices 16*a*.

No particular limitation is imposed on the method by which the suction member moving mechanism 326 moves the suction member 314. Any of various methods may be employed, such as a method that uses a cam, a method that uses an air cylinder, or a method that uses a linear drive.

Next, the removal mechanism moving means 34, which has a supporting base 50, a drive screw 52, a guide rail 54 and a coupler 56, moves the suction member 314 and the support 324 in a direction perpendicular to the ink-ejecting surface of the head substrate 13 (the Y directions indicated by the arrows in FIG. 15).

That is, the removal mechanism moving means 34 moves the suction member 314 from a standby position separated by a given distance from the ink-ejecting surface of the head substrate 13 to a position close to the head substrate 13.

Because the various elements of the removal mechanism moving means 34 are the same as the elements of the removal mechanism in the above-described maintenance device 30K, detailed descriptions of those elements are omitted below.

Next, an ink-jet head maintenance method according to a third aspect of the invention which uses the above-described maintenance device 310 to remove liquid droplets and debris adhering to the ink-ejecting surfaces of the respective head substrates 13 of the recording heads 136Y, 136C, 136M and 136K, particularly in the vicinity of the orifices 16*a*, is described.

As already noted above, because the ink-jet head (recording head) maintenance method is the same for each of the recording heads 136Y, 136C, 136M and 136K, the description given below for the recording head 136K applies also to the other recording heads.

Figure 17A:
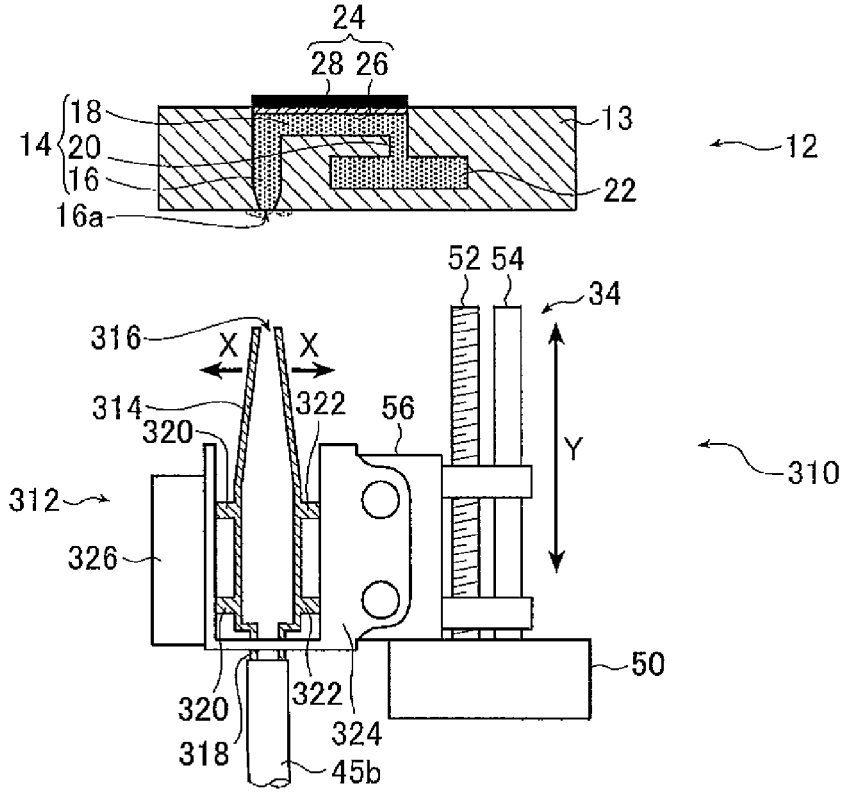
FIGS. 17A and 17B are diagrams showing steps in a maintenance method for a recording head.
Figure 17B:
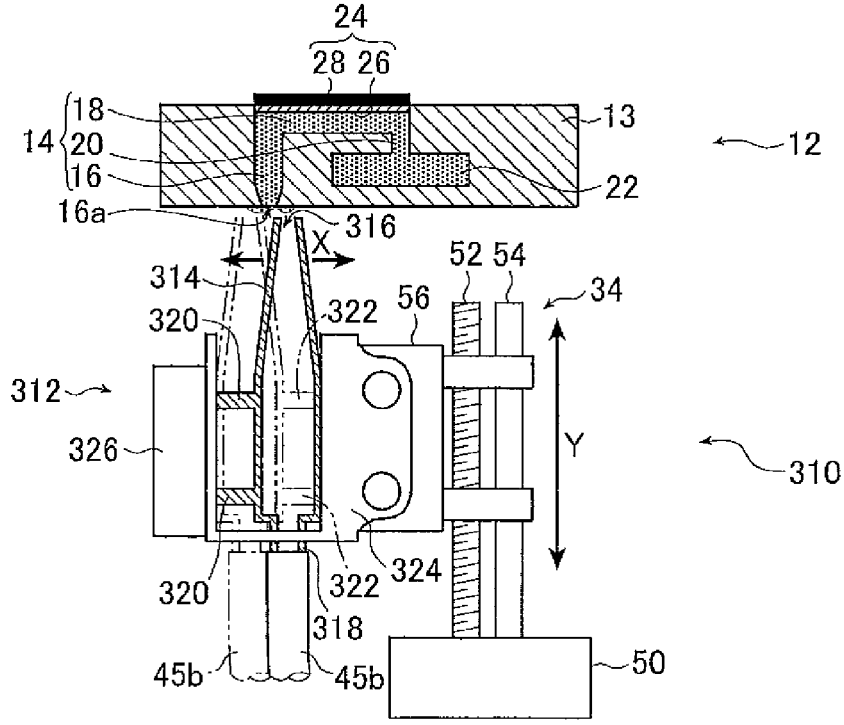

FIGS. 17A and 17B are diagrams showing steps in a maintenance method for the recording head 136K by the maintenance device 310.

First, while images are being recorded with the recording head 136K, i.e., while labels are being produced, the suction member 314 (and the removal mechanism 312, including support members, etc.) stands by at a position away from the recording head, as shown in FIG. 17A; that is, the suction member 314 stands by at a position which does not impede transport of the recording medium P.

When label production by the label printer 100 has finished and maintenance of the recording head 136K is to be carried out, first the maintenance device 310, by means of the suction member moving mechanism 326, moves the suction member 314 toward the ink-ejecting surface of the head substrate 13, as shown in FIG. 17B; that is, the suction member 314 is moved to the recording head 136K side. The slit 316 on the suction member 314 is thus brought closer to the orifices 16*a* on the ejection portions 12. In other words, the slit 316 is moved toward the orifices 16*a* to a position where it does not touch the orifices 16*a*.

Next, the maintenance device 310 draws air inside the suction member 314 with the suction pump 48 to effect a negative pressure, thereby aspirating air and/or ink in the vicinity of the slit 316. That is, i.e., in this embodiment, while aspirating ink together with air through the slit 316, the slit 316 on the suction member 314 is moved by the suction member moving mechanism 326 parallel to the ink-ejecting surface of the head substrate 13 and in a direction perpendicular to the array direction of the orifices 16*a*.

More specifically, the maintenance device 310 moves the suction member 314 from the solid-line position in FIG. 17B to the dashed-line position while aspirating air and/or ink through the slit 316 that has been brought near the ink-ejecting surface of the head substrate 13. That is, the slit 316 on the suction member 314 passes by both edges of the orifices 16*a*.

In this way, even bringing the slit 316 closer to the ink-ejecting surface of the head substrate and moving the slit 316 which is in an air and/or ink aspirating state around the orifices 16*a* enables ink droplets and debris in the vicinity of the orifices 16*a* on the ink-ejecting surface of the head substrate 13 to be aspirated and removed.

By thus aspirating and removing ink droplets and debris from the vicinity of the orifices 16*a*, the direction in which ink droplets are ejected from the orifices 16*a* can be made constant. That is, deviations in the ink droplet deposition positions can be prevented from occurring.

This enables high-quality images to be stably formed on the recording medium.

Moreover, as in the above-described maintenance device 30K, by giving the slit 316 on the suction member 314 a shape that is elongated in the array direction of the orifices 16*a*, it is possible to simultaneously aspirate and remove ink droplets and debris adhering in the vicinity of a plurality of orifices 16*a* formed in a row on the head substrate 13 with the single slit 316 on the suction member 314, thereby enabling maintenance of the recording head to be carried out in a short period of time.

In particular, by giving the suction member 314 a length in the array direction of the orifices 16*a* which is the same as the length of the head substrate 13 in the manner of the present embodiment, that is, by having the length of the slit 316 on the suction member 314 in the present embodiment be a length which covers all the orifices 16*a* arrayed in a row, all the orifices 16*a* formed in a row on the head substrate can be maintained at the same time with the single suction member 314. Moreover, the recording head can be maintained without having to move the suction member 314 in the array direction of the orifices 16*a*.

Because the suction member 314 can remove ink droplets and solid deposits adhering to the vicinity of the orifices 16*a* on the ink-ejecting surface of the head substrate 13 without coming into contact with the ink-ejecting surface, damage to the ink-ejecting surface of the head substrate 13 can be prevented.

Moreover, the slit 316 on the suction member 314 is moved only a short distance in the direction perpendicular to the array direction of the orifices 16*a*, i.e., only around a single orifice 16*a*, enabling a simple drive mechanism to be used.

Also, by carrying out suction while the slit 316 on the suction member 314 is moved, the size of the slit opening can be made smaller. That is, even with a slit 316 having a small opening, ink droplets and debris around the orifices 16*a* can be removed by scanning the slit 316 over the entire region in the vicinity of the orifices 16*a*.

By thus making the size of the opening on the slit 316 small, an inexpensive suction pump may be used. In other words, even when a pump having a small suction force is used, the suction force on air drawn in from the slits 316 can be increased by making the size of the slit opening smaller. By increasing the force of suction from the slit 316, ink droplets and debris in the vicinity of the orifice 16*a* can be more reliably aspirated.

In addition, by moving the slit 316 and varying the position at which it aspirates ink droplets and debris, the suction force acting on the ink droplets and debris adhering to the head substrate 13 can be varied, which can facilitate aspiration.

Hence, in the present embodiment, ink droplets and debris in the vicinity of the orifices can be efficiently removed in a short time, in addition to which the device configuration can be simplified, enabling the device to be made inexpensive.

Here, it is preferable for the suction member moving mechanism 326 to reciprocatingly move the slit 314 on the suction member 314 parallel to the ink-ejecting surface of the head substrate 13 and perpendicular to the array direction of the orifices 16*a*.

By moving the slit 314 reciprocatingly with respect to the orifices 16*a*, ink droplets and debris in the vicinity of the orifices 16*a* can be reliably aspirated and removed.

Because the range over which the slit 314 is reciprocatingly moved perpendicular to the array direction of the orifices 16*a* is limited to the vicinity of a single orifice 16*a*, the suction member 314 (slit 316) can be moved back and forth in a short period of time and with a simple device configuration.

Letting d be the interval in millimeters between the orifices 16*a* and letting L be the size in millimeters of the suction port 316 in a direction perpendicular to the array direction of the orifices 16*a*, it is preferable for the suction member moving mechanism 326 to move the suction member 314 a distance of at least (2×d+L) mm in the direction perpendicular to the array direction of the orifices 16*a*. That is, the suction member moving mechanism 326 preferably moves the slit 316 a distance of at least (2×d+L) mm perpendicular to the array direction of the orifices 16*a*.

By having the suction member moving distance satisfy the above conditions, ink droplets and debris in the vicinity of the orifices 16*a* on the ink-ejecting surface of the head substrate 13 can be reliably removed in a short period of time.

The size of the slit 316 (sometimes referred to below as the "suction port") in the direction perpendicular to the array direction of the orifices 16*a* is preferably at least 0.5 mm but not more than 2.0 mm, and more preferably at least 0.5 mm but not more than 1.0 mm.

By having the size of the slit 316 satisfy the foregoing range, the above-described effects can be more fully achieved.

Figure 18:
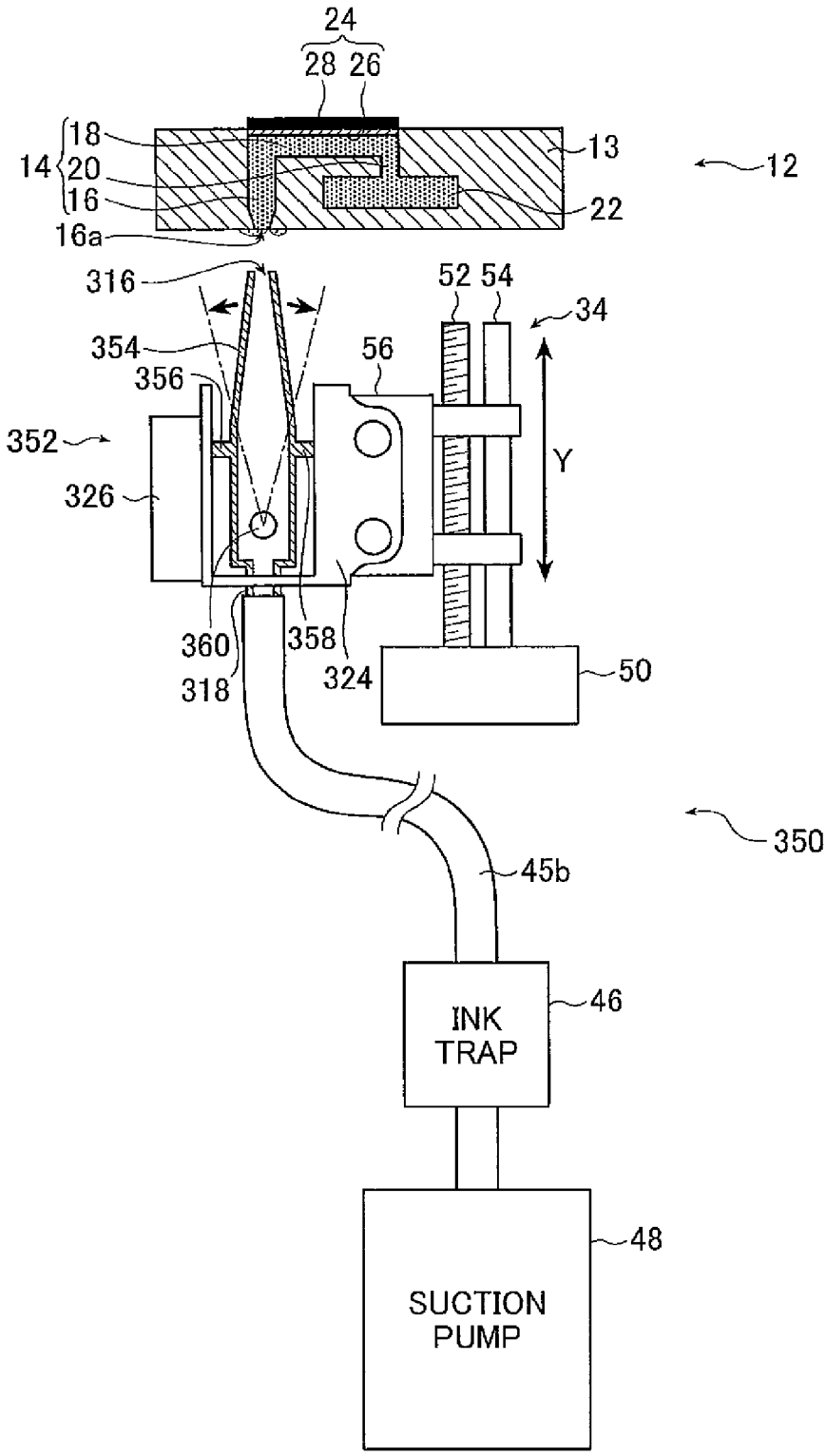
FIG. 18 is a cross-sectional view showing, in simplified form, a further embodiment of the maintenance device of the invention.

FIG. 18 is a simplified view of a still further embodiment of the maintenance device of the invention.

Because the maintenance device 350 shown in FIG. 18 has an arrangement which, aside from a removal mechanism 352, is the same as that of the maintenance device 310 shown in FIG. 15, like elements in both embodiments are denoted by the same reference symbols and repeated explanations of such elements are omitted below. The following description focuses on the distinctive features of the maintenance device 350 in the present embodiment.

The maintenance device 350 has a removal mechanism 352 and a removal mechanism moving means 34.

The removal mechanism 352 has a suction member 354, a support 324, a suction member moving mechanism 326, an ink trap 46 and a suction pump 48. Because the support 324, the suction member moving mechanism 326, the ink trap 46 and the suction pump 48 have the same configurations as the corresponding elements in the above-described maintenance device 310, detailed explanations of these elements are omitted below.

The suction member 354 is disposed opposite the ejection portions 12 on the recording head 136K and has a hollow, box-like shape with a width that becomes progressively smaller toward the ejection portion 12 side.

The suction member 354 has a slit 316 formed at a tip thereof on the ejection portion 12 side. A connector 318 is provided on part of a side of the suction member 354 opposite to the side on which the slit 316 is formed.

In a cross-section taken perpendicular to the direction in which the orifices 16*a* are arrayed, a sidewall of the suction member 354, i.e., one of the sides lying between the side in which the slit 316 is formed and the side in which the connector 318 is formed, is provided with a single first ridge 356 and the other with a single second ridge 358.

In addition, the suction member 354 has a pivot 360 disposed somewhat to the side of the connector 318 from the center thereof.

The pivot 360 is a rod-like member which is disposed parallel to the array direction of the orifices 16*a*, and is rotatably supported at both ends by the support 324.

That is, the suction member 354 is supported so as to be rotatable about the pivot 360 as the axis of rotation.

The first ridge 356 and the second ridge 358 on the suction member 354 are movably supported by the support 324. The first ridge 356 is coupled to the suction member moving mechanism 326.

When the suction member moving mechanism 326 pulls the ridge 356 toward the side of the suction member moving mechanism 326, the suction member 354, and thus the slit 316, rotates toward the suction member moving mechanism 326 side about the pivot 360. Conversely, when the suction member moving mechanism 326 pushes the ridge 356 toward the removal mechanism moving means 34 side, the suction member 354, and thus the slit 316, rotates toward the removal mechanism moving means 34 side about the pivot 360.

Hence, the ink droplets and debris adhering to the vicinity of the orifices 16*a* on the ink-ejecting surface of the head substrate 13 can be aspirated and removed even with a configuration in which the slit 316 is moved by rotating the suction member 354 about the pivot 360.

It is preferable for the suction member 354 to be rotated about the pivot 360, i.e., in both directions.

By rotating the suction member 354, ink droplets and debris adhering to the vicinity of the orifices 16*a* on the ink-ejecting surface of the head substrate 13 can be aspirated and removed.

Here, even in cases where ink droplets and debris adhering to the vicinity of the orifices 16*a* on the ink-ejecting surface of the head substrate 13 are aspirated and removed by using the suction member moving mechanism 326 to move the suction member 354 and thereby move the suction port 316 as in the present embodiment, maintenance of the ink-jet head can be carried out by the various maintenance methods mentioned above in connection with the maintenance device 30K of to the earlier described embodiment.

In the embodiments described above, prior to aspirating air and/or ink from the suction port, that is, while the suction pump is at rest, the suction port was disposed in the vicinity of the ink-ejecting surface of the head substrate by moving the suction member and optionally the blowing member of the removal mechanism with the removal mechanism moving means in a direction perpendicular to the ink-ejecting surface of the head substrate. In other words, the distance from the suction port and optionally the blowing port to the ink-ejecting surface was set at or below a fixed distance. However, instead of or in addition to this, the removal mechanism may be moved parallel to the ink-ejecting surface of the head substrate and parallel to the array direction of the orifices.

Figure 19A:
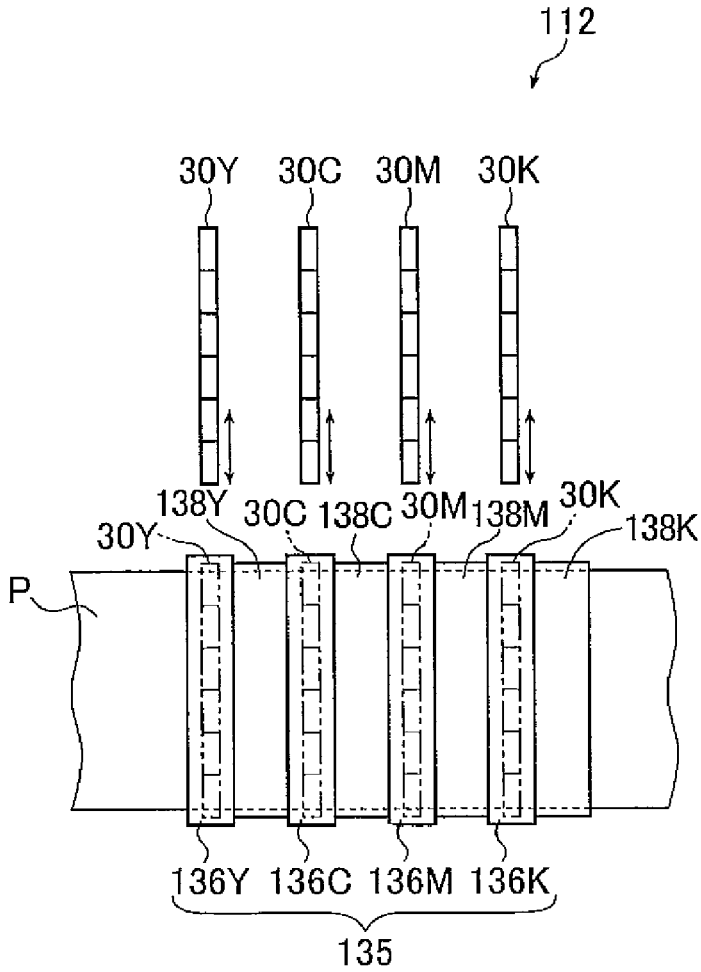
FIG. 19A is a top view showing still another embodiment of the maintenance device in a label printer.
Figure 19B:
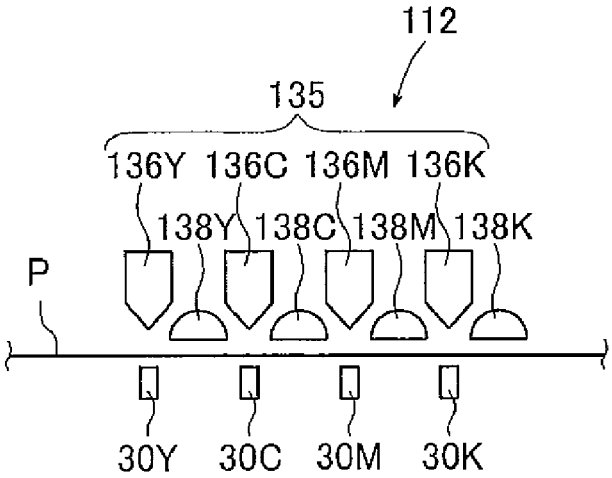
FIG. 19B is a front view of FIG. 19A.

That is, referring to FIGS. 19A and 19B, the removal mechanism standby position may be changed from a position facing the ink-ejecting surface of the head substrate to a position which is separated therefrom by a given distance in a direction parallel to the array direction of the orifices, and specifically to a position outside of the travel path by recording medium P in the width direction thereof, and the removal mechanism moving mechanism may be moved from the standby position (solid lines in FIG. 19A) to a position facing the head substrate (dashed lines in FIG. 19A).

Here, in FIGS. 19A and 19B, although omitted in the diagrams, the moving mechanism which moves the removal mechanism in a direction parallel to the array direction of the orifices is not subject to any particular limitation. For example, use may be made of a method which utilizes a ball screw, or any of various other suitable means of displacement such as a linear drive or belt transport as in a method for moving the suction member (removal mechanism) in a direction perpendicular to the ink-ejecting surface of the head substrate.

Although the moving mechanism is larger, which increases the size of the apparatus as a whole, by setting the removal mechanism standby position outside of the travel path by the recording medium P, even when the maintenance device 30K is moved parallel to the ink-ejecting surface of the head substrate and parallel to the array direction of the orifices, the maintenance device 30K can be prevented from impeding transport of the recording medium P during image recording.

Here, as shown in FIGS. 19A and 19B, in cases where the removal mechanism standby position is set outside of the travel path by the recording medium P, the removal mechanism is held at the standby position during image recording. At the start of maintenance, the removal mechanism moving mechanism moves the removal mechanism from the standby position (solid line in FIG. 19A) to a position opposite the head substrate (dashed line in FIG. 19A). The subsequent operations are the same as in the maintenance methods described above.

Figure 20:
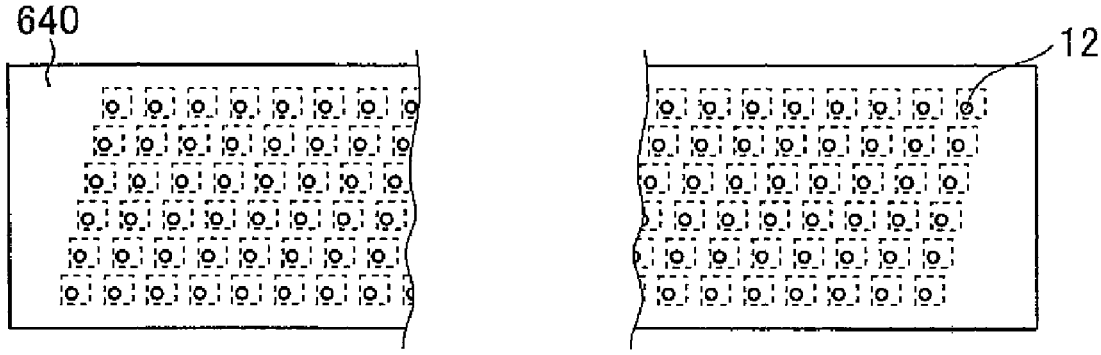
FIG. 20 is a bottom view showing another example of the pattern in which nozzles in the recording head are arranged.

In all of the above embodiments, the recording heads used in the image recording section are full-line heads in which the orifices (ejection portions) are arranged in a single line. However, the recording heads used in the invention are not limited to those having a single-row array of orifices. For example, as shown in FIG. 20, the recording head 640 may be configured in such a way that a plurality of rows of orifices (ejection portions) are disposed in a staggered arrangement at a fixed pitch. By disposing the orifices (ejection portions 12) in such a staggered arrangement on the recording head 640 and using the multiple rows of ejection portions to form a single row of deposited points on the recording medium, it is possible to form images of even higher resolution.

In cases where the ejection portions 12 in the recording head 640 are arranged in a two-dimensional matrix as shown in FIG. 20, it is possible to provide a maintenance device for each row of ejection portions 12 on the recording head. Alternatively, it is possible to provide a movement mechanism which moves a maintenance device in a direction perpendicular to the array direction of the orifices (ejection portions 12), i.e., in the "column" direction of the matrix in FIG. 20, and by moving a single maintenance device in the column direction, aspirates and remove ink droplets and debris from the vicinity of orifices at the ink-ejecting surface of the head substrate on the recording head having more than one row of ejection portions.

The present embodiment can carry out maintenance in a short period of time, a maintenance device is disposed at each recording head. However, the invention is not limited to such an arrangement. By providing instead in the maintenance device a movement mechanism which moves between the respective recording heads, it is possible to service a plurality of recording heads with a single maintenance device, that is, to remove ink droplets and debris adhering to the vicinity of the orifices on the ink-ejecting surfaces of a plurality of head substrates. By employing a single maintenance device in this way, the design of the device can be simplified and the cost of the device lowered.

Also, in the present embodiment, the suction port on the suction member is formed as a single slit for all the orifices arrayed in a row. However, the invention is not limited in this regard. Thus, in another possible arrangement, the suction port may be in the form of a plurality of divided slits. For example, a suction port may be provided for each of the orifices arrayed in a row, and ink droplets and debris adhering to the vicinity of the respective ejection portions on the ink-ejecting surface of the head substrate thereby aspirated.

Likewise, the blowing port on the blowing member may be formed as a single slit for all the orifices arrayed in a row, although other arrangements may instead be used, such as one in which the blowing port is in the form of a plurality of divided slits. For example, a blowing port may be provided for each of the orifices arrayed in a row, and air thereby blown onto the vicinity of the respective ejection portions on the ink-ejecting surface of the head substrate.

The suction port on the suction member is preferably divided in a direction perpendicular to the array direction of the orifices. That is, partitions are preferably disposed on the suction member in a direction parallel to the direction in which the orifices are arranged.

By thus dividing the suction port in a direction perpendicular to the array direction of the orifices, in the event that some of the suction ports become clogged by ink droplets and debris during aspiration, ink droplets and debris can still be aspirated from the other suction ports. It is possible in this way to reliably remove ink droplets and debris from the vicinity of the orifices.

Figure 21:
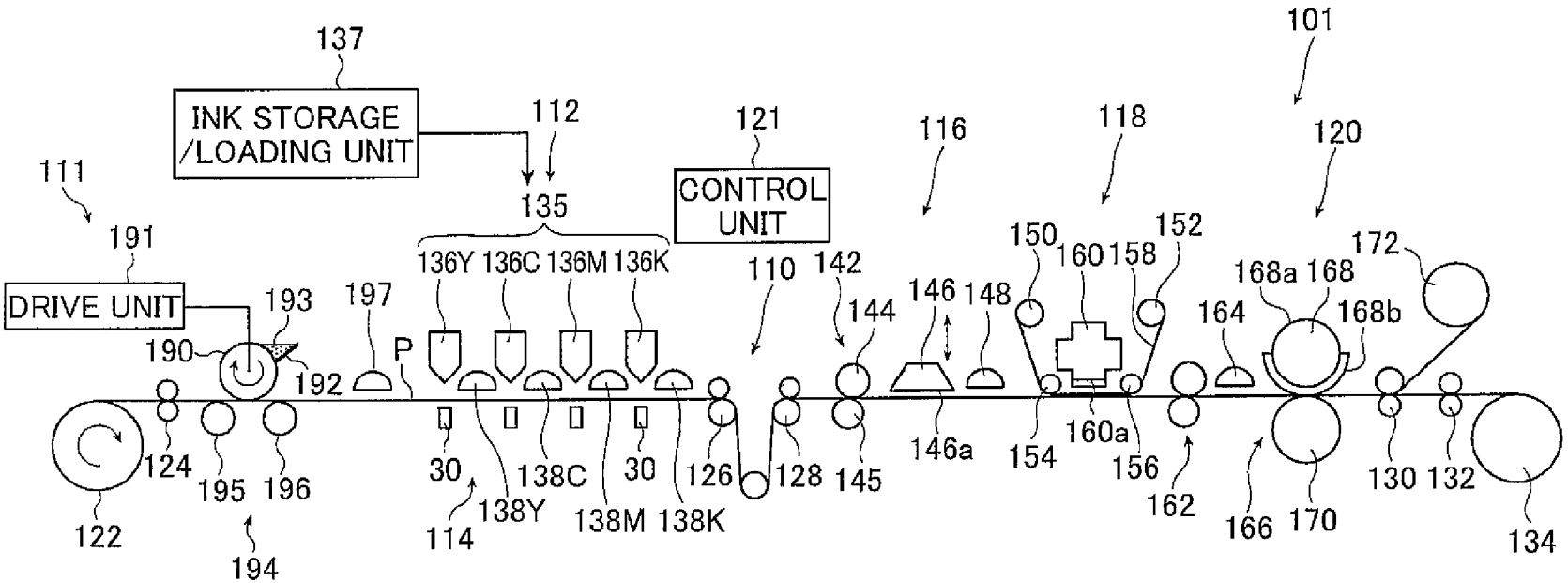
FIG. 21 is a front view showing, in simplified form, another embodiment of a digital label printer which employs a maintenance device according to the invention.

Another embodiment of a digital label printer is described while referring to FIG. 21.

Because a digital label printer 101 shown in FIG. 21 has an arrangement which, aside from the position of the buffer, is the same as that of the digital label printer 100 shown in FIG. 1, like elements in both embodiments are denoted by the same reference symbols and repeated explanations of such elements are omitted below. The following description focuses on the distinctive features of the digital label printer 101 in the present embodiment.

The digital label printer 101 shown in FIG. 21 has a buffer disposed between the image recording section 112 and the surface smoothing section 116. However, the transport buffer is not limited to this position, and may be situated in any of various positions.

In the above embodiments, a description has been provided of a digital label printer which uses an active energy-curable ink, ejects the active energy-curable ink from a recording head to form an active energy-curable ink image on a recording medium P, then exposes the image to active energy so as to cure the image, thereby fixing the image on the recording medium. However, the invention is not limited in this regard. For example, use may also be made of an ink-jet recording device which, by subjecting an image recorded on the recording medium P to heat and pressure, fixes the image on the recording medium P.

The recording head configuration is not limited to the configuration described in connection with the above embodiments, and may have any of various constructions. For example, use may be made of a side shooter type recording head or a top shooter type recording head. In the embodiments described herein, a system is used in which the ink droplets are expelled by the deformation of an actuator such as a piezoelectric element. However, the invention is not limited in this regard. For example, the recording head used may be one which employs any of various ink ejecting systems in place of a piezo system, such as a thermal jet system which uses a heating element such as a heater to heat ink and generate bubbles. In the latter system, the pressure of the bubbles propels droplets of ink.

In the present embodiment, to obtain such effects as the ability to form high-quality images, there is provided an undercoat forming section which, prior to the formation of an image in the image recording section, applies an undercoating liquid onto the recording medium so as to form an undercoat. However, it is not always necessary to provide an undercoat forming section; that is, an image may be formed in the image recording section without first forming an undercoat on the recording medium.

To enable the undercoating liquid to be applied more evenly, it is advantageous for the undercoating liquid to be applied by having the coating roll rotate in the reverse direction. However, the method used to apply the undercoating liquid is not subject to any particular limitation. Any of various methods may be used for this purpose, such as spray coating or coating using an ink-jet recording system.

In all of the above-described embodiments, arrangements are used in which a maintenance device is situated on the digital label printer. However, it is possible for the maintenance device to be an independent unit which is attachable to and detachable from the ink-jet head.

Alternatively, it is possible to integrate the maintenance device and the ink-jet head into a single unit, i.e., to provide an ink-jet unit having both a maintenance device and an ink-jet head.

Likewise, it is possible to provide an ink-jet recording device having at least an ink-jet head and a maintenance device, as exemplified by the digital label printers of the embodiments described herein.

In the foregoing embodiments, the present invention has been described with respect to use in digital label printers. However, the invention is not limited in this regard, and may be adapted for use as a maintenance device or as a maintenance method in devices which use an ink-jet recording system to record images onto various types of recording media (e.g., plain paper, metal, and plastic materials), such as printers and platemaking equipment.

Recording media, undercoating liquids and inks which may be advantageously used in the ink-jet recording device of the invention, particularly undercoating liquids and inks which are suitable for use when semi-curing is effected, are described below.

The various ingredients employed in the inks and undercoat liquids that may be suitably used to work the invention are described below.

Active energy-curable inks which may be advantageously used in the invention include cationic-polymerizable ink compositions, radical-polymerizable ink compositions and aqueous ink compositions.

(Physical Properties of Ink and Undercoat Liquid)

The physical properties of the ink (droplets) ejected onto the recording medium will differ with the device, although in general the viscosity at 25° C. is preferably from 5 to 100 mPa·s, and more preferably from 10 to 80 mPa·s. The viscosity at 25° C. before internal curing of the undercoat liquid is preferably from 10 to 500 mPa·s, and more preferably from 50 to 300 mPa·s.

In the practice of the invention, in order to form dots of the intended size on the recording medium, it is preferable for the undercoat liquid to include a surfactant, and more preferable that it satisfy conditions (A), (B) and (C) below.

(A) The undercoat liquid has a lower surface tension than any of the inks ejected onto the recording medium.

(B) At least one surfactant included in the undercoat liquid satisfies the relationship $$\gamma s(0)-\gamma s(\text{saturation})>0\ (\text{mN/m}).$$

(C) The surface tension of the undercoat liquid satisfies the relationship $$\gamma s<(\gamma s(0)+\gamma s(\text{saturation})^{max})/2.$$

Here, γs represents the surface tension of the undercoat liquid, γs (0) is the surface tension of the liquid from which all the surfactants in the undercoat liquid composition have been excluded, γs (saturation) is the surface tension of the liquid obtained by adding one of the surfactants included in the undercoat liquid to the above "liquid from which all the surfactants in the undercoat liquid composition have been excluded" and increasing the concentration of that surfactant until the surface tension reaches saturation, and γs (saturation)$^{max}$ is the largest of the γs (saturation) values obtained for all the surfactants included in the undercoat liquid that satisfy above condition (B).

Condition (A):

In the practice of the invention, as explained above, to form ink dots of the desired size on the recording medium, it is preferable for the surface tension γs of the undercoat liquid to be lower than the surface tension γk of any of the inks.

Also, to more effectively prevent expansion of the ink dots in the time interval between deposition and exposure, it is more preferable for γs<γk−3 (mN/m), and even more preferable for γs<γk−5 (mN/m).

When a full-color image is formed (printed), to enhance the sharpness of the image, the surface tension γs of the undercoat liquid is preferably lower than the surface tension of an ink containing a colorant having a high luminosity factor, and more preferably lower than the surface tension of all inks. Examples of colorants having a high luminosity factor include colorants which have magenta, black and cyan colors.

Moreover, for proper ejection, the ink surface tension γk and the undercoat liquid surface tension γs should satisfy the above-indicated relationship, with each being preferably within a range of from 15 to 50 mN/m, more preferably within a range of from 18 to 40 mN/m, and most preferably within a range of from 20 to 38 mN/m.

By having the surface tensions for both the ink and the undercoat liquid be at least 15 mN/m, the ink droplets to be ejected by the ink-jet heads can be suitably formed, making it possible to prevent improper ejection from occurring. That is, the ink droplets can be suitably ejected. Also, by having the surface tensions for both the undercoat liquid and the ink be up to 50 mN/m, the wettability with the ink-jet heads can be increased, enabling suitable ejection of the ink droplets. That is, the improper ejection of droplets can be prevented from occurring. By having the surface tensions for both be within a range of from 18 to 40 mN/m, and especially within a range of from 20 to 38 mN/m, the above effects can be better achieved and the ink droplets can be reliably ejected.

In the present embodiment, the surface tensions are values measured by the Wilhelmy plate method at a liquid temperature of 20° C. and 60% relative humidity using a commonly used surface tensiometer (e.g., the CBVP-Z surface tensiometer manufactured by Kyowa Interface Science Co., Ltd.).

Conditions (B) and (C):

In the present invention, the undercoat liquid preferably includes one or more surfactants. By including one or more surfactants in the undercoat liquid, ink dots of the desired size can be more reliably formed on the recording medium. Moreover, it is preferable for the one or more surfactants included in the undercoat liquid to satisfy the following condition (B).

$$\gamma s(0)-\gamma s(\text{saturation})>0 \text{ mN/m} \qquad \text{Condition (B):}$$

In addition, it is preferable for the surface tension of the undercoat liquid to satisfy the following condition (C).

$$\gamma s<(\gamma s(0)+\gamma s(\text{saturation})^{max})/2 \qquad \text{Condition (C):}$$

As mentioned above, γs represents the surface tension of the undercoat liquid, γs (0) is the surface tension of the liquid from which all the surfactants in the undercoat liquid composition have been excluded, γs (saturated) is the surface tension of the liquid obtained by adding one of the surfactants included in the undercoat liquid to the above "liquid from which all the surfactants in the undercoat liquid composition have been excluded" and increasing the concentration of that surfactant until the surface tension reaches saturation, and γs $(\text{saturation})^{max}$ is the largest of the γs (saturation) values obtained for all the surfactants included in the undercoat liquid that satisfy above condition (B).

The above γs (0) value is obtained by measuring the surface tension of the liquid from which all the surfactants in the undercoat liquid composition have been excluded. The above γs (saturation) value is obtained by adding to the above "liquid from which all the surfactants in the undercoat liquid composition have been excluded" one of the surfactants included in the undercoat liquid and, while increasing the concentration of that surfactant present in the liquid in increments of 0.01 wt %, measuring the surface tension of the liquid when the amount of change in surface tension with respect to the change in surfactant concentration falls below 0.01 mN/m.

The above values of γs (0), γs (saturation) and γs $(\text{saturation})^{max}$ are described more fully below.

For example, when the ingredients making up the undercoat liquid (Example 1) are a high-boiling solvent (diethyl phthalate, available from Wako Pure Chemical Industries, Ltd.), a polymerizable material (dipropylene glycol diacrylate; available from Akcros Chemicals Ltd.), a polymerization initiator (TPO, Initiator 1 shown below), a fluorocarbon surfactant (Megaface F475, available from Dainippon Ink & Chemicals, Inc.) and a hydrocarbon surfactant (sodium di-(2-ethylhexyl)sulfosuccinate), the γs (0), γs $(\text{saturation})^1$ (when a fluorocarbon surfactant has been added), γs $(\text{saturation})^2$ (when a hydrocarbon surfactant has been added), γs (saturation) and γs $(\text{saturation})^{max}$ values are as indicated below.

Initiator 1

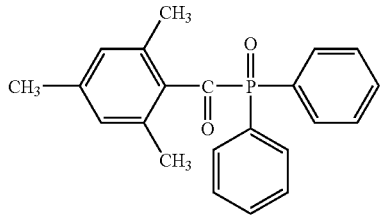

Namely, the value for γs (0), which is the surface tension of the liquid from which all the surfactants in the undercoat liquid have been excluded, is 36.7 mN/m. When the above fluorocarbon surfactant is added to this liquid, the saturation value γs $(\text{saturation})^1$ for the surface tension of the liquid when the surfactant concentration has been increased is 20.2 mN/m. Similarly, when the hydrocarbon surfactant is added to this liquid, the saturation value γs $(\text{saturation})^2$ for the surface tension of the liquid when the surfactant concentration has been increased is 30.5 mN/m.

Because the undercoat liquid (Example 1) includes two types of surfactants which satisfy above condition (B), γs (saturation) can have two values: one for when a fluorocarbon surfactant is added (γs $\text{saturation})^1$, and another for when a hydrocarbon surfactant is added (γs $(\text{saturation})^2$. Because γs $(\text{saturation})^{max}$ is the largest value among γs $(\text{saturation})^1$ and γs $(\text{saturation})^2$ in this case it is the γs $(\text{saturation})^2$ value.

The above values are summarized below.

γs (0)=36.7 mN/m

γs $(\text{saturation})^1$=20.2 mN/m (when fluorocarbon surfactant is added)

γs $(\text{saturation})^2$=30.5 mN/m (when hydrocarbon surfactant is added)

γs $(\text{saturation})^{max}$=30.5 mN/m

From the above results, it is preferable for the surface tension γs of the undercoat liquid in the foregoing example to satisfy the following relationship:

$$\gamma s<(\gamma s(0)+\gamma s(\text{saturation})^{max})/2=33.6 \text{ mN/m}.$$

With regard to above condition (C), to more effectively prevent ink droplet expansion during the period between deposition and exposure, it is preferable for the surface tension of the undercoat liquid to satisfy the relationship:

$$\gamma s<\gamma s(0)-3\times\{\gamma s(0)-\gamma s(\text{saturation})^{max}\}/4,$$

and especially preferable for it to satisfy the relationship:

$$\gamma s\leqq\gamma s(\text{saturation})^{max}.$$

While it suffices for the compositions of the ink and the undercoat liquid to be selected so that the desired surface tension is obtainable, it is preferable for these liquids to include a surfactant. As already explained, to form ink dots of the desired size on the recording medium, it is preferable for the undercoat liquid to include at least one surfactant. A description of the surfactant follows below.

(Surfactant)

The surfactant used in the invention is typically a substance having a strong surface activity with respect to at least one solvent from among hexane, cyclohexane, p-xylene, toluene, ethyl acetate, methyl ethyl ketone, butyl carbitol, cyclohexanone, triethylene glycol monobutyl ether, 1,2-hexanediol, propylene glycol monomethyl ether, isopropanol, methanol, water, isobornyl acrylate, 1,6-hexanediol diacrylate and polyethylene glycol diacrylate; preferably a substance having a strong surface activity with respect to at least one solvent from among hexane, toluene, propylene glycol monomethyl ether, isobornyl acrylate, 1,6-hexanediol diacrylate and polyethylene glycol diacrylate; more preferably a substance having a strong surface activity with respect to at least one solvent from among propylene glycol monomethyl ether, isobornyl acrylate, 1,6-hexanediol diacrylate and polyethylene glycol diacrylate; and most preferably a substance having a strong surface activity with respect to at least one solvent from among isobornyl acrylate, 1,6-hexanediol diacrylate and polyethylene glycol diacrylate.

Whether or not a particular compound is a substance having a strong surface activity with respect to the solvents listed above can be determined by the following procedure.

One solvent is selected from the solvents listed above, and the surface tension $\gamma_{solvent}$ (0) for that solvent is measured. The compound is added to the same solvent as that for which $\gamma_{solvent}$ (0) was determined and, as the concentration of the compound is increased in increments of 0.01 wt %, the surface tension $\gamma_{solvent}$ (saturation) of the solution when the change in surface tension with respect to the change in compound concentration falls below 0.01 mN/m is measured. If the relationship between $\gamma_{solvent}$ (0) and $\gamma_{solvent}$ (saturation) satisfies the condition $$\gamma_{solvent}(0)-\gamma_{solvent}(\text{saturation})>1\ (\text{mN/m}),$$

it can be concluded that the compound is a substance having a strong surface activity with respect to the solvent.

Specific examples of surfactants which may be included in the undercoat liquid include anionic surfactants such as dialkylsulfosuccinic acid salts, alkylnaphthalenesulfonic acid salts, and fatty acid salts; nonionic surfactants such as polyoxyethylene alkyl ethers, polyoxyethylene alkylallyl ethers, acetylene glycols and polyoxyethylene polyoxypropylene block copolymers; cationic surfactants such as alkylamine salts and quaternary ammonium salts; and fluorocarbon surfactants. Other suitable surfactants include those mentioned in, for example, JP 62-173463 A and JP 62-183457 A.

(Cure Sensitivity of Ink and Undercoat Liquid)

In the practice of the invention, the cure sensitivity of the ink is preferably comparable to or higher than the cure sensitivity of the undercoat liquid. The cure sensitivity of the ink is more preferably higher than the cure sensitivity of the undercoat liquid but not more than four times the cure sensitivity of the undercoat liquid, and even more preferably higher than the cure sensitivity of the undercoat liquid but not more than two times the cure sensitivity of the undercoat liquid.

As used herein, "cure sensitivity" refers to the amount of energy required for complete curing when the ink and/or the undercoat liquid is cured using a mercury vapor lamp (e.g., a ultrahigh-pressure, high-pressure or moderate-pressure mercury-vapor lamp; preferably an ultrahigh-pressure mercury vapor lamp). A smaller amount of energy means a higher cure sensitivity. Accordingly, a two-fold cure sensitivity means that the amount of energy required for complete curing is one-half as large.

Also, reference herein to a cure sensitivity as being "comparable" signifies that the difference in the cure sensitivities of the two liquids being compared is less than 2-fold, and preferably less than 1.5-fold.

(Recording Medium)

The recording medium used in the ink-jet recording device of the present embodiment may be a permeable recording medium, an impermeable recording medium or a slowly permeable recording medium. Of these, the advantageous effects of the invention can be more clearly achieved with the use of an impermeable or slowly permeable recording medium. As used herein, "permeable recording medium" refers to a recording medium in which, when a 10 pL (picoliter) droplet is deposited on the recording medium, permeation of all the liquid takes not more than 100 ms. "Impermeable recording medium" refers herein to a recording medium in which a droplet substantially does not permeate. "Substantially does not permeate" connotes here a permeability of a droplet after 1 minute of not more than 5%. Also, "slowly permeable recording medium" refers herein to a recording medium in which, when a 10 pL droplet is deposited on the recording medium, permeation of all the liquid takes 100 ms or more.

Illustrative examples of permeable recording media include plain paper, porous paper, and recording media capable of absorbing other liquids.

Illustrative examples of impermeable or slowly permeable recording media include art paper, plastic, rubber, resin-coated paper, glass, metal, ceramic and wood. In the practice of the invention, composite recording media in which a plurality of these materials are combined may also be used for the purpose of adding the functionality thereof.

For plastic recording media, any suitable plastic may be used. Illustrative examples include polyesters such as polyethylene terephthalate and polybutadiene terephthalate; polyolefins such as polyvinyl chloride, polystyrene, polyethylene, polyurethane and polypropylene; and also acrylic resins, polycarbonate, acrylonitrile-butadiene-styrene copolymers, diacetate, triacetate, polyimide, cellophane and celluloid. The thickness and shape of the recording medium when a plastic is used are not subject to any particular limitation. That is, the recording medium may be in the form of a film-like, card-like or block-like shape, and may be either clear or opaque.

It is preferable to use as this plastic recording medium any of various types of film-like, non-absorbing plastics employed in soft packaging, or films made thereof. Illustrative examples of such plastic films include PET films, OPS films, OPP films, PNy films, PVC films, PE films, TAC films and PP films. Other plastics that may be used include polycarbonate, acrylic, ABS, polyacetal and PVA. Use may also be made of rubber.

Illustrative examples of resin-coated paper-type recording media include clear polyester films, opaque polyester films, opaque polyolefin resin films, and paper substrates laminated on both sides with a polyolefin resin. The use of a paper substrate laminated on both sides with a polyolefin resin is especially preferred.

Metal recording media are not subject to any particular limitation. For example, suitable use can be made of aluminum, iron, gold, silver, copper, nickel, titanium, chromium, molybdenum, silicon, lead, zinc and stainless steel, as well as composite materials thereof.

In addition, it is also possible to use as the recording medium read-only optical disks such as CD-ROMs and DVD-ROMs, write-once optical disks such as CD-Rs and DVD-Rs, and rewritable optical disks. In such cases, the image is preferably recorded on the "label" side of the disk.

(Ink and Undercoat Liquid)

Inks and undercoat liquids suitable for use in the invention are described in detail below.

The ink, which has at least a composition suitable for forming images, includes at least one polymerizable or crosslinkable material, and optionally includes as well a polymerization initiator, a hydrophilic solvent, a colorant and other ingredients.

The undercoat liquid includes at least one polymerizable or crosslinkable material, and optionally includes as well a polymerization initiator, a hydrophilic solvent, a colorant and other ingredients. It is preferable for the undercoat liquid to be formulated so as to have a different composition than the ink.

The polymerization initiator is preferably a compound which is capable of initiating a polymerization reaction or crosslinking reaction under the influence of active energy rays. An undercoat liquid that has been applied to the coating medium can in this way be cured by exposure to active energy rays.

The undercoat liquid and/or the ink preferably includes a radical-polymerizable composition. As used herein, "radical-polymerizable composition" refers to a composition which includes at least one radical-polymerizable material and at least one radical polymerization initiator. Because the undercoat liquid and/or ink includes a radical-polymerizable composition, the undercoat liquid and/or ink curing reaction can be carried out at a high sensitivity in a short period of time.

Moreover, it is preferable for the ink to include a colorant. It is preferable for the undercoat liquid which is used in combination with this ink to either have a composition that includes no colorant or includes less than 1 wt % of colorant, or to have a composition that includes a white pigment as the colorant.

The various ingredients which make up the ink and/or undercoat liquid are described below.

(Polymerizable or Crosslinkable Material)

The polymerizable or crosslinkable material has the function of triggering a polymerization or crosslinking reaction with initiating species such as radicals generated from, for example, the subsequently described polymerization initiator, and thus causing the composition containing these to cure.

The polymerizable or crosslinkable material employed may be a polymerizable or crosslinkable material which elicits a known polymerizable or crosslinking reaction such as a radical polymerization reaction and a dimerization reaction. Illustrative examples include addition-polymerizable compounds having at least one ethylenically unsaturated double bond, high-molecular-weight compounds having pendant maleimide groups, and high-molecular-weight compounds having a pendant cinnamyl, cinnamylidene or chalcone group with a photodimerizable unsaturated double bond adjacent to an aromatic ring. Of these, an addition-polymerizable compound having at least one ethylenically unsaturated double bond is preferred. Selection from among compounds having at least one, and preferably two or more, terminal ethylenically unsaturated bonds (monofunctional or polyfunctional compounds) is especially preferred. More specifically, suitable selection may be made from among such compounds that are well-known in the industrial field of the invention, including those having the chemical form of, for example, monomers, prepolymers (i.e., dimers, trimers and oligomers) and mixtures thereof, as well as copolymers thereof.

The polymerizable or crosslinkable materials may be used singly or as a combination of two or more thereof.

The use as the polymerizable or crosslinkable material in the invention of, in particular, any of various known radical-polymerizable monomers in which a polymerization reaction is triggered by an initiating species generated from a radical initiator is preferred.

Examples of radical-polymerizable monomers include (meth)acrylates, (meth)acrylamides, aromatic vinyls, vinyl ethers and compounds having internal double bonds (e.g., maleic acid). Here, "(meth)acrylate" refers to either or both "acrylate" and "methacrylate," and "(meth)acryl" refers to either or both "acryl" and "methacryl."

[0188-0189]

Illustrative examples of (meth)acrylates are as follows:

Specific examples of monofunctional (meth)acrylates include hexyl(meth)acrylate, 2-ethylhexyl(meth)acrylate, tert-octyl(meth)acrylate, isoamyl(meth)acrylate, decyl (meth)acrylate, isodecyl(meth)acrylate, stearyl(meth)acrylate, isostearyl(meth)acrylate, cyclohexyl(meth)acrylate, 4-n-butylcyclohexyl(meth)acrylate, bornyl(meth)acrylate, isobornyl(meth)acrylate, benzyl(meth)acrylate, 2-ethyl hexyl diglycol(meth)acrylate, butoxyethyl(meth)acrylate, 2-chloroethyl(meth)acrylate, 4-bromobutyl(meth)acrylate, cyanoethyl(meth)acrylate, benzyl(meth)acrylate, butoxymethyl(meth)acrylate, 3-methoxybutyl(meth)acrylate, alkoxymethyl(meth)acrylate, alkoxyethyl(meth)acrylate, 2-(2-methoxyethoxy)ethyl(meth)acrylate, 2-(2-butoxyethoxy)ethyl(meth)acrylate, 2,2,2-trifluoroethyl(meth)acrylate, 1H,1H,2H,2H-perfluorodecyl(meth)acrylate, 4-butylphenyl(meth)acrylate, phenyl(meth)acrylate, 2,4,5-tetramethylphenyl(meth)acrylate, 4-chlorophenyl(meth) acrylate, phenoxymethyl(meth)acrylate, phenoxyethyl (meth)acrylate, glycidyl(meth)acrylate, glycidyloxybutyl (meth)acrylate, glycidyloxyethyl(meth)acrylate, glycidyloxypropyl(meth)acrylate, tetrahydrofurfuryl(meth) acrylate, hydroxyalkyl(meth)acrylate, 2-hydroxyethyl(meth) acrylate, 3-hydroxypropyl(meth)acrylate, 2-hydroxypropyl (meth)acrylate, 2-hydroxybutyl(meth)acrylate, 4-hydroxybutyl(meth)acrylate, dimethylaminoethyl(meth) acrylate, diethylaminoethyl(meth)acrylate, dimethylaminopropyl(meth)acrylate, diethylaminopropyl(meth)acrylate, trimethoxysilylpropyl(meth)acrylate, trimethylsilylpropyl (meth)acrylate, polyethylene oxide monomethyl ether(meth) acrylate, oligoethylene oxide monomethyl ether(meth)acrylate, polyethylene oxide(meth)acrylate, oligoethylene oxide (meth)acrylate, oligoethylene oxide monoalkyl ether(meth) acrylate, polyethylene oxide monoalkyl ether(meth)acrylate, dipropylene glycol(meth)acrylate, polypropylene oxide monoalkyl ether(meth)acrylate, oligopropylene oxide monoalkyl ether(meth)acrylate, 2-methacryloyloxyethylsuccinic acid, 2-methacryloyloxyhexahydrophthalic acid, 2-methacryloyloxyethyl-2-hydroxypropylphthalate, hutoxydiethylene glycol(meth)acrylate, trifluoroethyl(meth)acrylate, perfluorooctylethyl(meth)acrylate, 2-hydroxy-3-phenoxypropyl(meth)acrylate, EO-modified phenol (meth) acrylate, EO-modified cresol(meth)acrylate, EO-modified nonylphenyl(meth)acrylate, PO-modified nonylphenyl (meth)acrylate and EO-modified 2-ethylhexyl(meth)acrylate.

Specific examples of difunctional (meth)acrylates include 1,6-hexanediol di(meth)acrylate, 1,10-decanediol di(meth) acrylate, neopentyl glycol di(meth)acrylate, 2,4-dimethyl-1,5-pentanediol di(meth)acrylate, butylethylpropanediol di(meth)acrylate, ethoxylated cyclohexanemethanol di(meth)acrylate, polyethylene glycol di(meth)acrylate, oligoethylene glycol di(meth)acrylate, ethylene glycol di(meth) acrylate, 2-ethyl-2-butylbutanediol di(meth)acrylate, hydroxypivalic acid neopentyl glycol di(meth)acrylate, EO-modified bisphenol A di(meth)acrylate, bisphenol F polyethoxy di(meth)acrylate, polypropylene glycol di(meth)acrylate, oligopropylene glycol di(meth)acrylate, 1,4-butanediol di(meth)acrylate, 2-ethyl-2-butylpropanediol di(meth)acrylate, 1,9-nonane di(meth)acrylate, propoxylated ethoxylated bisphenol A di(meth)acrylate and tricyclodecane di(meth) acrylate.

Specific examples of trifunctional (meth)acrylates include trimethylolpropane tri(meth)acrylate, trimethylolethane tri (meth)acrylate, the alkylene oxide-modified tri(meth)acrylate of trimethylolpropane, pentaerythritol tri(meth)acrylate, dipentaerythritol tri(meth)acrylate, trimethylolpropane tris ((meth)acryloyloxypropyl)ether, isocyanuric acid alkylene oxide-modified tri(meth)acrylate, propionic acid dipentaerythritol tri(meth)acrylate, tris((meth)acryloyloxyethyl) isocyanurate, hydroxypivalaldehyde-modified dimethylolpropane tri(meth)acrylate, sorbitol tri(meth)acrylate, propoxylated trimethylolpropane tri(meth)acrylate and ethoxylated glycerol triacrylate.

Specific examples of tetrafunctional (meth)acrylates include pentaerythritol tetra(meth)acrylate, sorbitol tetra (meth)acrylater ditrimethylolpropane tetra(meth)acrylate, propionic acid dipentaerythritol tetra(meth)acrylate and ethoxylated pentaerythritol tetra(meth)acrylate.

Specific examples of pentafunctional (meth)acrylates include sorbitol penta(meth)acrylate and dipentaerythritol penta(meth)acrylate.

Specific examples of hexafunctional (meth)acrylates include dipentaerythritol hexa(meth)acrylate, sorbitol hexa (meth)acrylate, the alkylene oxide-modified hexa(meth)acrylate of phosphazene, and captolactone-modified dipentaerythritol hexa(meth)acrylate.

Examples of (meth)acrylamides include (meth)acrylamide, N-methyl(meth)acrylamide, N-ethyl(meth)acrylamide, N-propyl(meth)acrylamide, N-n-butyl(meth)acrylamide, N-t-butyl(meth)acrylamide, N-butoxymethyl(meth) acrylamide, N-isopropyl(meth)acrylamide, N-methylol (meth)acrylamide, N,N-dimethyl(meth)acrylamide, N,N-diethyl(meth)acrylamide and (meth)acryloylmorpholine.

Examples of aromatic vinyls include styrene, methylstyrene, dimethylstyrene, trimethylstyrene, ethylstyrene, isopropylstyrene, chloromethylstyrene, methoxystyrene, acetoxystyrene, chlorostyrene, dichlorostyrene, bromostyrene, methyl vinylbenzoate, 3-methylstyrene, 4-methylstyrene, 3-ethylstyrene, 4-ethylstyrene, 3-propylstyrene, 4-propylstyrene, 3-butylstyrene, 4-butylstyrene, 3-hexylstyrene, 4-hexylstyrene, 3-octylstyrene, 4-octylstyrene, 3-(2-ethylhexyl)styrene, 4-(2-ethylhexyl)styrene, allylstyrene, isopropenylstyrene, butenylstyrene, octenylstyrene, 4-t-butoxycarbonylstyrene, 4-methoxystyrene and 4-t-butoxystyrene.

Vinyl ethers are exemplified by monovinyl ethers such as methyl vinyl ether, ethyl vinyl ether, propyl vinyl ether, n-butyl vinyl ether, t-butyl vinyl ether, 2-ethylhexyl vinyl ether, n-nonyl vinyl ether, lauryl vinyl ether, cyclohexyl vinyl ether, cyclohexyl methyl vinyl ether, 4-methylcyclohexyl methyl vinyl ether, benzyl vinyl ether, dicyclopentenyl vinyl ether, 2-dicyclopentenoxyethyl vinyl ether, methoxyethyl vinyl ether, ethoxyethyl vinyl ether, butoxyethyl vinyl ether, methoxyethoxyethyl vinyl ether, ethoxyethoxyethyl vinyl ether, methoxypolyethylene glycol vinyl ether, tetrahydrofurfuryl vinyl ether, 2-hydroxyethyl vinyl ether, 2-hydroxypropyl vinyl ether, 4-hydroxybutyl vinyl ether, 4-hydroxymethylcyclohexyl methyl vinyl ether, diethylene glycol monovinyl ether, polyethylene glycol vinyl ether, chloroethyl vinyl ether, chlorobutyl vinyl ether, chloroethoxyethyl vinyl ether, phenylethyl vinyl ether and phenoxypolyethylene glycol vinyl ether.

Examples of polyvinyl ethers include divinyl ethers such as ethylene glycol divinyl ether, diethylene glycol divinyl ether, polyethylene glycol divinyl ether, propylene glycol divinyl ether, butylene glycol divinyl ether, hexanediol divinyl ether, bisphenol A alkylene oxide divinyl ether and bisphenol F alkylene oxide divinyl ether; and other polyvinyl ethers such as trimethylolethane trivinyl ether, trimethylolpropane trivinyl ether, ditrimethylolpropane tetravinyl ether, glycerol trivinyl ether, pentaerythritol tetravinyl ether, dipentaerythritol pentavinyl ether, dipentaerythritol hexavinyl ether, ethylene oxide adducts of trimethylolpropane trivinyl ether, propylene oxide adducts of trimethylolpropane trivinyl ether, ethylene oxide adducts of ditrimethylolpropane tetravinyl ether, propylene oxide adducts of ditrimethylolpropane tetravinyl ether, ethylene oxide adducts of pentaerythritol tetravinyl ether, propylene oxide adducts of pentaerythritol tetravinyl ether, ethylene oxide adducts of dipentaerythritol hexavinyl ether and propylene oxide adducts of dipentaerythritol hexavinyl ether.

From the standpoint of such considerations as curability, adhesion to the recording medium and surface hardness of the formed image, it is preferable to use as the vinyl ether compound a di- or trivinyl ether compound. The use of a divinyl ether compound is especially preferred.

In addition to the above, other examples of radical-polymerizable monomers include vinyl esters (e.g., vinyl acetate, vinyl propionate, vinyl versatate), allyl esters (e.g., allyl acetate), halogen-bearing monomers (e.g., vinylidene chloride, vinyl chloride), vinyl cyanides (e.g., (meth)acrylonitrile), and olefins (e.g., ethylene, propylene).

Of the above, from the standpoint of the cure rate, it is preferable to use (meth)acrylates and (meth)acrylamides as the radical-polymerizable monomer. The use of (meth)acrylates having a functionality of 4 or more is especially preferred for achieving a good cure rate. In addition, from the standpoint of the viscosity of the ink composition, the use of a polyfunctional (meth)acrylate in combination with a monofunctional or bifunctional (meth)acrylate or (meth)acrylamide is preferred.

The content of the polymerizable or crosslinkable material in the ink and the undercoat liquid is preferably in a range of 50 to 99.6 wt %, more preferably in a range of 70 to 99.0 wt %, and even more preferably in a range of 80 to 99.0 wt %, based on the weight of the total solids in each droplet.

The content in a droplet, based on the total weight of each droplet, is preferably in a range of 20 to 98 wt %, more preferably in a range of 40 to 95 wt %, and most preferably in a range of 50 to 90 wt %.

(Polymerization Initiator)

It is preferable for at least the undercoat liquid, or for both the ink and the undercoat liquid, to include at least one polymerization initiator. This initiator is a compound which generates initiating species such as radicals when the energy of active rays, heat or both is applied thereto, thereby initiating and promoting a polymerization or crosslinking reaction of the above-described polymerizable or crosslinkable material so as to effect curing.

The polymerizable material preferably includes a polymerization initiator which triggers radical polymerization. A photopolymerization initiator is especially preferred.

Photopolymerization initiators are compounds which incur a chemical change due to the action of light or to interactions with the electronically excited state of a sensitizing dye, and generates at least one of the following: a radical, an acid or a base. Of such compounds, a photoradical generator is preferred for initiating polymerization by the simple means of exposure to light.

The photopolymerization initiator used in the invention may be suitably selected from among those having sensitivity to the active rays used for exposure, such as 400 nm to 200 nm ultraviolet light, far-ultraviolet light, g-line radiation, h-line radiation, i-line radiation, KrF excimer laser light, ArF excimer laser light, electron beams, x-rays, molecular beams and ion beams.

Any photopolymerization initiator known to those skilled in the art may be used without limitation. Numerous examples are mentioned in, for example, B. M. Monroe et al.: *Chemical Revue* 93, 435 (1993); R. S. Davidson: *Journal of Photochemistry and Biology A: Chemistry* 73, 81 (1993); J. F. Paussier: "Photoinitiated Polymerization—Theory and Applications," in *Rapra Review Reports*, Vol. 9, Rapra Technology, Ltd. (1998); and M. Tsunooka et al.: *Prog. Polym. Sci.* 21, 1 (1996). In addition, use may also be made of the group of compounds mentioned in, for example, F. D. Saeva: *Topics in Current Chemistry* 156, 59 (1990); G. G. Maslak: *Topics in Current Chemistry* 168, 1 (1993); H. B. Shuster et al.: *JACS* 112, 6329 (1990); and I. D. F. Eaton et al.: *JACS* 102, 3298 (1980), which undergo oxidative or reductive bond cleavage through interactions with the electronically excited state of the sensitizing dye.

Preferred photopolymerization initiators include (a) aromatic ketones, (b) aromatic onium salt compounds, (c) organic peroxides, (d) hexaarylbiimidazole compounds, (e) ketoxime ester compounds, (f) borate compounds, (g) azinium compounds, (h) metallocene compounds, (i) active ester compounds, and (j) compounds having carbon-halogen bonds.

Preferred examples of aromatic ketones (a) include the compounds having a benzophenone skeleton or a thioxanthone skeleton mentioned on pages 77 to 117 of *Radiation Curing in Polymer Science and Technology* by J. P. Fouassier and J. F. Rabek (1993). More preferred examples of aromatic ketones (a) include the α-thiobenzophenone compounds mentioned in JP 47-6416 B, the benzoin ether compounds mentioned in JP 47-3981 B, the α-substituted benzoin compounds mentioned in JP 47-22326 B, the benzoin derivatives mentioned in JP 47-23664 B, the aroylphosphonic acid esters mentioned in JP 57-30704 A, the dialkoxybenzophenones mentioned in JP 60-26483 B, the benzoin ethers mentioned in JP 60-26403 B and 62-81345 A, the α-aminobenzophenones mentioned in JP 1-34242 B, U.S. Pat. No. 4,318,791 and EP 0284561 A, the p-di(dimethylaminobenzoyl) benzenes mentioned in JP 2-211452 A, the thio-substituted aromatic ketones mentioned in JP 61-194062 A, the acylphosphine sulfides mentioned in JP 2-9597 B, the acylphosphines mentioned in JP 2-9596 B, the thioxanthones mentioned in JP 63-61950 B, and the coumarins mentioned in JP 59-42864 B.

Exemplary aromatic onium salt compounds (b) include aromatic onium salts of periodic table group V, VI, and VII elements such as nitrogen, phosphorus, arsenic, antimony, bismuth, oxygen, sulfur, selenium, tellurium and iodine. Preferred examples include iodonium salts mentioned in EP 104143 B, U.S. Pat. No. 4,837,124, JP 2-150848 A and JP 2-96514 A; sulfonium salts mentioned in EP 370693 B, EP 233567 B, EP 297443 B, EP 297442 B, EP 279210 B, EP 422570 B, U.S. Pat. No. 3,902,144, U.S. Pat. No. 4,933,377, U.S. Pat. No. 4,760,013, U.S. Pat. No. 4,734,444 and U.S. Pat. No. 2,833,827; diazonium salts (e.g., benzenediazonium salts which may be substituted), diazonium salt resins (e.g., formaldehyde resins of diazodiphenylamine), N-alkoxypyridinium salts (such as those mentioned in U.S. Pat. No. 4,743,528, JP 63-138345 A, JP 63-142345 A, JP 63-142346 A and JP 46-42363 B, a specific example being 1-methoxy-4-phenylpyridinium tetrafluoroborate), and the compounds mentioned in JP 52-147277 B, JP 52-14278 B and JP 52-14279 B. A radical or an acid is generated as the active species.

Exemplary organic peroxides (c) include substantially all organic compounds having one or more oxygen-oxygen bond in the molecule. For example, it is preferable to use a peroxidized ester such as 3,3',4,4'-tetrakis(t-butylperoxycarbonyl) benzophenone, 3,3',4,4'-tetrakis(t-amylperoxycarbonyl)benzophenone, 3,3',4,4'-tetrakis(t-hexylperoxycarbonyl) benzophenone, 3,3',4,4'-tetrakis(t-octylperoxycarbonyl) benzophenone, 3,3',4,4'-tetrakis(cumylperoxycarbonyl) benzophenone, 3,3',4,4'-tetrakis p-isopropylcumylperoxycarbonyl)benzophenone and di-t-butyldiperoxyisophthalate.

Exemplary hexaarylbiimidazoles (d) include the lophine dimers mentioned in JP 45-37377B and JP 44-86516 B, such as 2,2'-bis(o-chlorophenyl)-4,4',5,5'-tetraphenylbiimidazole, 2,2'-bis(o-bromophenyl)-4,4',5,5'-tetraphenylbiimidazole, 2,2'-bis(o,p-dichlorophenyl)-4,4',5,5'-tetraphenylbiimidazole, 2,2'-bis(o-chlorophenyl)-4,4',5,5'-tetrakis(m-methoxyphenyl)biimidazole, 2,2'-bis(o,o'-dichlorophenyl)-4,4',5,5'-tetraphenylbiimidazole, 2,2'-bis(o-nitrophenyl)-4,4',5,5'-tetraphenylbiimidazole, 2,2'-bis(o-methylphenyl)-4,4',5,5'-tetraphenylbiimidazole and 2,2'-bis(o-trifluorophenyl)-4,4',5,5'-tetraphenylbiimidazole.

Exemplary ketoxime esters (e) include 3-benzoyloxyiminobutan-2-one, 3-acetoxyiminobutan-2-one, 3-propionyloxyiminobutan-2-one, 2-acetoxyiminopentan-3-one, 2-acetoxyimino-1-phenylpropan-1-one, 2-benzoyloxyimino-1-phenylpropan-1-one, 3-p-toluenesulfonyloxyiminobutan-2-one and 2-ethoxycarbonyloxyimino-1-phenylpropane-1-one.

Exemplary borate compounds (f) include the compounds mentioned in U.S. Pat. No. 3,567,453, U.S. Pat. No. 4,343,891, EP 109,772 B and EP 109,773 B.

Exemplary azinium salt compounds (g) include the group of compounds having N—O bonds mentioned in JP 63-138345 A, JP 63-142345 A, JP 63-142346 A, JP 63-143537 A and JP 46-42363 B.

Exemplary metallocene compounds (h) include the titanocene compounds mentioned in JP 59-152396 A, JP 61-151197 A, JP 63-41484 A, JP 2-249 A, JP 2-4705 A, and the iron-arene complexes mentioned in JP 1-304453 A and JP 1-152109 A.

Specific examples of titanocene compounds include dicyclopentadienyl titanium dichloride, dicyclopentadienyl titanium bisphenyl, dicyclopentadienyl titanium bis-2,3,4,5,6-pentafluorophen-1-yl, dicyclopentadienyl titanium bis-2,3,5,6-tetrafluorophen-1-yl, dicyclopentadienyl titanium bis-2,4,6-trifluorophen-1-yl, dicyclopentadienyl titanium 2,6-difluorophen-1-yl, dicyclopentadienyl titanium bis-2,4-difluorophen-1-yl, dimethylcyclopentadienyl titanium bis-2,3,4,5,6-pentafluorophen-1-yl, dimethylcyclopentadienyl titanium bis-2,3,5,6-tetrafluorophen-1-yl, dimethylcyclopentadienyl titanium bis-2,4-difluorophen-1-yl, bis(cyclopentadienyl)-bis(2,6-difluoro-3-(pyr-1-yl)phenyl)titanium, bis (cyclopentadienyl)bis[2,6-difluoro-3-(methylsulfonamide) phenyl]titanium, bis(cyclopentadienyl)bis[2,6-difluoro-3-(N-butylbiaroylamino)phenyl]titanium.

Exemplary active ester compounds (i) include the nitrobenzyl ester compounds mentioned in EP 0290750 B, EP 046083 B, EP 156153 B, EP 271851 B, EP 0388343 B, U.S. Pat. No. 3,901,710, U.S. Pat. No. 4,181,531, JP 60-198538 A and JP 53-133022 A; the iminosulfonate compounds mentioned in EP 0199672 B, EP 84514 B, EP 199672 B, EP 044115 B, EP 0101122 B, U.S. Pat. No. 4,618,564, U.S. Pat. No. 4,371,605, U.S. Pat. No. 4,431,774, JP 64-18143 A, JP 2-245756 A, and JP 4-365048 A; and the compounds mentioned in JP 62-6223 B, JP 63-14340 B and JP 59-174831 A.

Preferred examples of compounds having carbon-halogen bonds (j) include the compounds mentioned by Wakabayashi et al. in *Bull. Chem. Soc. Japan* 42, 2924 (1969), the compounds mentioned in GB 1388492 B, the compounds mentioned in JP 53-133428 A, and the compounds mentioned in DE 3337024 B.

Additional examples include the compounds mentioned by F. C. Schaefer et al. in *J. Org. Chem.* 29, 1527 (1964), the compounds mentioned in JP 62-58241 A, the compounds mentioned in JP 5-281728 A, compounds such as those mentioned in DE 2641100 B, the compounds mentioned in DE 3333450 B, the groups of compounds mentioned in DE 3021590 B and the groups of compounds mentioned in DE 3021599 B.

Illustrative, non-limiting examples of the photopolymerization initiator used in the invention include the following compounds.

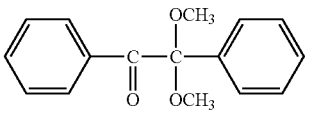

-continued
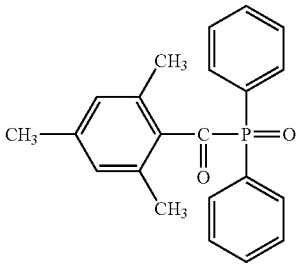
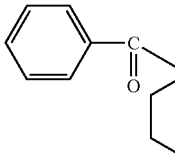
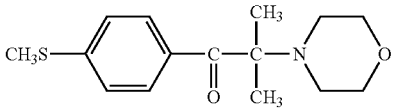
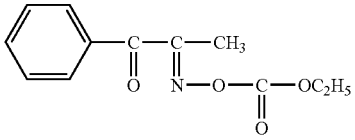
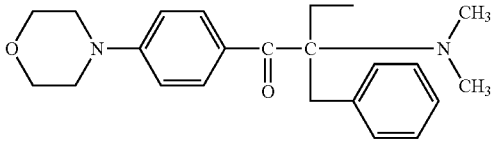
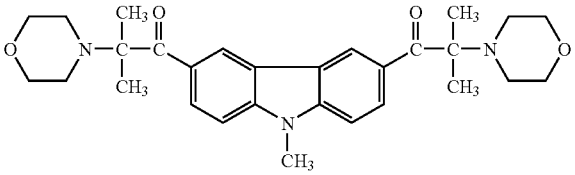
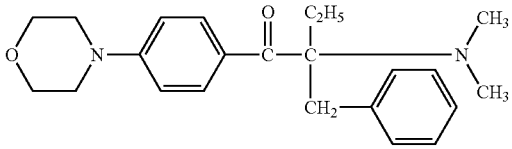
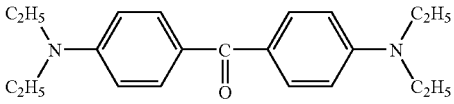
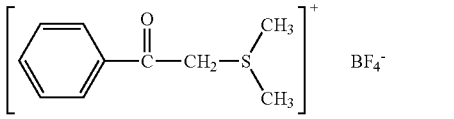
$BF_4^-$
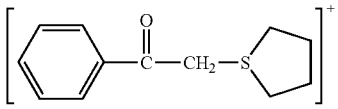
$PF_6^-$
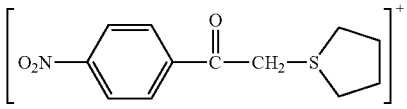
$AsF_6^-$
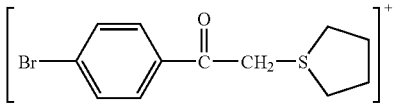
$SbF_6^-$
-continued
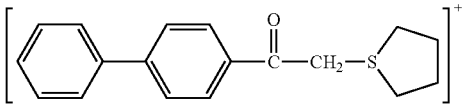
$FeCl_6^-$
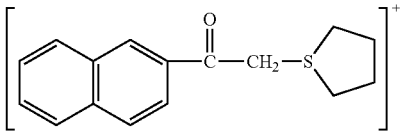
$SbCl_6^-$
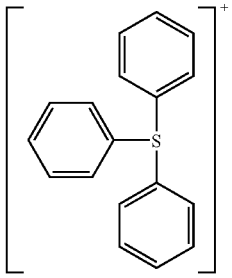
$SbCl_6^-$
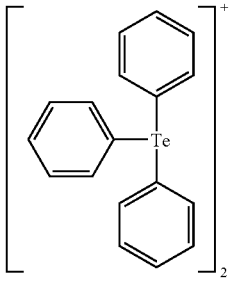
$BiCl_3^{2-}$
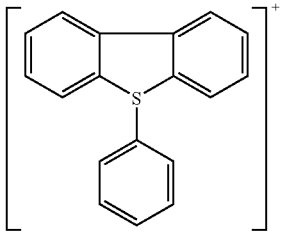
$BF_4^-$
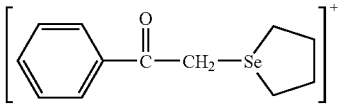
$PF_6^-$
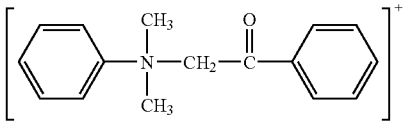
$BF_4^-$
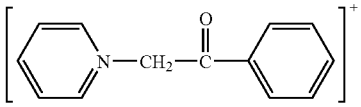
$SbF_6^-$
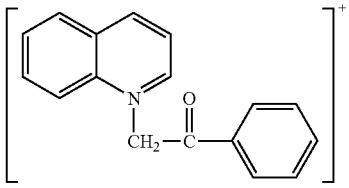
$BF_4^-$ -continued
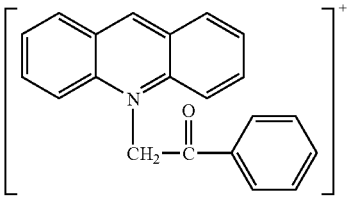
$BF_4^-$
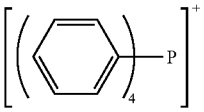
$BF_4^-$
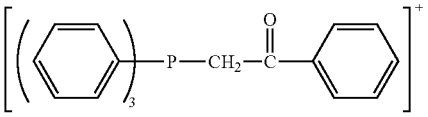
$AsF_6^-$
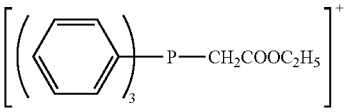
$PF_6^-$
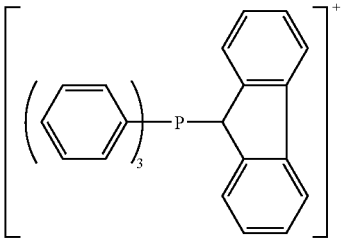
$BF_4^-$
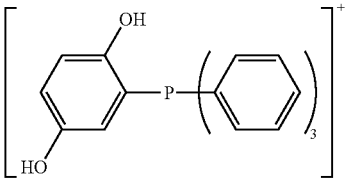
$BF_4^-$
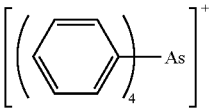
$BF_4^-$
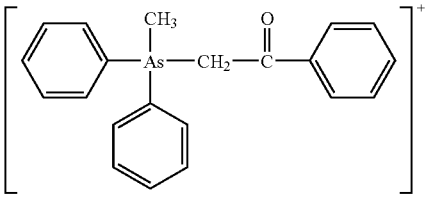
$BF_4^-$
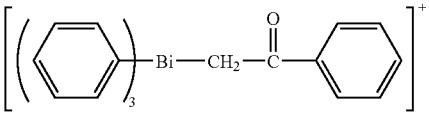
$BF_4^-$
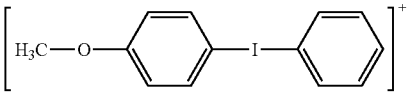
$BF_4^-$
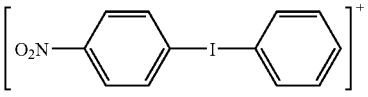
$BF_4^-$
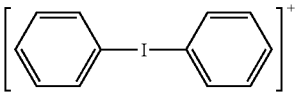
$PF_6^-$
-continued
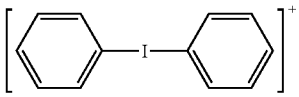
$SbF_6^-$
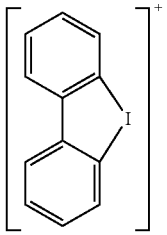
$BF_4^-$
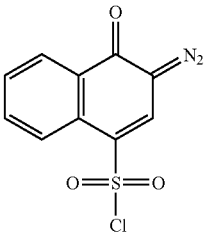
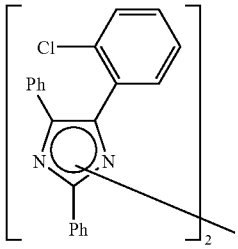
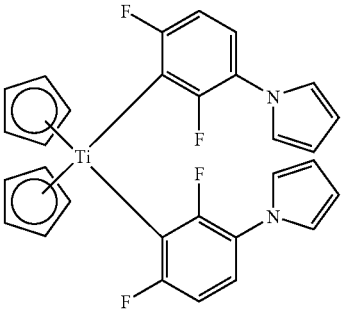
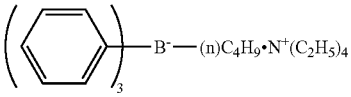
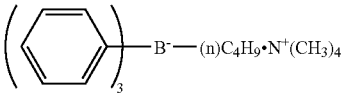
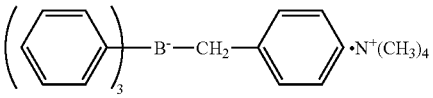
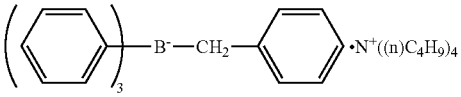
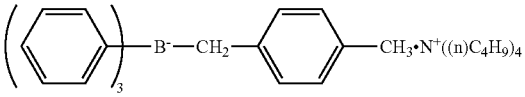
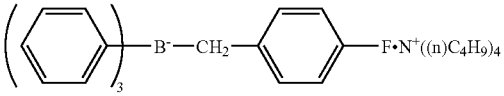
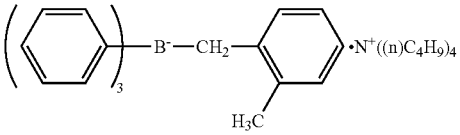
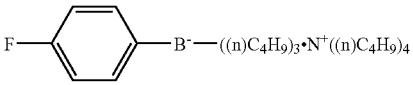

-continued

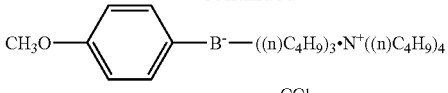

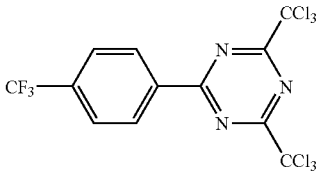

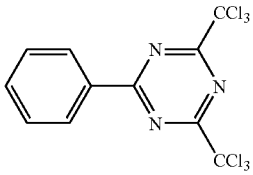

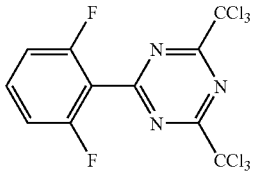

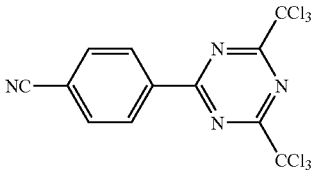

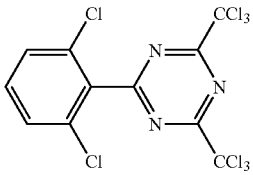

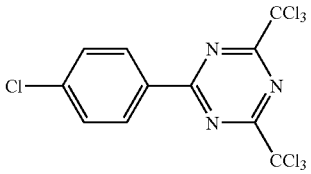

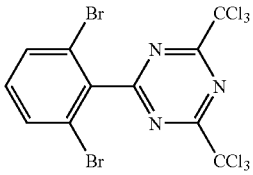

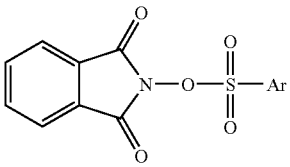

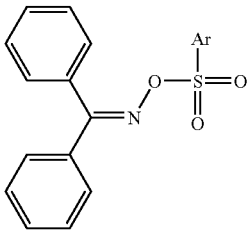

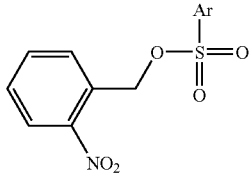

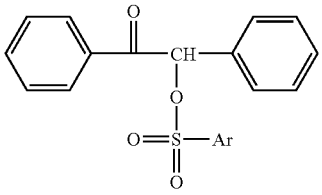

-continued

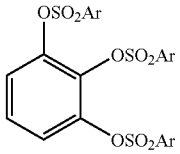

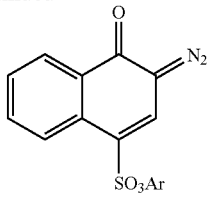

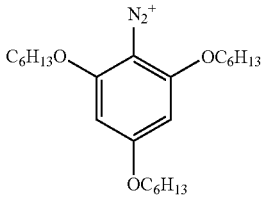

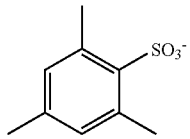

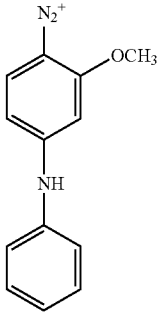

$PF_6^-$

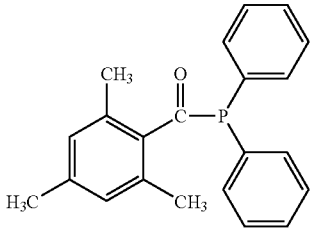

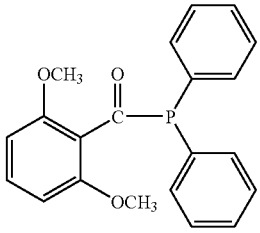

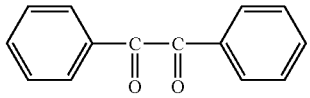

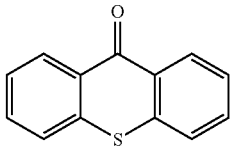

It is desirable for the polymerization initiator to have an excellent sensitivity, although from the standpoint of storage stability, the use of an initiator which does not trigger thermal decomposition at temperatures up to 80° C. is preferred.

The polymerization initiator may be used singly or as a combination of two or more thereof. To enhance the sensitivity, a known sensitizer may be used together with the initiator, insofar as the objects of the invention are attainable.

For a good stability over time, curability and cure rate, the content of the initiator in the undercoat liquid is preferably within a range of 0.5 to 20 wt %, more preferably 1 to 15 wt %, and most preferably 3 to 10 wt %, based on the polymerizable material in the undercoat liquid. By setting the content within the above range, problems such as deposition and separation over time, and deterioration in properties, including the strength and scuff resistance of the ink after curing, can be suppressed.

In addition to being included in the undercoat liquid, the polymerization initiator may also be included in the ink. If such an initiator is included in the ink, the initiator may be suitably selected and included within a range that enables the storage stability of the ink to be maintained at a desired level. In such a case, it is advantageous for the initiator content, based on the polymerizable or crosslinkable compound in the ink, to be set in a range of preferably 0.5 to 20 wt %, and more preferably 1 to 15 wt %.

(Sensitizing Dye)

It is desirable to add a sensitizing dye to the ink and/or undercoat liquid in order to enhance the sensitivity of the photopolymerization initiator. Preferred sensitizing dyes are exemplified by those compounds among the following which have an absorption wavelength in the range of 350 nm to 450 nm: polycyclic aromatic compounds (e.g., pyrene, perylene, triphenylene), xanthenes (e.g., fluorescein, eosin, erythrosine, rhodamine B, rose bengal), cyanines (e.g., thiacarbocyanine, oxacarbocyanine), merocyanines (e.g., merocyanine, carbomerocyanine), thiazines (e.g., thionine, methylene blue, toluidine blue), acridines (e.g., acridine orange, chloroflavine, acriflavine), anthraquinones (e.g., anthraquinone), squaliums (e.g., squalium) and coumarins (e.g., 7-diethylamino-4-methylcoumarin).

More preferred examples of sensitizing dyes include compounds having the general formulas IX to XIII below.

(IX)

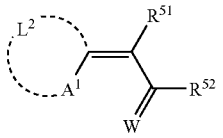

(X)

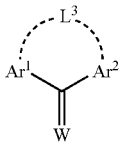

(XI)

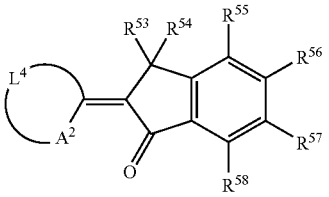

(XII)

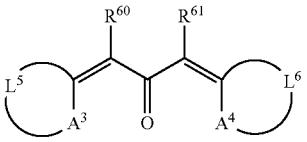

-continued (XIII)

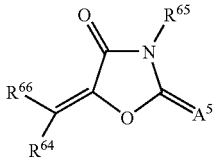

In formula IX, $A^1$ represents a sulfur atom or —$NR^{50}$—; and $R^{50}$ is an alkyl or aryl group; $L^2$ is a non-metallic atomic group which forms, together with the neighboring $A^1$ and the neighboring carbon atom, the basic nucleus of the dye. $R^{51}$ and $R^{52}$ are each independently a hydrogen atom or a monovalent non-metallic atomic group, and may bond together to form the acidic nucleus of the dye. W is an oxygen atom or a sulfur atom.

In formula X, $Ar^1$ and $Ar^2$ are each independently an aryl group, and are linked through -$L^3$-. Here, -$L^3$- represents —O— or —S—. W is the same as in general formula IX.

In formula XI, $A^2$ represents a sulfur atom or —$NR^{59}$—, and $L^4$ is a non-metallic atomic group which forms, together with the neighboring $A^2$ and carbon atom, the basic nucleus of the dye. $R^{53}$, $R^{54}$, $R^{55}$, $R^{56}$, $R^{57}$ and $R^{58}$ are each independently a monovalent non-metallic atomic group, and $R^{59}$ is an alkyl or aryl group.

In formula XII, $A^3$ and $A^4$ each independently represent —S—, —$NR^{62}$— or —$NR^{63}$—; $R^{62}$ and $R^{63}$ are each independently a substituted or unsubstituted alkyl group or a substituted or unsubstituted aryl group; $L^5$ and $L^6$ are each independently a non-metallic atomic group which forms, together with the neighboring $A^3$ and $A^4$ and the neighboring carbon atom, the basic nucleus of the dye; and $R^{60}$ and $R^{61}$ are each independently a hydrogen atom or a monovalent non-metallic atomic group, or may bond together to form an aliphatic or aromatic ring.

In formula XIII, $R^{66}$ is an aromatic ring or hetero ring which may be substituted; and $A^5$ is an oxygen atom, a sulfur atom or —$NR^{67}$—. $R^{64}$, $R^{65}$ and $R^{67}$ are each independently a hydrogen atom or a monovalent non-metallic atomic group, and $R^{67}$ may bond with $R^{64}$ and $R^{65}$ may bond with $R^{67}$ to form, respectively, an aliphatic or aromatic ring.

Preferred examples of compounds having general formulas IX to XIII include compounds A-1 to A-20 shown below.

(A-1)

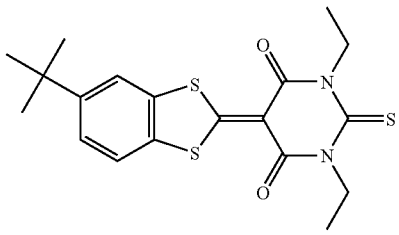

(A-2)

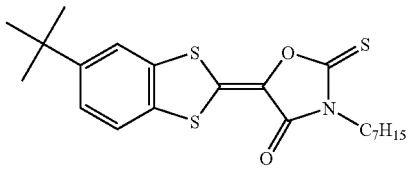

-continued
(A-3)
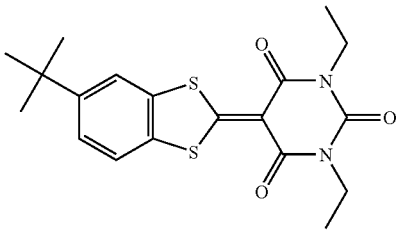
(A-4)
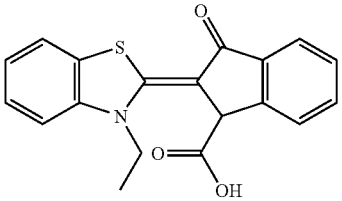
(A-5)
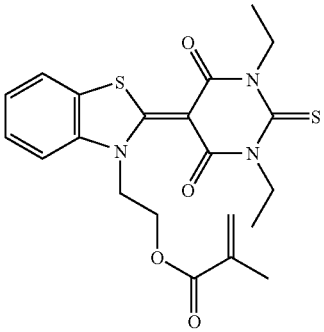
(A-6)
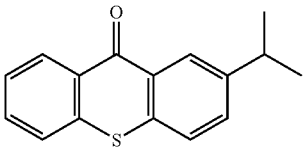
(A-7)
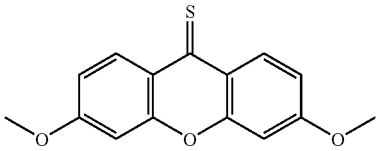
(A-8)
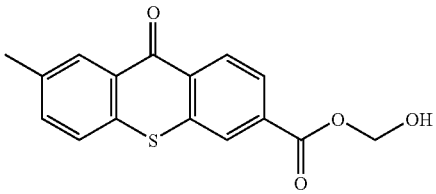
(A-9)
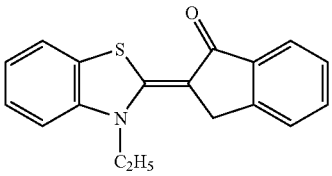
-continued
(A-10)
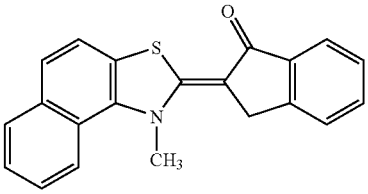
(A-11)
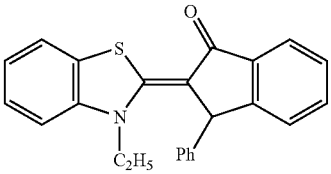
(A-12)
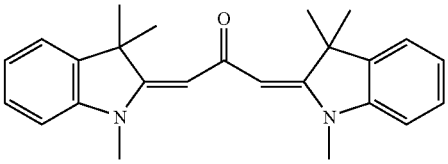
(A-13)
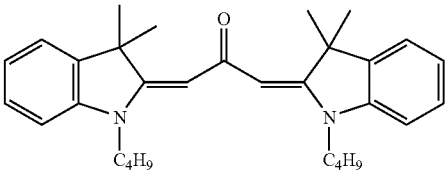
(A-14)
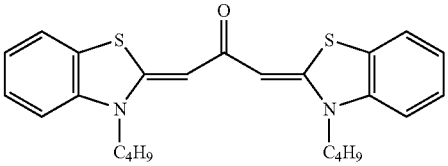
(A-15)
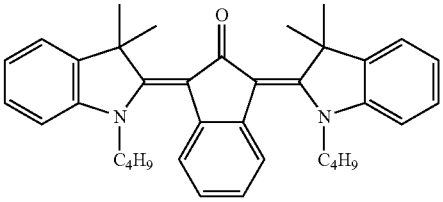
(A-16)
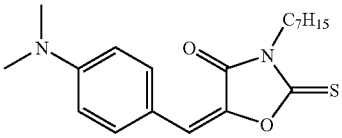
(A-17)
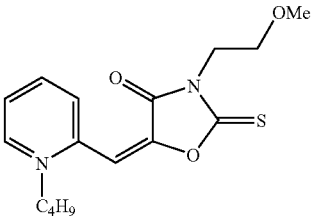

-continued (A-18)

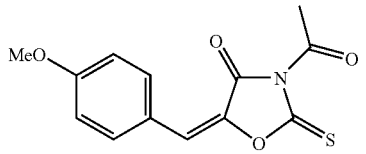

(A-19)

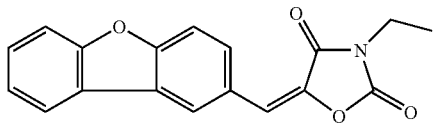

(A-20)

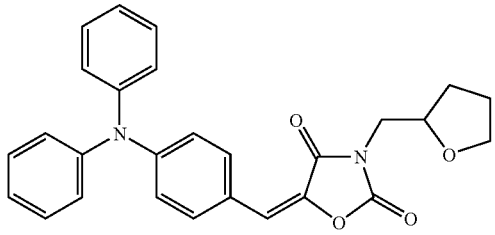

(Co-Sensitizer)

It is also desirable to add to the ink and/or undercoat liquid, as a co-sensitizer, a known compound which acts to, for example, further enhance the sensitivity or suppress the inhibition of polymerization by oxygen.

Exemplary co-sensitizers include compounds mentioned in, for example, M. R. Sander et al.: *Journal of Polymer Society* 10, 3173 (1972); JP 44-20189 B, JP 51-82102 A, JP 52-134692 A, JP 59-138205 A, JP 60-84305 A, JP 62-18537 A, JP 64-33104 A, and Research Disclosure 33825. Specific examples include triethanolamine, ethyl p-dimethylaminobenzoate, p-formyldimethylaniline and p-methylthiodimethylaniline.

Other exemplary co-sensitizers include the thiol compounds mentioned in JP 53-702 A, JP 55-500806 B and JP 5-142772 A, and the disulfide compounds mentioned in JP 56-75643 A. Specific examples of these include 2-mercaptobenzothiazole, 2-mercaptobenzoxazole, 2-mercaptobenzimidazole, 2-mercapto-4-(3H)-quinazoline and β-mercaptonaphthalene.

Still further examples include amino acid compounds (e.g., N-phenylglycine), the organometallic compounds mentioned in JP 48-42965 B (e.g., tributyltin acetate), hydrogen donors mentioned in JP 55-34414 B, the sulfur compounds mentioned in JP 6-308727 A (e.g., trithiane), the phosphorus compounds mentioned in JP 6-250387 A (e.g., diethylphosphite) and the Si—H and Ge—H compounds mentioned in JP 8-65779 A.

(Colorants)

At least the ink, or both the ink and the undercoat liquid, include at least one colorant. Colorants may be included not only in the ink, but also in the undercoat liquid and in other liquids.

The colorants used are not subject to any particular limitation, and may be suitably selected from among, for example, known water-soluble dyes, oil-soluble dyes and pigments. Of these, in cases where the ink and the undercoat liquid are composed of water-insoluble organic solvent systems capable of suitably achieving the objects of the invention, it is preferable for the colorant to be an oil-soluble dye or a pigment which can be easily dispersed or dissolved uniformly in the water-insoluble medium.

The colorant content of the ink is preferably from 1 to 30 wt %, more preferably from 1.5 to 25 wt %, and most preferably from 2 to 15 wt %. When a white pigment is included as a colorant in the undercoat liquid, the colorant content in the undercoat liquid is preferably from 2 to 45 wt %, and more preferably from 4 to 35 wt %.

Pigments suitable for use in the invention are described below.

Pigments:

The use of a pigment as the colorant is preferred.

The pigment used may be either an organic pigment or an inorganic pigment. Preferred black pigments include carbon black pigments. Black pigments and pigments in the three primary colors of cyan, magenta and yellow are generally used. Pigments having other hues, such as red, green, blue, brown and white; metal luster pigments such as those of gold and silver colors; and colorless or light-colored extender pigments may also be used according to the intended purpose.

Organic pigments are not limited as to their hue. Exemplary organic pigments include perylene, perinone, quinacridone, quinacridonequinone, anthraquinone, anthanthrone, benzimidazolone, disazo condensation, disazo, azo, indanthrone, phthalocyanine, triarylcarbonium, dioxazine, aminoanthraquinone, diketopyrrolopyrrole, thioindigo, isoindoline, isoindolinone, pyranthrone, isoviolanthrone pigments and mixtures thereof.

Specific examples include perylene pigments such as C.I. Pigment Red 190 (C.I. No. 71140), C.I. Pigment Red 224 (C.I. No. 71127) and C.I. Pigment Violet 29 (C.I. No. 71129); perinone pigments such as C.I. Pigment Orange 43 (C.I. No. 71105) and C.I. Pigment Red 194 (C.I. No. 71100); quinacridone pigments such as C.I. Pigment Violet 19 (C.I. No. 73900), C.I. Pigment Violet 42, C.I. Pigment Red 122 (C.I. No. 73915), C.I. Pigment Red 192, C.I. Pigment Red 202 (C.I. No. 73907), C.I. Pigment Red 207 (C.I. No. 73900, 73906) and C.I. Pigment Red 209 (C.I. No. 73905); quinacridonequinone pigments such as C.I. Pigment Red 206 (C.I. No. 73900/73920), C.I. Pigment Orange 48 (C.I. No. 73900/73920) and C.I. Pigment Orange 49 (C.I. No. 73900/73920); anthraquinone pigments such as C.I. Pigment Yellow 147 (C.I. No. 60645); anthanthrone pigments such as C.I. Pigment Red 168 (C.I. No. 59300); benzimidazolone pigments such as C.I. Pigment Brown 25 (C.I. No. 12510), C.I. Pigment Violet 32 (C.I. No. 12517), C.I. Pigment Yellow 180 (C.I. No. 21290), C.I. Pigment Yellow 181 (C.I. No. 11777), C.I. Pigment Orange 62 (C.I. No. 11775) and C.I. Pigment Red 185 (C.I. No. 12516); disazo condensation pigments such as C.I. Pigment Yellow 93 (C.I. No. 20710), C.I. Pigment Yellow 94 (C.I. No. 20038), C.I. Pigment Yellow 95 (C.I. No. 20034), C.I. Pigment Yellow 128 (C.I. No. 20037), C.I. Pigment Yellow 166 (C.I. No. 20035), C.I. Pigment Orange 34 (C.I. No. 21115), C.I. Pigment Orange 13 (C.I. No. 21110), C.I. Pigment Orange 31 (C.I. No. 20050), C.I. Pigment Red 144 (C.I. No. 20735), C.I. Pigment Red 166 (C.I. No. 20730), C.I. Pigment Red 220 (C.I. No. 20055), C.I. Pigment Red 221 (C.I. No. 20065), C.I. Pigment Red 242 (C.I. No. 20067), C.I. Pigment Red 248, C.I. Pigment Red 262 and C.I. Pigment Brown 23 (C.I. No. 20060); disazo pigments such as C.I. Pigment Yellow 13 (C.I. No. 21100), C.I. Pigment Yellow 83 (C.I. No. 21108) and C.I. Pigment Yellow 188 (C.I. No. 21094); azo pigments such as C.I. Pigment Red 187 (C.I. No. 12486), C.I. Pigment Red 170 (C.I. No. 12475), C.I. Pigment Yellow 74 (C.I. No. 11714), C.I. Pigment Yellow 150 (C.I. No. 48545), C.I. Pigment Red 48 (C.I. No. 15865), C.I. Pigment Red 53 (C.I. No. 15585), C.I. Pigment Orange 64 (C.I. No. 12760) and C.I. Pigment Red 247 (C.I. No. 15915); indanthrone pigments such as C.I. Pigment Blue 60 (C.I. No.

69800); phthalocyanine pigments such as C.I. Pigment Green 7 (C.I. No. 74260), C.I. Pigment Green 36 (C.I. No. 74265), C.I. Pigment Green 37 (C.I. No. 74255), C.I. Pigment Blue 16 (C.I. No. 74100), C.I. Pigment Blue 75 (C.I. No. 74160:2) and 15 (C.I. No. 74160); triarylcarbonium pigments such as C.I. Pigment Blue 56 (C.I. No. 42800) and C.I. Pigment Blue 61 (C.I. No. 42765:1); dioxazine pigments such as C.I. Pigment Violet 23 (C.I. No. 51319) and C.I. Pigment Violet 37 (C.I. No. 51345); aminoanthraquinone pigments such as C.I. Pigment Red 177 (C.I. No. 65300); diketopyrrolopyrrole pigments such as C.I. Pigment Red 254 (C.I. No. 56110), C.I. Pigment Red 255 (C.I. No. 561050), C.I. Pigment Red 264, C.I. Pigment Red 272 (C.I. No. 561150), C.I. Pigment Orange 71 and C.I. Pigment Orange 73; thioindigo pigments such as C.I. Pigment Red 88 (C.I. No. 73312); isoindoline pigments such as C.I. Pigment Yellow 139 (C.I. No. 56298) and C.I. Pigment Orange 66 (C.I. No. 48210); isoindolinone pigments such as C.I. Pigment Yellow 109 (C.I. No. 56284) and C.I. Pigment Orange 61 (C.I. No. 11295); pyranthrone pigments such as C.I. Pigment Orange 40 (C.I. No. 59700) and C.I. Pigment Red 216 (C.I. No. 59710); and isoviolanthrone pigments such as C.I. Pigment Violet 31 (C.I. No. 60010).

A combination of two or more organic pigments or organic pigment solid solutions may be used for the colorant.

In addition, any of the following may be used: particles composed of a core of e.g., silica, alumina or resin on the surface of which is fixed a dye or pigment, dyes that have been rendered into insoluble lakes, colored emulsions, and colored latexes. Resin-coated pigments may also be used. These are called microencapsulated pigments, and are commercially available from, for example, Dainippon Ink & Chemicals, Inc. and Toyo Ink Manufacturing Co., Ltd.

For a good balance of optical density and storage stability, the volume-average particle size of the pigment particles included in the liquid is preferably in a range of from 10 to 250 nm, and more preferably from 50 to 200 nm. Here, the volume-average particle size of the pigment particles may be measured by a particle size distribution analyzer such as the LB-500 manufactured by Horiba, Ltd.

A single colorant may be used alone or two or more colorants may be used in admixture. Differing colorants may be used for the respective droplets and liquids that are deposited, or the same colorant may be used.

(Other Components)

Known additives and ingredients other than those described above may also be used in the ink and/or undercoat liquid in accordance with the intended purpose.

Storage Stabilizer:

It is preferable to add a storage stabilizer to the ink and undercoat liquid (especially the ink) in order to inhibit undesirable polymerization during storage. It is desirable for the storage stabilizer to be used in the presence of a polymerizable or crosslinkable material. Also, it is advantageous for the storage stabilizer to be soluble in the droplet or liquid which includes it or in another ingredient present therein.

Exemplary storage stabilizers include quaternary ammonium salts, hydroxylamines, cyclic amides, nitriles, substituted ureas, heterocyclic compounds, organic acids, hydroquinone, hydroquinone monoethers, organic phosphines and copper compounds. Specific examples include benzyltrimethylammonium chloride, diethylhydroxylamine, benzothiazole, 4-amino-2,2,6,6-tetramethylpiperidine, citric acid, hydroquinone monomethyl ether, hydroquinone monobutyl ether and copper naphthenate.

It is preferable to suitably adjust the amount of storage stabilizer added based on the activity and polymerizability of the polymerization initiator or the polymerizability of the crosslinkable material, and on the type of storage stabilizer. However, for a good balance of storage stability and curability, it is advantageous to set the solids equivalent of the storage stabilizer in the liquid to from 0.005 to 1 wt %, more preferably from 0.01 to 0.5 wt %, and even more preferably from 0.01 to 0.2 wt %.

Conductive Salts:

Conductive salts are solid compounds which enhance the electrical conductivity. In the practice of the invention, owing to the concern that deposition may occur during storage, it is preferable for substantially no conductive salt to be used. However, in cases where the solubility is good because the solubility of the conductive salt has been increased or a conductive salt having a high solubility in the liquid component is used, a suitable amount of conductive salt may be added.

Exemplary conductive salts include potassium thiocyanate, lithium nitrate, ammonium thiocyanate and dimethylamine hydrochloride.

Solvents:

In the invention, a known solvent may be used if necessary. The solvent may be used for such purposes as to improve the polarity, viscosity and surface tension of the liquid (ink), to improve the solubility or dispersibility of the colored material, to adjust the electrical conductivity, and to adjust the printability.

For quick-drying properties and to record high-quality images having uniform line widths, it is preferable that the solvent be a water-insoluble liquid which contains no aqueous medium. Hence, a composition which uses a high-boiling organic solvent is desirable.

It is preferable for the high-boiling organic solvent to have an excellent compatibility with the components of the liquid, especially the monomer.

Specific examples of preferred solvents include tripropylene glycol monomethyl ether, dipropylene glycol monomethyl ether, propylene glycol monomethyl ether, ethylene glycol monobutyl ether, diethylene glycol monobutyl ether, triethylene glycol monobutyl ether, ethylene glycol monobenzyl ether and diethylene glycol monobenzyl ether.

Known solvents also include low-boiling organic solvents with boiling points of up to 100° C. However, owing to concerns over the adverse effects of solvents on curability and taking into account also environmental contamination by low-boiling organic solvents, it is desirable not to use such solvents. If a low-boiling organic solvent is used, the solvent is preferably a highly safe solvent. A "highly safe solvent" refers herein to a solvent having a high control level (the "control level" is an indicator used in the Working Environment Evaluation Standards issued by the Japanese Ministry of Health, Labor and Welfare) of preferably at least 100 ppm, and more preferably at least 200 ppm. Exemplary solvents of this type are alcohols, ketones, esters, ethers and hydrocarbons. Specific examples include methanol, 2-butanol, acetone, methyl ethyl ketone, ethyl acetate and tetrahydrofuran.

The solvent may be used singly or as combinations of two or more. When water and/or a low-boiling organic solvent are used, the amount in which both are used is preferably from 0 to 20 wt %, and more preferably from 0 to 10 wt %, based on each liquid (ink or undercoat liquid). The substantial absence of such solvents is especially preferred. The substantial absence of water in the ink and undercoat liquid used in the invention improves stability over time with respect to clouding of the liquid caused by, for example, a loss of homogeneity and dye deposition over time, and is also able to increase dryability when used on an impermeable or a slowly permeable recording medium. Here, "substantial absence" signifies that the presence of such solvent as an inadvertent impurity is allowable.

Other Additives:

Use can also be made of known additives such as polymers, surface tension adjusters, ultraviolet light absorbers, antioxidants, discoloration inhibitors and pH adjusters.

Known compounds may be suitably selected and used as the surface tension adjusters, ultraviolet light absorbers, antioxidants, discoloration inhibitors and pH adjusters. For example, use may be made of the additives mentioned in JP 2001-181549 A.

In addition to the above, a pair of compounds which, when mixed, react to form an agglomerate or thicken may be separately included in the ink and undercoat liquid according to the invention. This pair of compounds has the characteristic of either rapidly forming an agglomerate or rapidly thickening the liquid, thereby more effectively inhibiting the coalescence of mutually neighboring droplets.

Examples of reactions between the pair of compounds include acid-base reactions, hydrogen bonding reactions between a carboxylic acid and an amide group-bearing compound, crosslinking reactions such as between boronic acid and a diol, and reactions involving electrostatic interactions between cations and anions.

Although embodiments of the ink-jet head maintenance device, ink-jet unit, ink-jet recording device and ink-jet head maintenance method of the present invention have been described for illustrative purposes, those skilled in the art will appreciate that various modifications and improvements are possible without departing from the scope and spirit of the invention as disclosed in the accompanying claims.

By way of illustration, as described above, to achieve a higher quality in the images formed on the recording medium, it is preferable to semi-cure the undercoating liquid. However, the invention is not limited in this regard. For example, it is possible to fully cure the undercoating liquid that has been applied to the recording medium, then eject ink droplets onto the recording medium (more precisely, onto the undercoat) so as to form an image. Alternatively, it is possible to apply the undercoating liquid onto the recording medium, then eject ink droplets onto the recording medium (more precisely, onto the undercoat) and form an image without first curing the undercoating liquid, and subsequently carry out exposure to active rays so as to cure both the image areas and the undercoat on the recording medium at the same time.

The method used to semi-cure the undercoating liquid (undercoat) and/or the ink is exemplified by known thickening methods, including methods that use an agglomeration phenomenon, such as by furnishing a basic compound to an acidic polymer or by furnishing an acidic compound and a metal compound to a basic polymer; methods wherein the undercoating liquid (ink) is prepared beforehand to a high viscosity, then the viscosity is lowered by adding thereto a low-boiling organic solvent, after which the low-boiling organic solvent is evaporated so as to return the liquid to its original high viscosity; methods in which the undercoating liquid (ink) prepared to a high viscosity is first heated, then is cooled so as to return the liquid to its original high viscosity; and methods in which the undercoating liquid (ink) is semi-cured through a curing reaction induced by applying heat to the undercoating liquid (ink).

Of these, methods in which the undercoating liquid (ink) is semi-cured through a curing reaction induced by the application of heat or by irradiation with the above-described active energy rays are preferred.

In the present embodiment, an active energy-curable undercoating liquid and ink were used as the undercoating liquid and ink, and curing was effected by irradiating the undercoating liquid and ink with active energy rays. However, the invention is not limited in this regard. That is, use may be made of undercoating liquids and inks other than those which are active energy-curable. For example, images may be formed by means already known to the art using heat-curable inks. Likewise, a heat-curable liquid may be used as the undercoating liquid.

What is claimed is:

1. A maintenance device for an ink-jet head having a head substrate on a surface of which orifices for ejecting ink droplets are formed in an array having a direction, comprising:

a removal unit comprising a suction assembly which is disposed in a position that faces the surface of the head substrate having said orifices formed thereon and does not come into contact with the head substrate, and which has formed therein, on a surface opposite said head substrate surface on which said orifices are formed, a first suction port and a second suction port, each being slit-like and elongated in a direction parallel to an orifice array direction and mutually parallel and spaced apart in a direction perpendicular to the orifice array direction;

a suction pump which draws air from inside said suction assembly; and a soaking mechanism which, when said suction pump is at rest, discharges ink from said orifices in the ink-jet head so as to wet with the ink the surface of said head substrate on which said orifices are formed, wherein said first suction port is disposed at a position opposite to, in the direction perpendicular to the orifice array direction, one edge of each of said orifices, and said second suction port is disposed at a position opposite to, in the direction perpendicular to the orifice array direction, another edge of each of said orifices, and wherein said first suction port is disposed at a position straddling said one edge of each orifice and/or said second suction port is disposed at a position straddling said another edge of each orifice.

2. The ink-jet head maintenance device of claim 1, wherein said suction assembly has an interval between said first suction port and said second suction port which, in the direction perpendicular to the orifice array direction, is not more than R+L+2, where R represents a diameter in millimeters of the orifices in the direction perpendicular to the orifice array direction and L represents a size in millimeters of said first and second suction ports in the direction perpendicular to the orifice array direction.

3. The ink-jet head maintenance device of claim 1, wherein the removal unit further comprises:

a blowing member which is disposed adjacent to the suction assembly and which has formed therein, on the surface opposite said head substrate surface on which said orifices are formed, a blowing port being slit-like and elongated in the direction parallel to the orifice array direction, and a blowing pump which feeds air to the blowing member.

4. The ink-jet head maintenance device of claim 3, wherein said blowing port in said blowing member is disposed between said first suction port and said second suction port in the direction perpendicular to the orifice array direction.

5. The ink-jet head maintenance device of claim 1, wherein said first suction port and said second suction port are divided in the orifice array direction, respectively and have openings formed in rows parallel to the orifice array direction, respectively.

6. A maintenance device for an ink-jet head having a head substrate on a surface of which orifices for ejecting ink droplets are formed in an array having a direction, comprising:

a removal unit comprising a suction assembly which is disposed in a position that faces the surface of the head substrate having said orifices formed thereon and does not come into contact with the head substrate, and which has formed therein, on a surface opposite said head substrate surface on which said orifices are formed, a suction port elongated in a direction parallel to an orifice array direction in said ink-jet head, and a blowing member which is disposed adjacent to the suction assembly and has formed therein, on the surface opposite said head substrate surface on which said orifices are formed, a blowing port elongated in the direction parallel to the orifice array direction in said ink-jet head;

a suction pump which draws air from inside said suction assembly;

a blowing pump which feeds air to the blowing member; and a soaking mechanism which, when said suction pump is at rest, discharges ink from said orifices in the ink-jet head so as to wet with the ink the surface of said head substrate on which said orifices are formed, wherein said suction port is disposed at a position opposite to, in the direction perpendicular to the orifice array direction, one edge of each of said orifices, and said blowing port is disposed at a position opposite to, in the direction perpendicular to the orifice array direction, another edge of each of said orifices, and wherein said suction port is disposed at a position straddling said one edge of each orifice and/or said blowing port is disposed at a position straddling said another edge of each orifice.

7. The ink-jet head maintenance device of claim 6, wherein said suction port and said blowing port each have a length in the direction parallel to the orifice array direction which is longer than a spacing interval between said orifices formed in an array having a direction.

8. The ink-jet head maintenance device of claim 6, wherein said suction port and said blowing port are divided in the orifice array direction, respectively and have openings formed in rows parallel to the orifice array direction, respectively.

9. The ink-jet head maintenance device of claim 1, wherein said soaking mechanism further includes a liquid flow guide which is disposed in a position that faces the head substrate surface having said orifices formed thereon and does not come into contact with the head substrate, and which defines in an interval with the head substrate surface a flow channel for the ink discharged from the ink-jet head.

10. The ink-jet head maintenance device of claim 1, further comprising a removal unit moving mechanism which, when said suction pump is at rest, moves said removal unit in a direction perpendicular to the head substrate surface having said orifices formed thereon.

11. A maintenance device for an ink-jet head having a head substrate on a surface of which orifices for ejecting ink droplets are formed in an array having a direction, comprising:

a removal unit comprising a suction assembly which is disposed in a position that faces the surface of the head substrate having said orifices formed thereon and does not come into contact with the head substrate, and which has formed therein a suction port elongated in a direction parallel to an orifice array direction in said ink-jet head, and a moving mechanism which moves said at least one suction port on said suction assembly in a direction perpendicular to the orifice array direction;

a suction pump which draws air from inside said suction assembly; and a soaking mechanism which, when said suction pump is at rest, discharges ink from said orifices in the ink-jet head so as to wet with the ink the surface of said head substrate on which said orifices are formed, wherein said moving mechanism moves said suction port as said suction port aspirates air or ink or both with said suction pump so as to pass through both edges of each of the orifices.

12. The ink-jet head maintenance device of claim 11, wherein said moving mechanism moves said suction port as said suction port aspirates air or ink or both in the direction perpendicular to the orifice array direction and, relative to a center of said orifices, from a position opposite a portion of the head substrate that is farther away than one edge of each of the orifices to a position opposite a portion of the head substrate that is farther away than the other edge of each of the orifices.

13. The ink-jet head maintenance device of claim 11, wherein said moving mechanism reciprocatingly moves said at least one suction port in the direction perpendicular to the orifice array direction as said at least one suction port aspirates air or ink or both.

14. The ink-jet head maintenance device of claim 11, wherein said moving mechanism moves said suction port in a direction parallel to the head substrate surface on which said orifices are formed as said suction port aspirates air or ink or both.

15. The ink-jet head maintenance device of claim 11, wherein said moving mechanism rotates said at least one suction port about an axis which is a straight line that passes through a point farther from said orifices than the center of said suction assembly and is parallel to the orifice array direction as said at least one suction port aspirates air or ink or both.

16. The ink-jet head maintenance device of claim 11, wherein said soaking mechanism further includes a liquid flow guide which is disposed in a position that faces the head substrate surface having said orifices formed thereon, and which defines in an interval with the head substrate surface a flow channel for the ink discharged from the ink-jet head.

17. The ink-jet head maintenance device of claim 11, further comprising a removal unit moving mechanism which moves said removal unit in a direction perpendicular to the head substrate surface having said orifices formed thereon.

18. The ink-jet head maintenance device of claim 11, wherein said suction port is divided in the orifice array direction, respectively and have openings formed in rows parallel to the orifice array direction, respectively.

19. An ink-jet recording device comprising:

an ink-jet head having a head substrate on a surface of which orifices for ejecting ink droplets are formed in an array having a direction; and an ink-jet head maintenance device comprising:

a removal unit comprising a suction assembly which is disposed in a position that faces the surface of the head substrate having said orifices formed thereon and does not come into contact with the head substrate, and which has formed therein, on a surface opposite said head substrate surface on which said orifices are formed, a first suction port and a second suction port, each being slit-like and elongated in a direction parallel to an orifice array direction and mutually parallel and spaced apart in a direction perpendicular to the orifice array direction;

a suction pump which draws air from inside said suction assembly, and a soaking mechanism which, when said suction pump is at rest, discharges ink from said orifices in the ink-jet head so as to wet with the ink the surface of said head substrate on which said orifices are formed, wherein said first suction port is disposed at a position opposite to, in the direction perpendicular to the orifice array direction, one edge of each of said orifices, and said second suction port is disposed at a position opposite to, in the direction perpendicular to the orifice array direction, another edge of each of said orifices, and wherein said first suction port is disposed at a position straddling said one edge of each orifice and/or said second suction port is disposed at a position straddling said another edge of each orifice.

20. A method for maintaining an ink-jet head having a head substrate on a surface of which orifices for ejecting ink droplets are formed in an array having a direction, comprising the steps of:

discharging ink from said orifices of the head substrate so as to wet with said ink the surface of the head substrate on which said orifices are formed;

making a suction assembly approach a position that does not come into contact with the orifices on the head substrate surface having the orifices formed therein, said suction assembly having, on a surface opposite said head substrate surface on which said orifices are formed, a first suction port and a second suction port, each being slit-like and elongated in a direction parallel to an orifice array direction and mutually parallel and spaced apart in a direction perpendicular to the orifice array direction, said first suction port being disposed at a position opposite to, in the direction perpendicular to the orifice array direction, one edge of each of said orifices, and said second suction port being disposed at a position opposite to, in the direction perpendicular to the orifice array direction, another edge of each of said orifices, said first suction port is disposed at a position straddling said one edge of each orifice and/or said second suction port is disposed at a position straddling said another edge of each orifice; and aspirating from said first and second suction ports air or ink or both around the orifices, and thereby drawing off deposits from a periphery of said orifices on the head substrate.

21. The ink-jet head maintenance method of claim 20, which further comprises the steps of:

simultaneously making said suction assembly and a blowing member which has a blowing port elongated in the direction parallel to the orifice array direction and ejects air from said blowing port approach a position that does not come into contact with the orifices on the head substrate surface having the orifices formed therein; and aspirating from said first and second suction ports air or ink or both around the orifices and thereby drawing off deposits from the periphery of said orifices on said head substrate while ejecting air from the blowing port to the periphery of said orifices.

22. A method for maintaining an ink-jet head having a head substrate on a surface of which orifices for ejecting ink droplets are formed in an array having a direction, comprising the steps of:

discharging ink from said orifices of the head substrate so as to wet with said ink the surface of the head substrate on which said orifices are formed;

making a suction assembly that has a suction port elongated in a direction parallel to an orifice array direction and draws in air or ink or both from said suction port approach a position that does not come into contact with the orifices on the head substrate surface having the orifices formed therein; and aspirating from said suction port air or ink or both around the orifices, and simultaneously moving said suction port in the direction perpendicular to the orifice array direction so as to pass through both edges of each of the orifices, and thereby drawing off deposits from a periphery of said orifices on the head substrate.

23. The ink-jet head maintenance method of claim 22, which further comprises setting said suction assembly to a negative pressure at the interior thereof and, while drawing in air or ink or both from said suction port, reciprocatingly moving said suction port in the direction perpendicular to the orifice array direction.

24. The ink-jet head maintenance device of claim 1, wherein the soaking mechanism is an ink pressurizing mechanism pressurizing ink within a feed line that supplies the ink to the orifices of the head substrate to cause the ink to be discharged from the orifices.

* * * * *